US012214919B2

(12) United States Patent
Wu

(10) Patent No.: US 12,214,919 B2
(45) Date of Patent: Feb. 4, 2025

(54) TAPE PACKING APPARATUS

(71) Applicant: Meng Hsiu Wu, Lambare (PY)

(72) Inventor: Meng Hsiu Wu, Lambare (PY)

( * ) Notice: Subject to any disclaimer, the term of this patent is extended or adjusted under 35 U.S.C. 154(b) by 529 days.

(21) Appl. No.: 17/374,730

(22) Filed: Jul. 13, 2021

(65) Prior Publication Data

US 2023/0012620 A1 Jan. 19, 2023

(51) Int. Cl.

| | |
|---|---|
| ***B65B 51/06*** | (2006.01) |
| ***B65B 7/28*** | (2006.01) |
| ***B65B 13/04*** | (2006.01) |
| ***B65B 13/10*** | (2006.01) |
| ***B65B 13/12*** | (2006.01) |
| ***B65B 13/16*** | (2006.01) |
| ***B65B 13/18*** | (2006.01) |
| ***B65B 13/20*** | (2006.01) |
| ***B65B 57/00*** | (2006.01) |

(52) U.S. Cl.

CPC ..... *B65B 51/067* (2013.01); *B65B 7/2864* (2013.01); *B65B 13/04* (2013.01); *B65B 13/10* (2013.01); *B65B 13/12* (2013.01); *B65B 13/16* (2013.01); *B65B 13/183* (2013.01); *B65B 13/20* (2013.01); *B65B 57/00* (2013.01)

(58) Field of Classification Search

CPC ..... B65B 7/2864; B65B 13/04; B65B 13/10; B65B 13/12; B65B 13/16; B65B 13/183; B65B 13/20; B65B 51/06; B65B 51/067; B65B 57/00

USPC ..... 53/419, 137.2, 588; 100/4, 14, 27

See application file for complete search history.

(56) References Cited

U.S. PATENT DOCUMENTS

| | | | | |
|---|---|---|---|---|
| 2,743,562 | A * | 5/1956 | Dawson et al. | B65B 13/12 53/588 |
| 3,003,297 | A * | 10/1961 | Broadhead et al. | B65B 13/12 53/137.2 |
| 3,600,253 | A * | 8/1971 | Derenthal | B65B 13/10 100/27 |
| 6,159,328 | A | 12/2000 | Gaikoski et al. | |
| 6,910,820 | B2 | 6/2005 | Baker et al. | |
| 8,499,532 | B2 | 8/2013 | Park et al. | |
| 2010/0175836 | A1 | 7/2010 | Lam | |

(Continued)

FOREIGN PATENT DOCUMENTS

| | | | | |
|---|---|---|---|---|
| CN | 110758803 | A * | 2/2020 | B65B 13/18 |
| CN | 112061509 | A | 12/2020 | |

(Continued)

*Primary Examiner* — Stephen F. Gerrity

(74) *Attorney, Agent, or Firm* — Goldilocks ZONE IP Law

(57) ABSTRACT

Disclosed is a tape packing apparatus and method. The tape packing apparatus including: a supporting frame; a drive unit configured to install on the supporting frame; a tape head pressing arm configured to install on the supporting frame and connected to the drive unit, and the drive unit configured to drive the tape head pressing arm to move to a packing position such that the tap head is pressed onto an object to be packed; a cutting module configured to install on the supporting frame and connected with the driving unit, and the driving unit is constructed to drive the cutting module to the packing position to cut the tape. The tape packing apparatus provided by the embodiment of the present invention has good packing effect, can effectively shortens the packing time, has high packing efficiency, and saves manpower and costs.

19 Claims, 53 Drawing Sheets

(56) References Cited

U.S. PATENT DOCUMENTS

| | | | | |
|---|---|---|---|---|
| 2012/0199019 | A1* | 8/2012 | Kenney | B65B 13/04 100/27 |
| 2021/0179301 | A1* | 6/2021 | Kenney | B65B 13/12 |

FOREIGN PATENT DOCUMENTS

| | | | |
|---|---|---|---|
| JP | 2012515119 | A | 7/2012 |
| TW | 373621 | U | 11/1999 |

* cited by examiner

TAPE PACKING APPARATUS

TECHNICAL FIELD

This application relates to a field of packing equipment, and in particular to a tape packing apparatus and method.

BACKGROUND

With the development of the logistics industry, there is an increasing demand for boxes or cases required for packing, and how to seal boxes or cartons and facilitate subsequent openings has become an important issue.

Conventional carton box sealing machine dispenses 2 tapes onto a conventional box, one on top and one on the bottom. The top tape holds the 2 top-flaps together and the bottom tape holds the 2 bottom-flaps together. However, such conventional sealing system is useless and not suitable to close telescoping boxes. In order to properly seal a telescoping box, it is necessary to manually press the box down and manually dispense one tape at the time around the box and use a cutting tool to cut the tape so as to complete the sealing process. This process is usually done twice to completely and safely seal a box. This manual packing process is very slow and the labor cost is high.

Currently, there is an existing art can perform such sealing work by dispensing and banding 2 tapes around a telescoping box. However, due to its poor design such art is faulty and inefficient. It often fails to properly band the tapes onto the box, resulting in poor sealing and time wasting. The inefficiency derives from 2 design flaws:

1) The art uses a clamping system to hold the tip of the tape while the tape dispenser jumps start. Because the tape dispensing process jumps start at high speed, from time to time the tip of the tape gets rip out from the clamp, causing failure in the sealing process, consequently time is wasted.
2) In order to release the clamping system from the stickiness of the adhesive tape, it moves the clamping-arm in the opposite direction of the tape dispenser. This way of un-sticking the clamp depends on sheer brute force to rip the tape off the clamping-arm. Because adhesive tape is sticky, it often sticks to the clamping-arm strong enough so that when the clamp pulls away the tape bounces back like a rubber band. This tape bouncing often results in irregular sealing pattern and from time to time the tape bounces so hard that it actually comes off the box and gets pull way by the tape dispenser, consequently fails to seal the box.

SUMMARY

This application aims to solve at least one of the technical problems existing in the above-mentioned prior art or related technologies.

An embodiment of the present application provides a tape packing apparatus, device, wherein the tape packing device may include: a supporting frame; a drive unit configured to install on the supporting frame; a tape head pressing arm configured to install on the supporting frame and connected to the drive unit, and the drive unit is constructed to drive the tape head pressing arm to move to a packing position such that the tape head is pressed onto an object to be packed; a cutting module configured to install on the supporting frame and connected with the driving unit, and the driving unit is constructed to drive the cutting module to the packing position to cut the tape.

An aspect of the invention to provide a tape head pressing arm for pressing a tape against the box before the tape dispense starts cycling.

An aspect of the present invention is to provide a tape clamping and cutting arm to press the tail of the tape against the box to give a better finish at the end of the cycle.

The tape packing device according to an embodiment of the present invention has good packing effect, can effectively shortens the packing time, has high packing efficiency, and saves manpower and costs.

BRIEF DESCRIPTION OF DRAWINGS

Through the following description of the embodiments of the present application in conjunction with the accompanying drawings, the above and other objectives and features of the present application will become clearer.

FIGS. 13A and 13B show the second sub-operation process of the tape packing device according to an embodiment of the present invention; in which, FIG. 13A shows a process in which the tape head pressing arm is moving toward the tape head, and FIG. 13B shows a schematic diagram of a state in which the tape head pressing arm of the tape packing device is pressing the tape head according to an embodiment of the present invention (the second sub-operation process: 0.02 seconds);

FIGS. 14A and 14B show the third sub-operation process of the tape packing device according to an embodiment of the present invention, in which, FIG. 14A shows the process of clamping and cutting arm is retracting, FIG. 14B shows the state after the clamping and cutting arm is retracted (the third sub-operation process: 0.32 seconds);

FIGS. 15A and 15B show the fourth sub-operation process of the tape packing device according to an embodiment of the present invention, in which FIG. 15A shows the action process of the clamping support arm is moving away from the box, FIG. 15B shows the state after the clamping support arm is separated from the box (the 4th sub-operation process: 0.52 seconds);

FIGS. 16A and 16B show the fifth sub-operation process of the tape packing device according to an embodiment of the present invention, in which FIG. 16A shows a process of the retracting action of the horizontal press; FIG. 16B shows the state after the horizontal press is retracted (the fifth sub-operation process: 0.62 seconds);

FIGS. 17A and 17B show the sixth sub-operation process of the tape packing device according to an embodiment of the present invention, in which FIG. 17A shows a process of the vertical press is pressing down the box; FIG. 17B shows the state changing when the box cover moves down.

FIGS. 18A and 18B show the seventh sub-operation process of the tape packing device according to an embodiment of the present invention, in which, FIG. 18A shows a process of the horizontal press extends for the second time, FIG. 18B shows the state of the horizontal press after extension (the 7th sub-operation process: 0.90 seconds);

FIGS. 19A and 19B show the eighth sub-operation process of the tape packing device according to an embodiment of the present invention, in which, FIG. 19A shows the action process of the tape dispenser; FIG. 19B shows a state of the tape dispenser after starting (the 8th sub-operation process: 1.25 seconds);

FIGS. 20A and 20B show the ninth sub-operation process of the tape packing device of an embodiment of the present invention, in which, FIG. 20A shows the action process of the tape head pressing arm moving away from the box; FIG. 20B shows the state of the tape head pressing arm after moving away from the box (the 9th sub-operation process: 1.98 seconds);

FIGS. 21A and 21B respectively show the front perspective view and a rear perspective view of the tape packing device when the tape is wound for the first round (the 10th sub-operation process: 2.20 seconds);

FIGS. 22A and 22B show the eleventh sub-operation process of the tape packing device of an embodiment of the present invention, in which, FIG. 22A shows the action process of the clamping support arm moving close to the tape; FIG. 22B shows the state of the clamping support arm after moving close to the tape (the 11th sub-operation process: 2.45 seconds);

FIGS. 23A and 23B show the twelfth sub-operation process of the tape packing device of an embodiment of the present invention, in which, FIG. 23A shows a schematic diagram of the tape dispenser about to complete the second winding; FIG. 23B shows the state of the tape dispenser after the second winding is completed (the 12th sub-operation process: 2.81 seconds) is shown;

FIGS. 24A to 24D show the thirteenth sub-operation process of the tape packing device of an embodiment of the present invention, in which FIG. 24A shows a process of the clamping and cutting arm is moving and then cutting the tape; FIG. 24B to 24D show the state when the clamping and cutting arm being cutting the tape (the 13th sub-operation process: 2.90 seconds);

FIGS. 25A and 25B show the fourteenth sub-operation process of the tape packing device of an embodiment of the present invention, in which, FIG. 25A shows the action of the horizontal press moving away from the box, FIG. 25B shows the state of the horizontal press after it is away from the box (the 14th sub-operation process: 3.20 seconds);

FIGS. 26A and 26B show the fifteenth sub-operation process of the tape packing device of an embodiment of the present invention, in which, FIG. 26A shows a schematic diagram of the vertical press moving away from the box; FIG. 26B shows e state of the vertical press after it is away from the box (15th sub-operation process: 3.20 seconds);

REFERENCE NUMERALS

Figure 1:
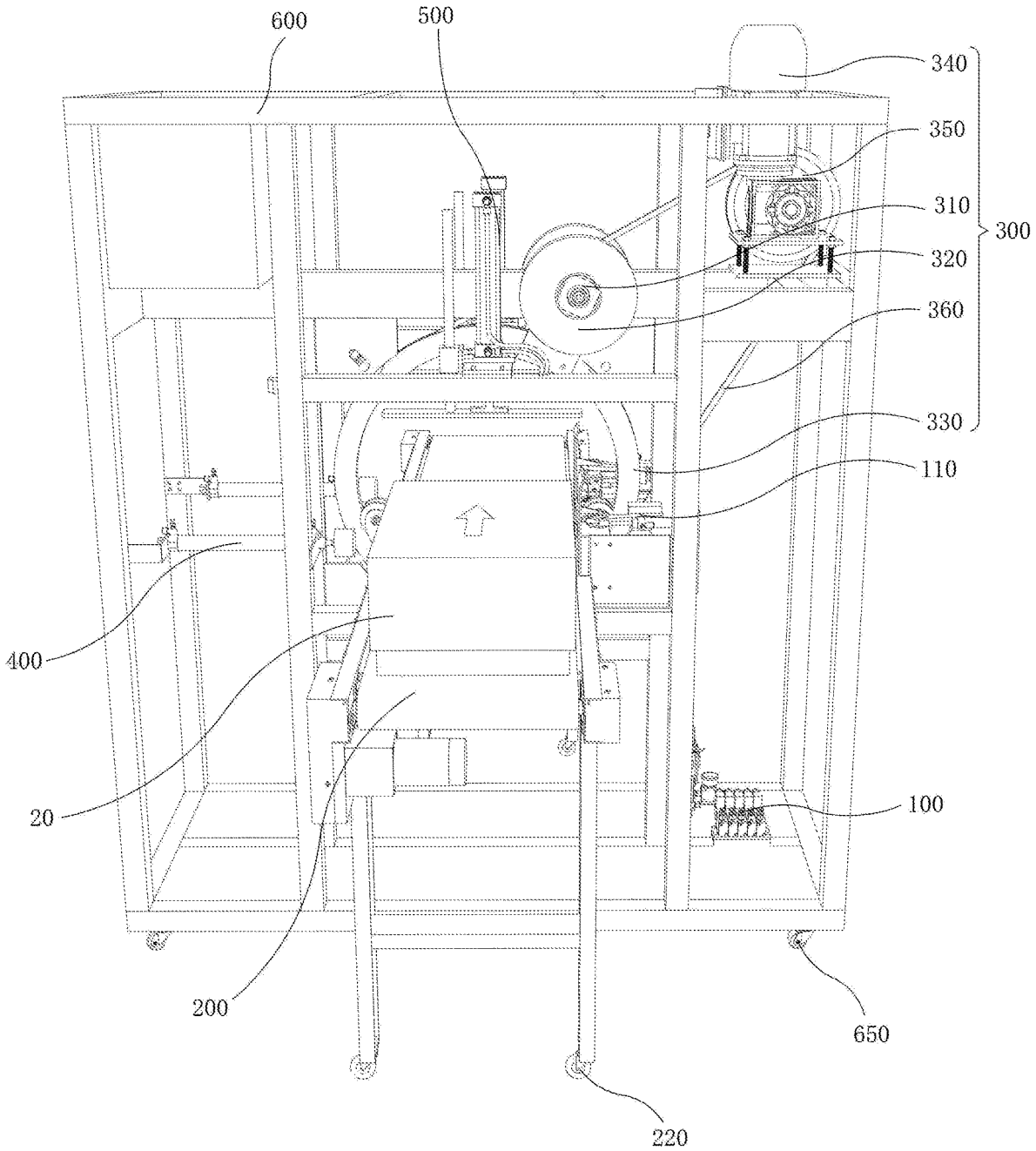
FIG. 1 shows a front view of a tape packing device according to an embodiment of the present invention.

10 tape packing device,
100 controller,
110 tape end processing unit,
120 tape head pressing arm, 121 pressing plate,
130 clamping support arm, 131 support roller,
140 clamping and cutting arm,
141 tape clamping arm,
142 cutting module, 142_1 cutting blade, 142_2 cutting blade support arm,
143 tape tail pressing arm,
150 drive unit,
160 first drive unit, 161 first transmission shaft,
170 a second drive unit, 171 a second transmission shaft,
180 third drive unit, 181 third transmission shaft,
190 support frame, 191 first support plate 19 second support plate,
193 third support plate, 194 first rotating shaft, 195 second rotating shaft,
196 third rotating shaft, 197 first baffle, 198 drive unit support frame,
199 second baffle,
200 packing platform, 210 supporting stand platform, 220 first roller,
230 first conveying part, 240 second conveying part,
300 tape dispenser, 310 tape mounting seat, 320 tape, 330 first transmission wheel,
340 first transmission wheel driver, 350 second transmission wheel,
360 transmission belt,
400 horizontal press, 410 fourth telescopic rod, 420 horizontal pressure plate,
500 vertical press, 510 fifth telescopic rod, 520 vertical pressing plate,
600 main frame, 610 cover, 620—emergency stop button, 630 adjustment knob, 640 start
button, 650 second roller,
700 memory,
20 box.

DETAILED DESCRIPTION

In order to make the invention objectives, technical solutions, and advantages of the present invention more obvious, the exemplary embodiments according to the present invention will be described in detail below with reference to the accompanying drawings. Obviously, the described embodiments are only a part of the embodiments of the present invention, rather than all the embodiments of the present invention, and it should be understood that the present invention is not limited by the exemplary embodiments described herein. Based on the embodiments of this invention described in this invention, other embodiments obtained by those skilled in the art without creative work should fall within the protection scope of this invention.

In the following description, a lot of specific details are given in order to provide a more thorough understanding of this invention. However, it is obvious to those skilled in the art that this invention can be implemented without one or more of these details. In other examples, in order to avoid confusion with this invention, some technical features known in the art are not described.

It should be understood that this invention can be implemented in different forms. It should not be interpreted as being limited to the embodiments presented here. On the contrary, the provision of these embodiments will make the disclosure thorough and complete, and will fully convey the scope of the invention to those skilled in the art.

The purpose of the terms used here is only to describe specific embodiments and not as a limitation of the present invention. As used herein, the singular forms of "a" and "an", as well as descriptions that do not indicate a quantity, are also intended to include the plural form, unless the context indicates otherwise. It should also be understood that the term "comprising" and "including", used in this specification indicate the existence of the described features, steps, operations, units, and/or components, but do not exclude one or more other features, steps, operations, units, and/or the presence of components. As used herein, the term "and/or" includes any and all combinations of related listed items.

It will be understood that when an element or layer is referred to as being "connected to" or "adjacent to" another element or layer, it can be connected to or adjacent to the other element or layer, or one or more intervening elements or layers may be present. In contrast, when an element or layer is referred to as being "directly connected to" or "immediately adjacent to" another element or layer, there are no intervening elements or layers present.

The tape packing device 10 of some embodiments of the present invention and its control method will be described in detail below with reference to the accompanying drawings to illustrate the technical solution proposed by the present invention. However, in addition to these detailed descriptions, the present invention may also have other implementation manners.

It should be noted that the term "packing position" in the present invention refers to the position where each operating arm moves toward the object to be packed such that the packing operation can be performed, rather than a position of a point in space. For example, for each operating arm, the "packing position" refers to the position where each operating arm is close to the object to be packed so that the tape or the object to be packed can be operated. For the object to be packed, the "packing position" means the location where the object can be wound by the tape for bundling.

The object to be packed can be boxes or cartons or other items to be bundled. Hereinafter, the embodiment of the present invention will be described by taking the box 20 as an object to-be-packed as an example.

Figure 2:
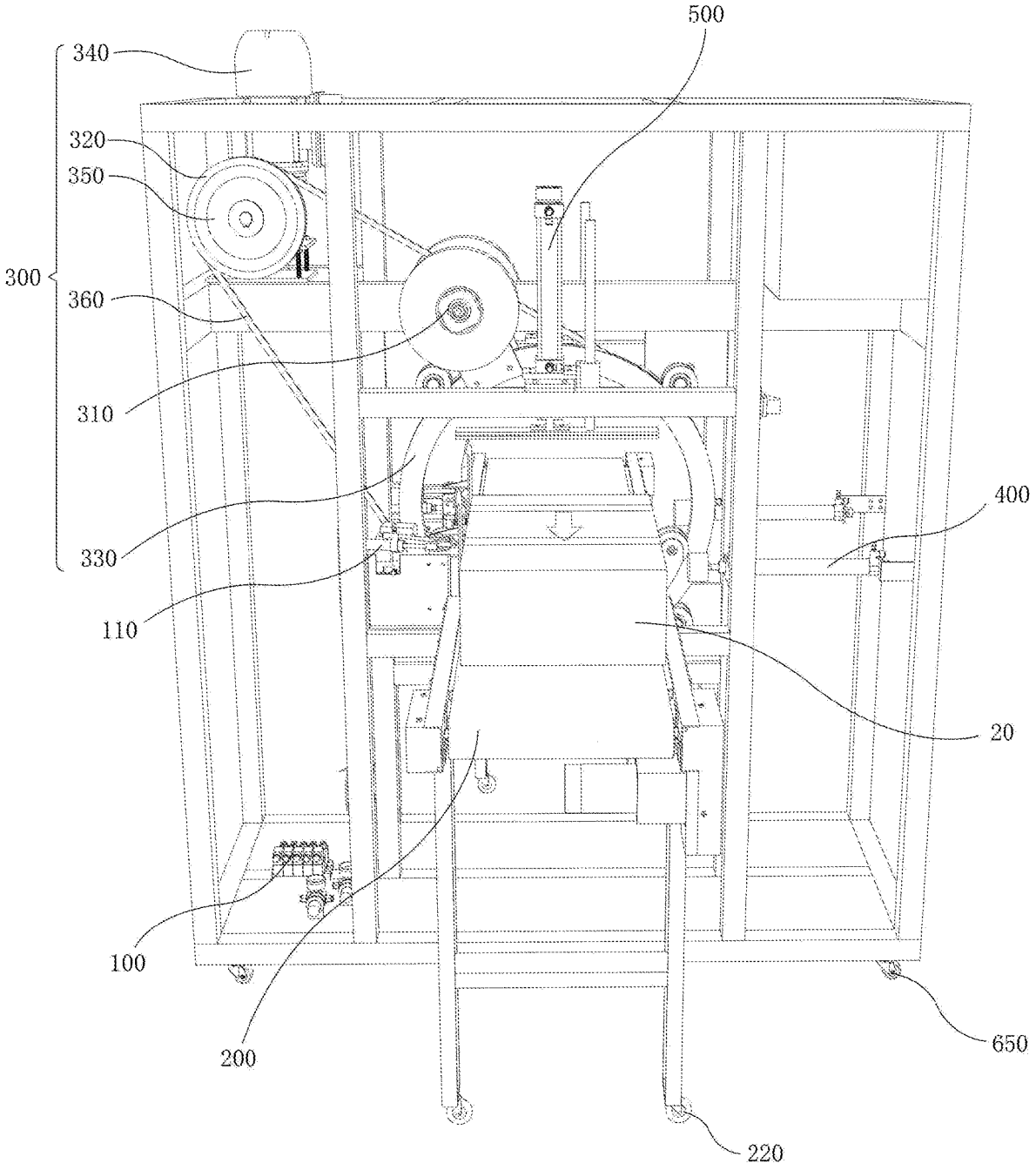
FIG. 2 shows a rear view of the tape packing device according to an embodiment of the present invention.

FIG. 1 shows a front view of a tape packing device 10 according to an embodiment of the present invention. FIG. 2 shows a schematic rear view of the tape packing device 10 according to an embodiment of the present invention. As shown in FIGS. 1 and 2, the tape packing device 10 includes a main frame 600, a tape end processing unit 110 mounted on the main frame 600, a tape dispenser 300, a horizontal press 400, a vertical press 500, and a packing platform 200 and a controller 100. The packing platform 200 is used to support and transport object to be packed, for example, the box 20 shown in the figures. The controller 100 is used to control the horizontal press 400 to push the box 20 to be positioned at a packing position. The controller 100 also controls the vertical press 500 to press the box 20 downward to compress the box 20 tightly, for example, to press a cover of the box 20 downward so that the cover stably covers the opening of the box. The controller 100 can also control the tape mounting seat 310 of the tape dispenser 300 to rotate around the packing platform 200 so that the tape 320 on the tape mounting seat 310 is wound around the box 20 to bind the box 20. The controller 100 can also control the tape end processing unit 110 to clamp and cut the tape 320, and also push the head and tail of the tape 320 to be adhered to the box 20.

Figure 3:
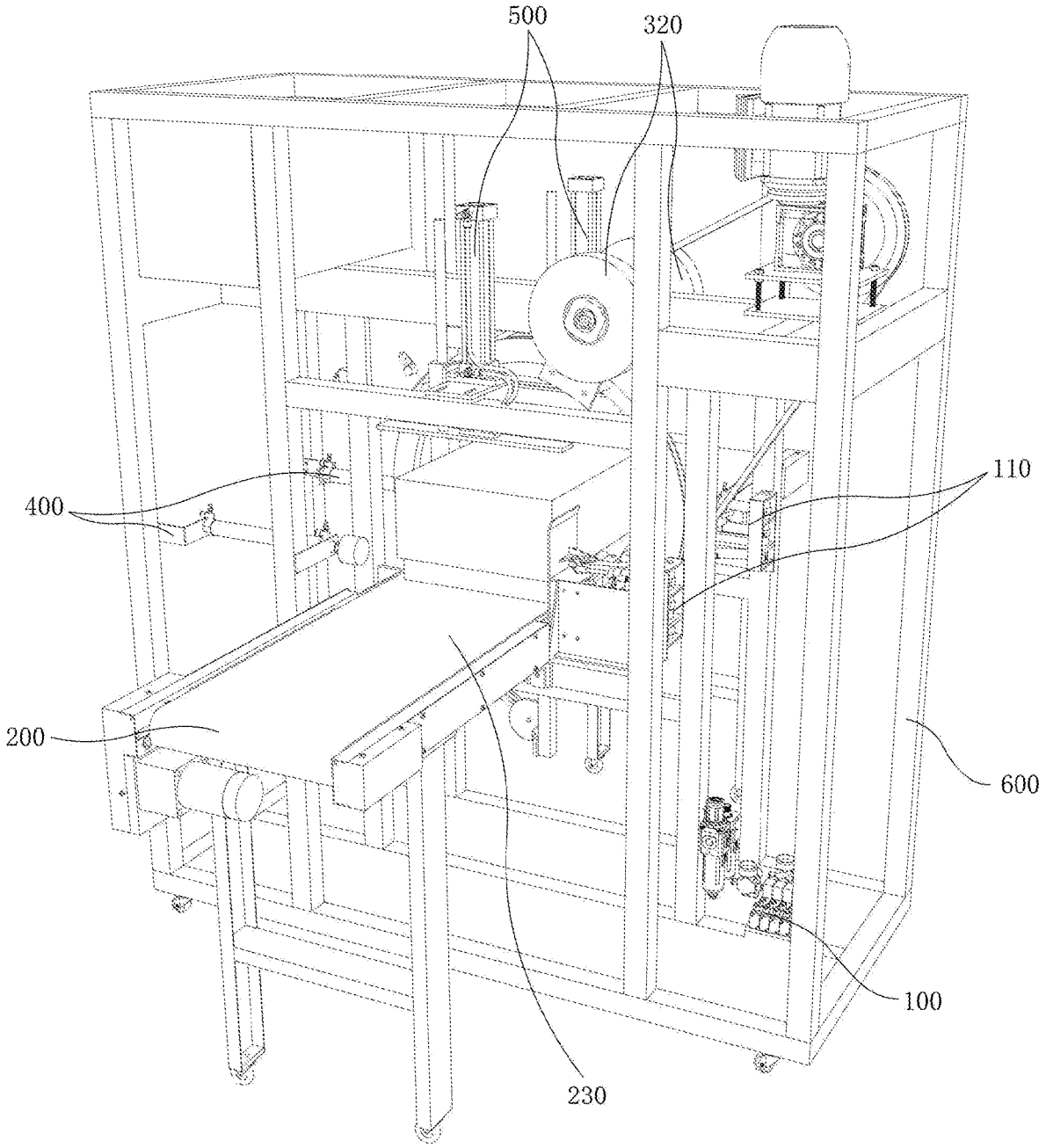
FIG. 3 shows a perspective view of a tape packing device according to an embodiment of the present invention.
Figure 4:
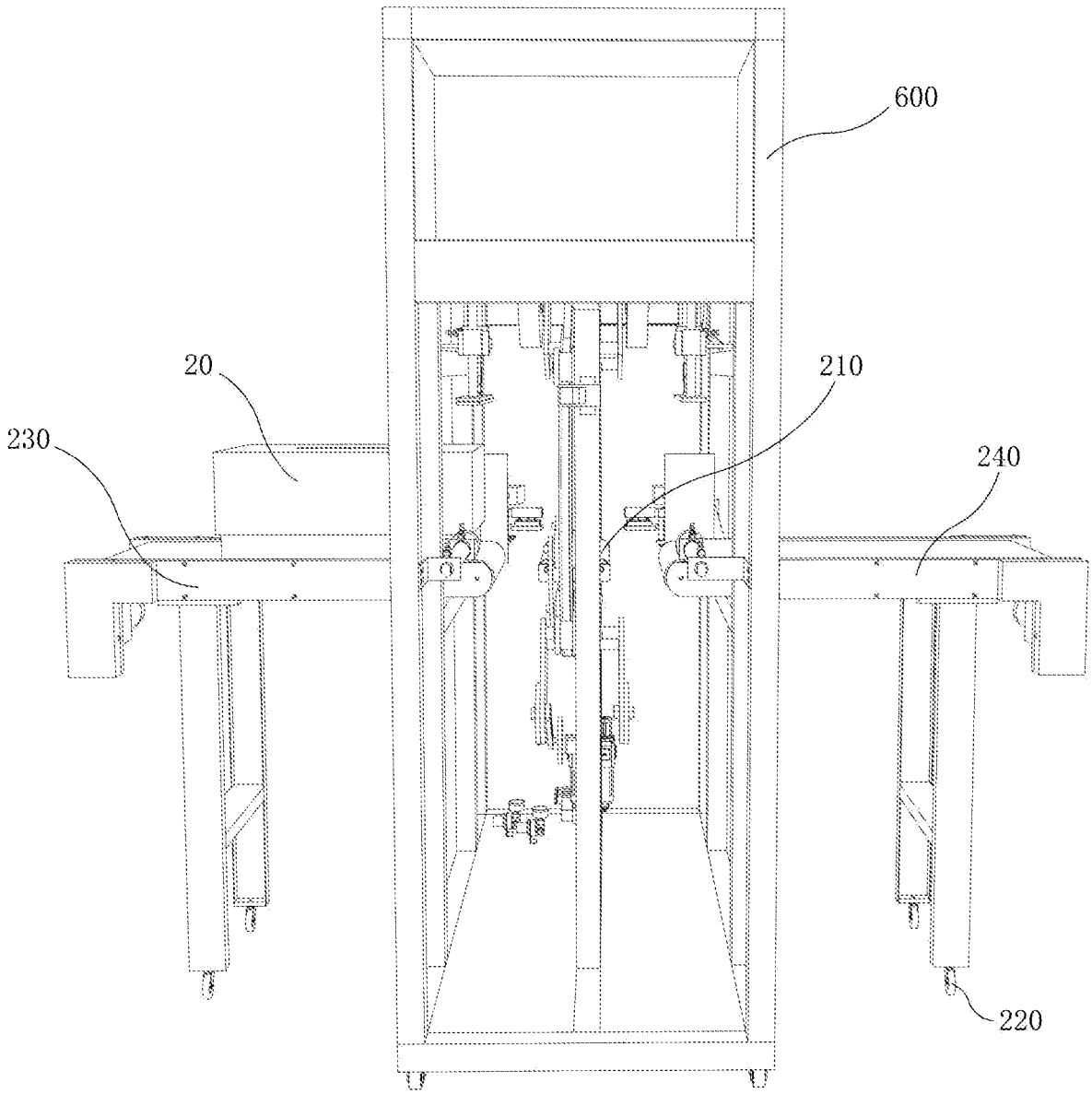
FIG. 4 shows a left side view of the tape packing device according to an embodiment of the present invention.
Figure 5:
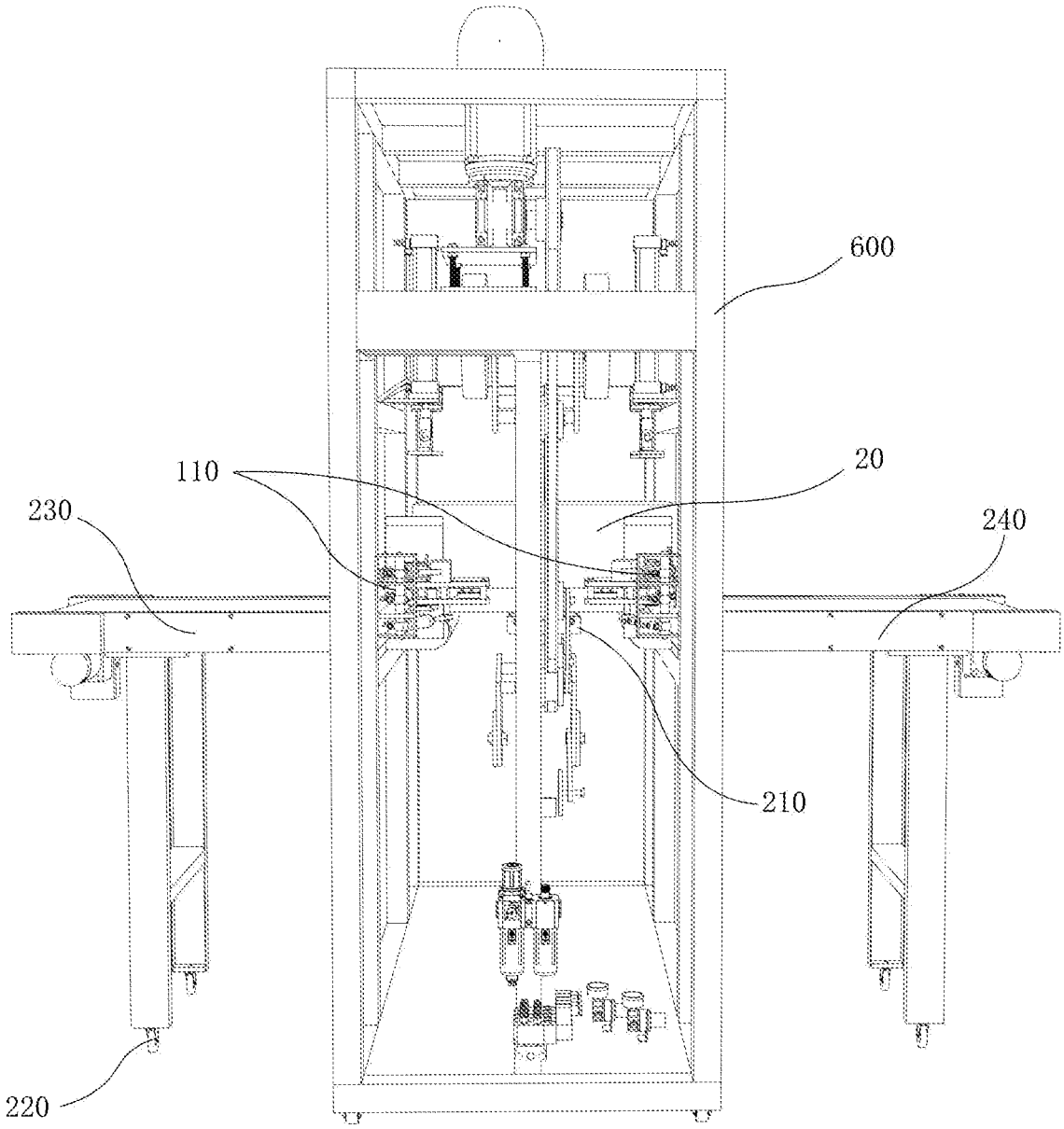
FIG. 5 shows a right-side view of the tape packing device according to an embodiment of the present invention.

FIG. 3 shows a perspective view of the tape packing device 10 according to an embodiment of the present invention. FIG. 4 shows a left side view of the tape packing device 10 according to an embodiment of the present invention. FIG. 5 shows a right-side view of the tape packing device 10 according to an embodiment of the present invention.

As shown in FIGS. 2 to 5, there may provide two tape end processing units 110. Similarly, the number of tape mounting seat 310 in the horizontal press 400, the vertical press 500, and the tape dispenser 300 may also be two, so as to wind the tape 320 on both ends of the box 20 respectively. When the box 20 is placed on the packing platform 200, both ends of the box 20 can be tied with the tape 320 at the same time. However, it is not limited thereto.

Figure 6:
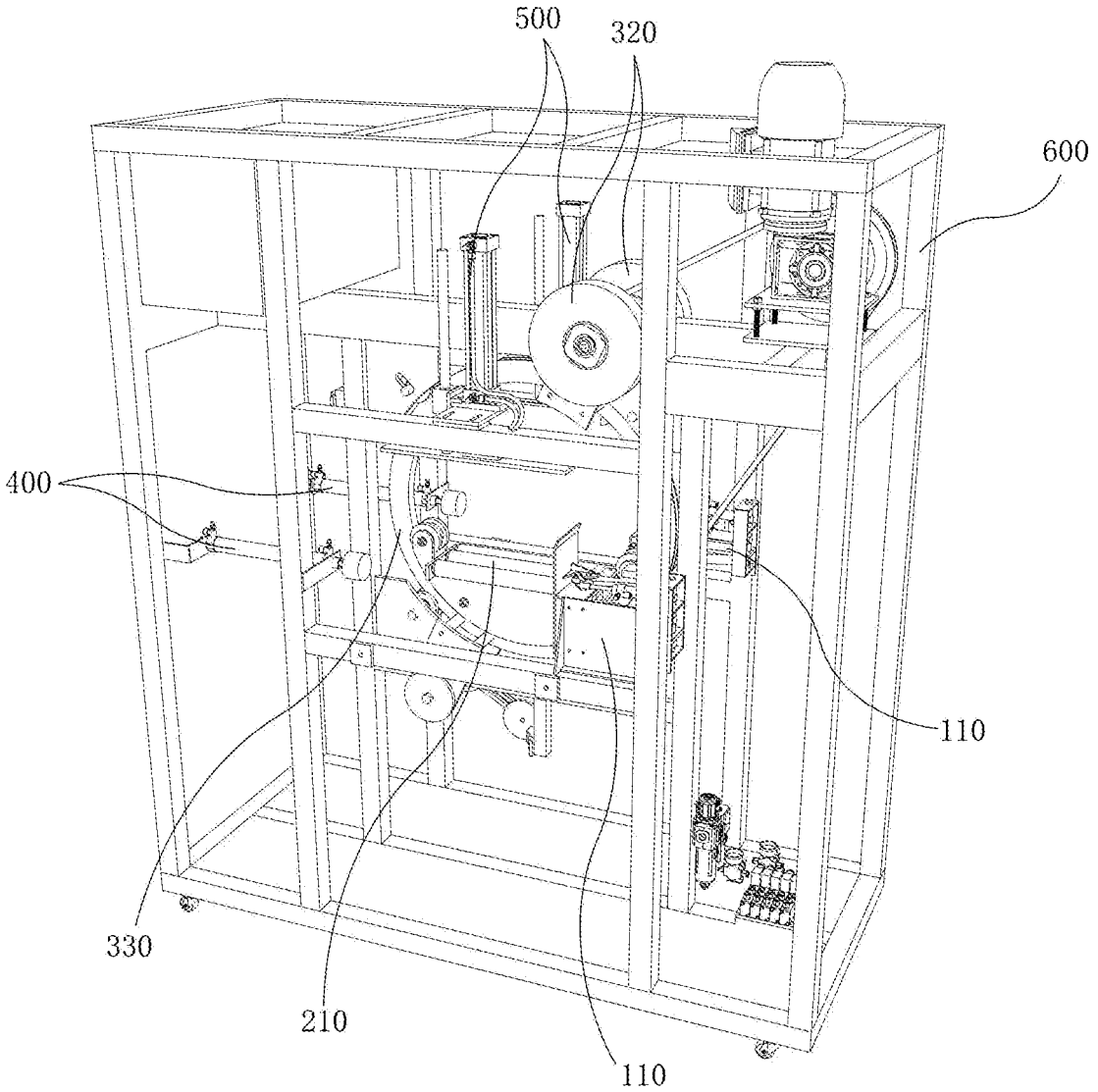
FIG. 6 shows a perspective view of the tape packing device according to an embodiment of the present invention with the conveying parts removed.

FIG. 6 shows a three-dimensional schematic diagram of the tape packing device 10 according to an embodiment of the present invention with the conveying parts removed. In this embodiment, the tape packing device 10 may include two tape end processing units 110, which may be referred to as a front-end tape end processing unit and a rear-end tape end processing unit, respectively, to process two tapes 320 at the front and rear ends of the box. In this embodiment, the structures of the two tape end processing units 110 may be completely the same and arranged symmetrically. Of course, in other embodiments, the two tape end processing units 110 may not be completely the same, and may also be arranged asymmetrically.

In the examples shown in FIG. 1 and FIG. 6, by bundling two positions of the box 20 at the same time, the packing efficiency and the packing effect are improved, and the packing time and cost are saved. However, the technical solution of the present invention is not limited by this example, and can also bind one position of the box 20, or bind three or more positions of the box 20.

Figure 7A:
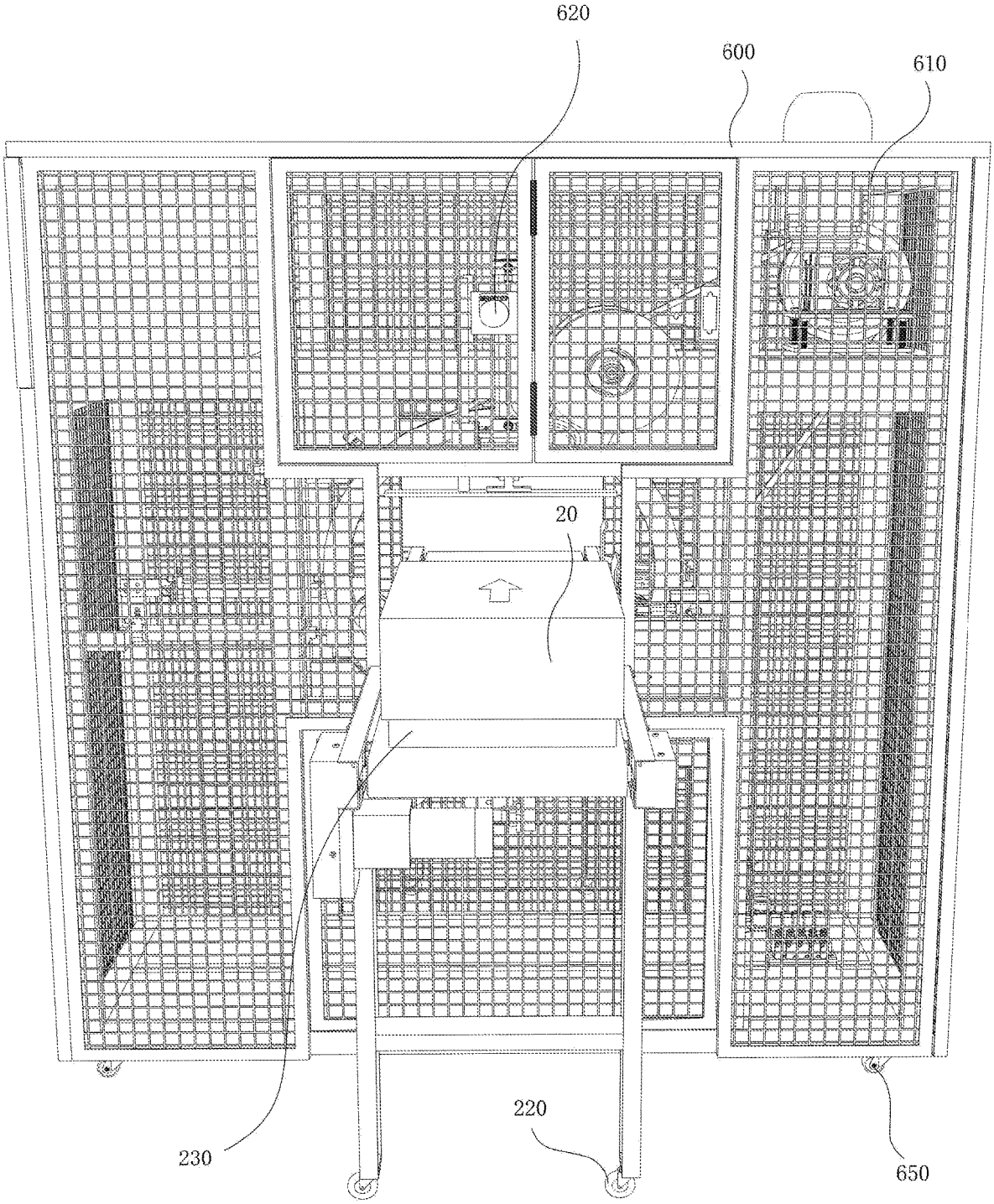
FIGS. 7A and 7B shows a schematic front view and a schematic rear view of the tape packing device with a housing according to an embodiment of the present invention.
Figure 7B:
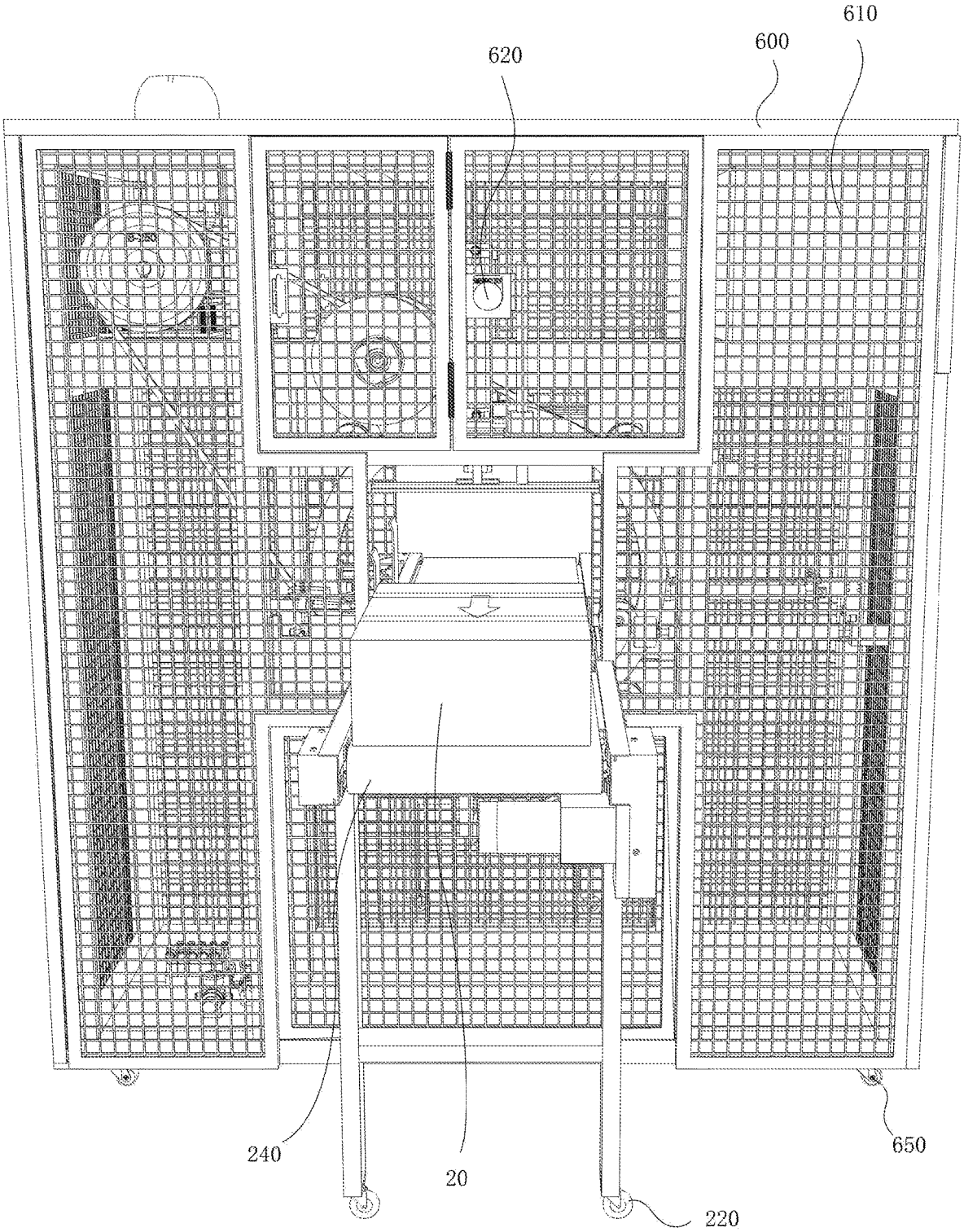
Figure 8:
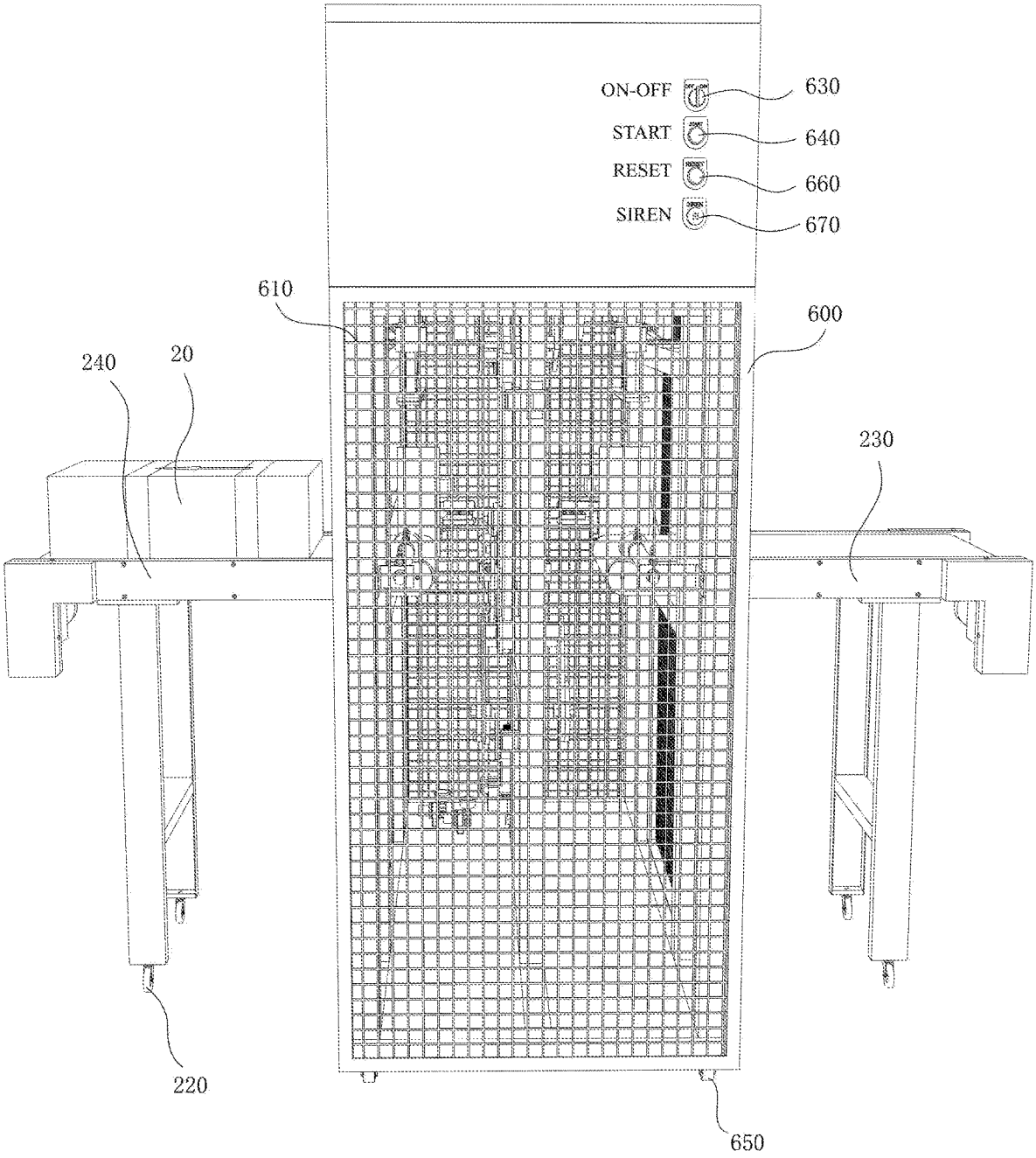
FIG. 8 shows a schematic side view of the tape packing device with a housing according to an embodiment of the present invention.

FIGS. 7A, 7B and 8 respectively show the front view, rear view and side view of the tape packing device 10 with a housing 610 according to an embodiment of the present invention. As shown in FIGS. 7A, 7B and 8, the tape packing device 10 may further include a housing 610, which is used to shield the internal structure and protect the internal components on the one hand, and on the other hand to prevent the user from getting hurt by mistaken insertion. The main frame 600 is provided with a plurality of operation buttons, such as an emergency stop button 620, a switch knob 630, a power button 640, a reset button 660 and a siren 670. In order to facilitate the user's touch and operation, the switch knob 630, the power button 640, the reset button 660 and the siren 670 can be set on the side of the main frame 600. An emergency stop button 620 is arranged on the front and back of the main frame 600. A plurality of rollers 650 are provided at the bottom of the main frame 600 to facilitate the movement of the main frame 600.

FIGS. 9A, 9B, 9C, and 9D show schematic structural diagrams of the front-end tape end processing unit according to an embodiment of the present invention from different perspectives. FIGS. 10A, 10B, 10C, and 10D show schematic structural diagrams of a rear-end tape end processing unit according to an embodiment of the present invention from different perspectives. In the embodiment of the present invention, the structure of the front-end tape end processing unit and the rear-end tape end processing unit are completely the same, the difference lies only in the symmetrical arrangement. Therefore, the same components will be referred to with the same reference numerals, and the front-end tape end processing unit and the rear-end tape end processing unit will be referred to as tape end processing unit in the following, and referenced by the reference number 110. As shown in FIGS. 9A, 9B, 9C and 9D and FIGS. 10A, 10B, 10C and 10D, the tape end processing unit 110 includes a support frame 190, a drive unit 150, a tape head pressing arm 120, a cutting module 142, a tape clamping arm 141, a clamping support arm 130 and squeezing tape tail pressing arm 143 mounted on the support frame 190. The tape head pressing arm 120, the cutting module 142, the tape clamping arm 141, the clamping support arm 130, and the tape tail pressing arm 143 are arranged on the support frame 190, and are connected to the driving unit 150. The driving unit 150 is constructed to drive the tape head pressing arm 120, the cutting module 142, the tape clamping module and the tape tail pressing arm 143 to operate. The tape end processing unit 110 may further include a controller 100. The controller 100 is electrically connected with the driving unit 150, and the driving unit is controlled to drive the operation arms to move.

Wherein, the tape head pressing arm 120 can be driven by the driving unit 150 to move toward the box 20 to be packed to the packing position, so as to press the head of the tape 320 against the box 20 to ensure that the head of the tape 320 sticks to the box 20. The tape clamping arm 141 and the clamping support arm 130 can be driven by the driving unit 150 to move to the packing position and clamp each side of the tape 320 respectively, thereby fixing the position of the head end of the tape. The cutting module 142 can be moved to the packing position under the driving of the driving unit, so as to cut the tape 320 after the winding operation of the tape 320 is completed. In the length extension direction of the tape 320, the tape head pressing arm 120 and the cutting module 142 are respectively located on each side of the tape clamping module. The tape tail pressing arm 143 is located on one side of the cutting module 142 opposite to the tape head pressing arm 120. For example, in the example shown in the drawings, the tape head pressing arm 120 and the cutting module 142 are located on the upper and lower sides of the tape clamping module, respectively, and the tape tail pressing arm 143 is located on the lower side of the tape cutting module 142. It depends on the winding direction of tape. The tape tail pressing arm 143 can be moved to the packing position under the drive of the driving unit 150 to press the tail of the tape 320 against the box 20 to ensure that the tail of the tape 320 is adhered on the box 20, thereby ensuring that the tape 320 is firmly bound to the box 20 without tail curling.

Figure 9A:
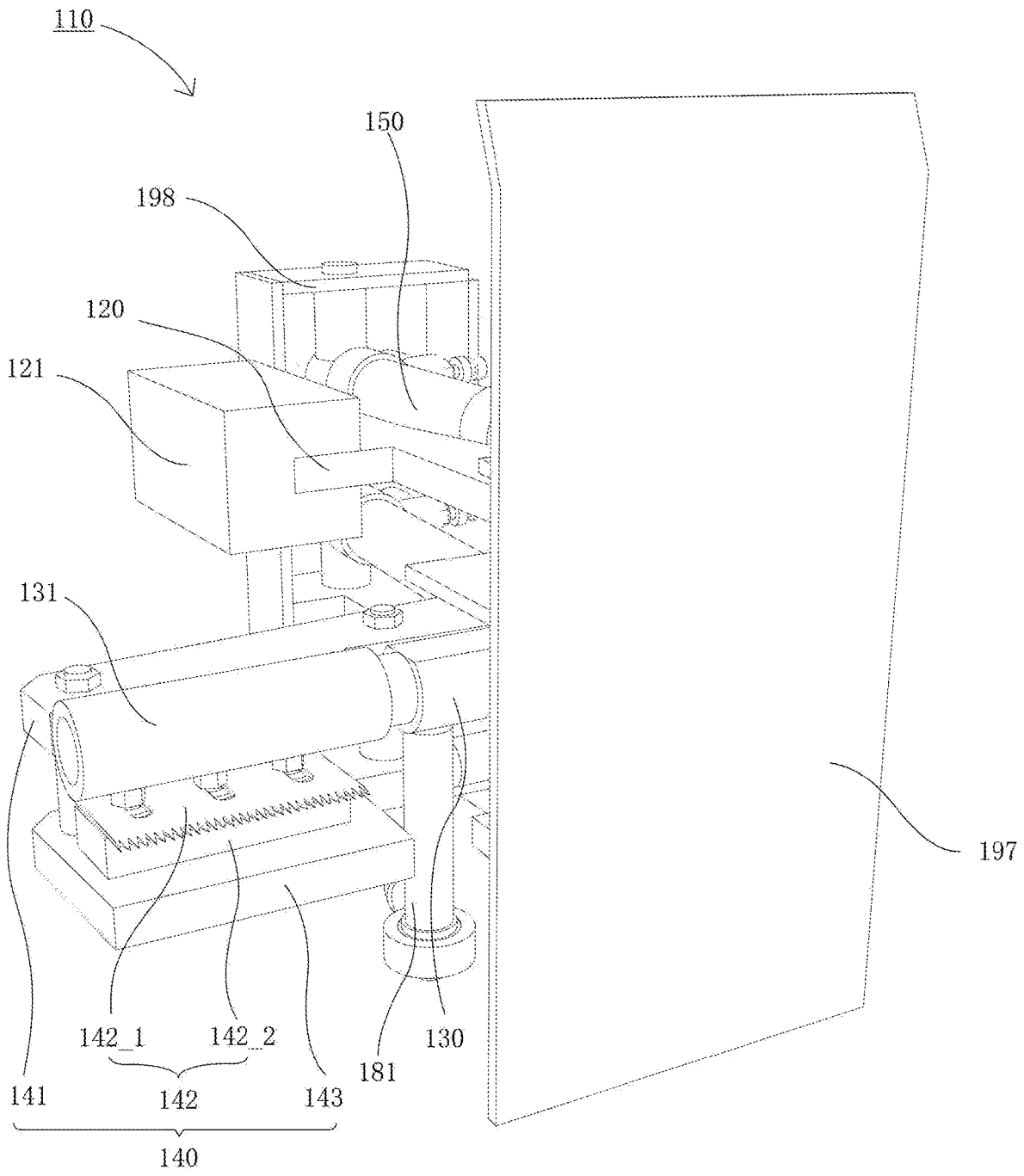
FIGS. 9A to 9D show schematic structural diagrams of a tape end processing unit in different viewing angles according to an embodiment of the present invention.
Figure 9B:
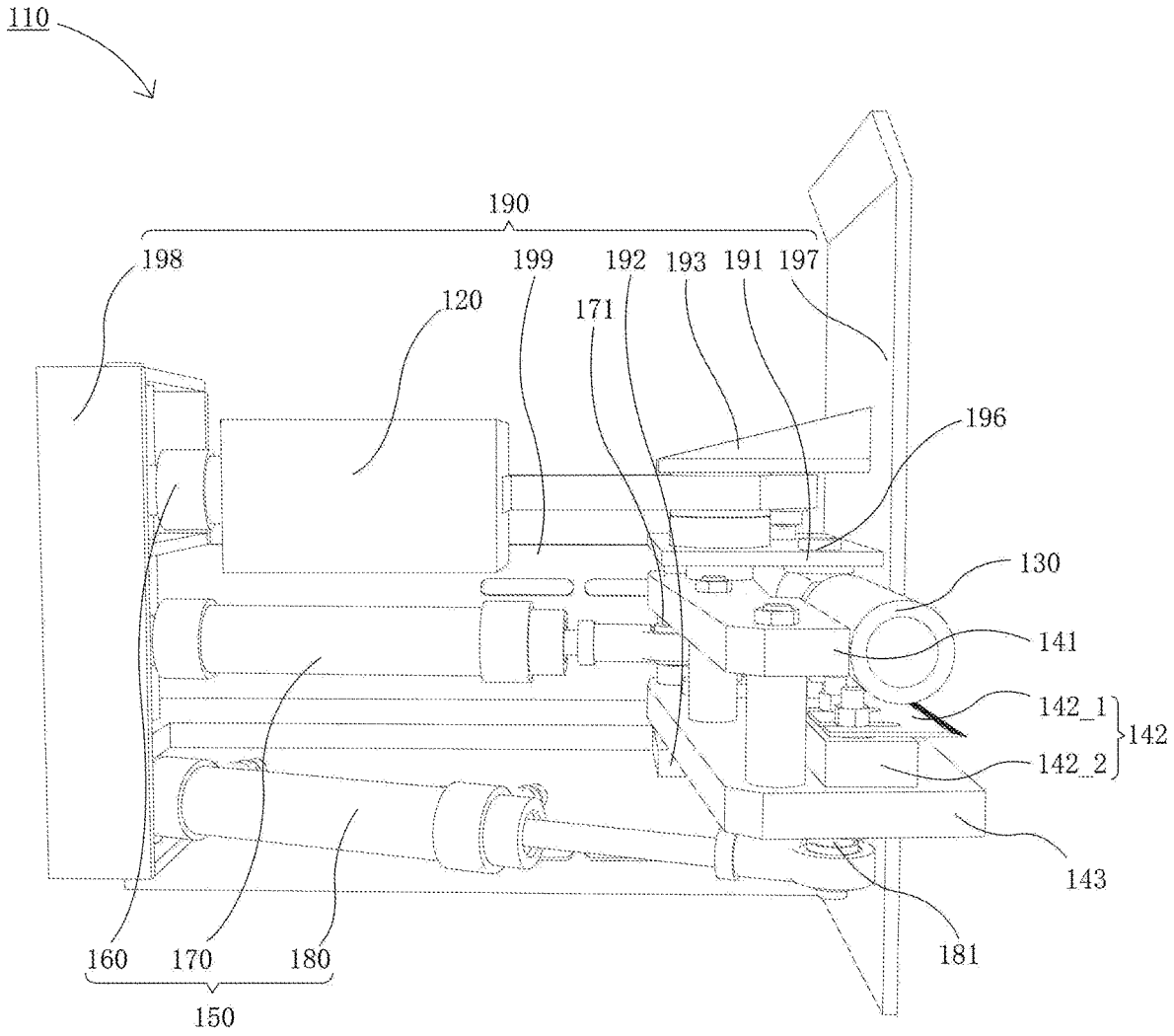
Figure 9C:
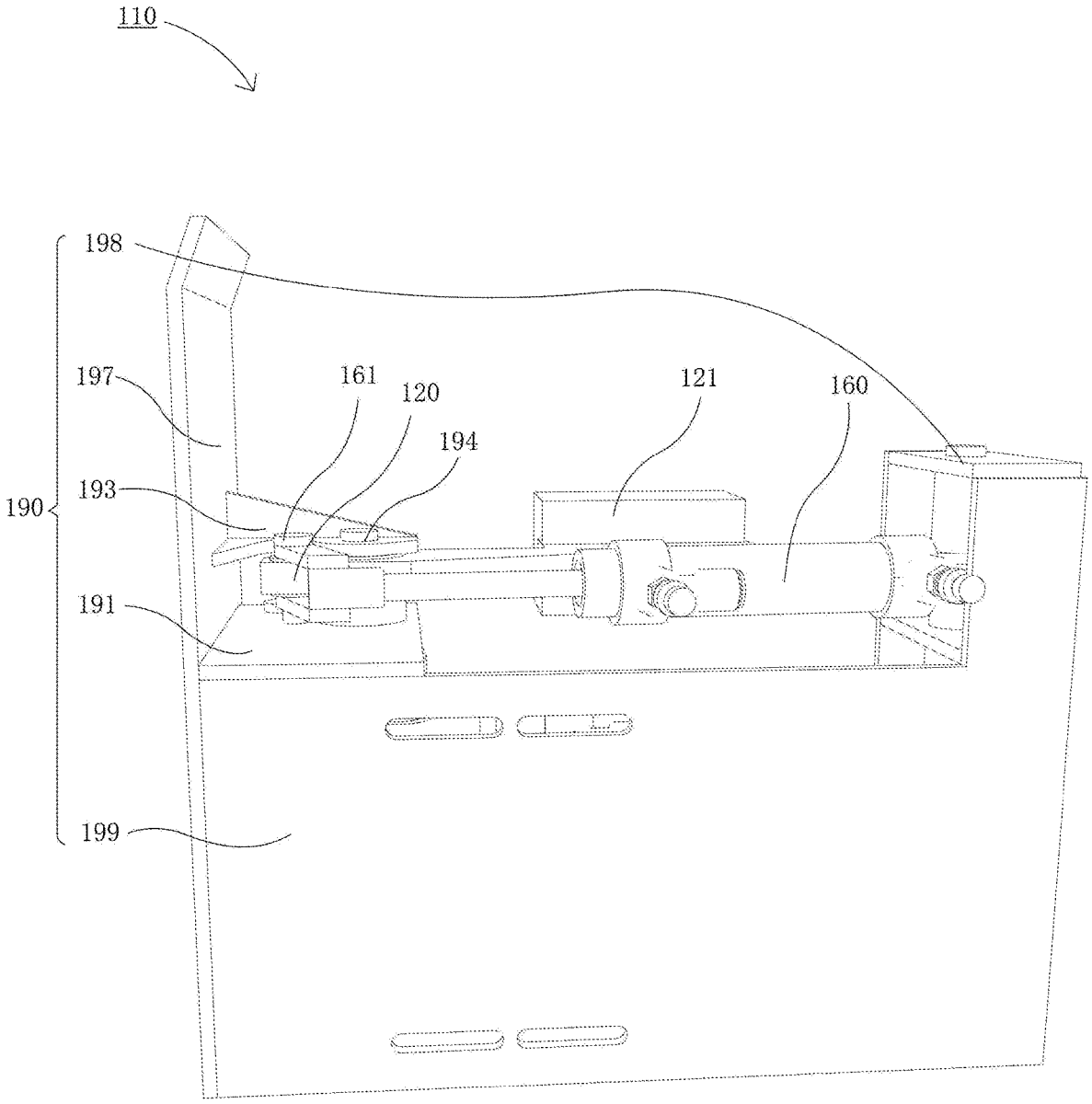
Figure 9D:
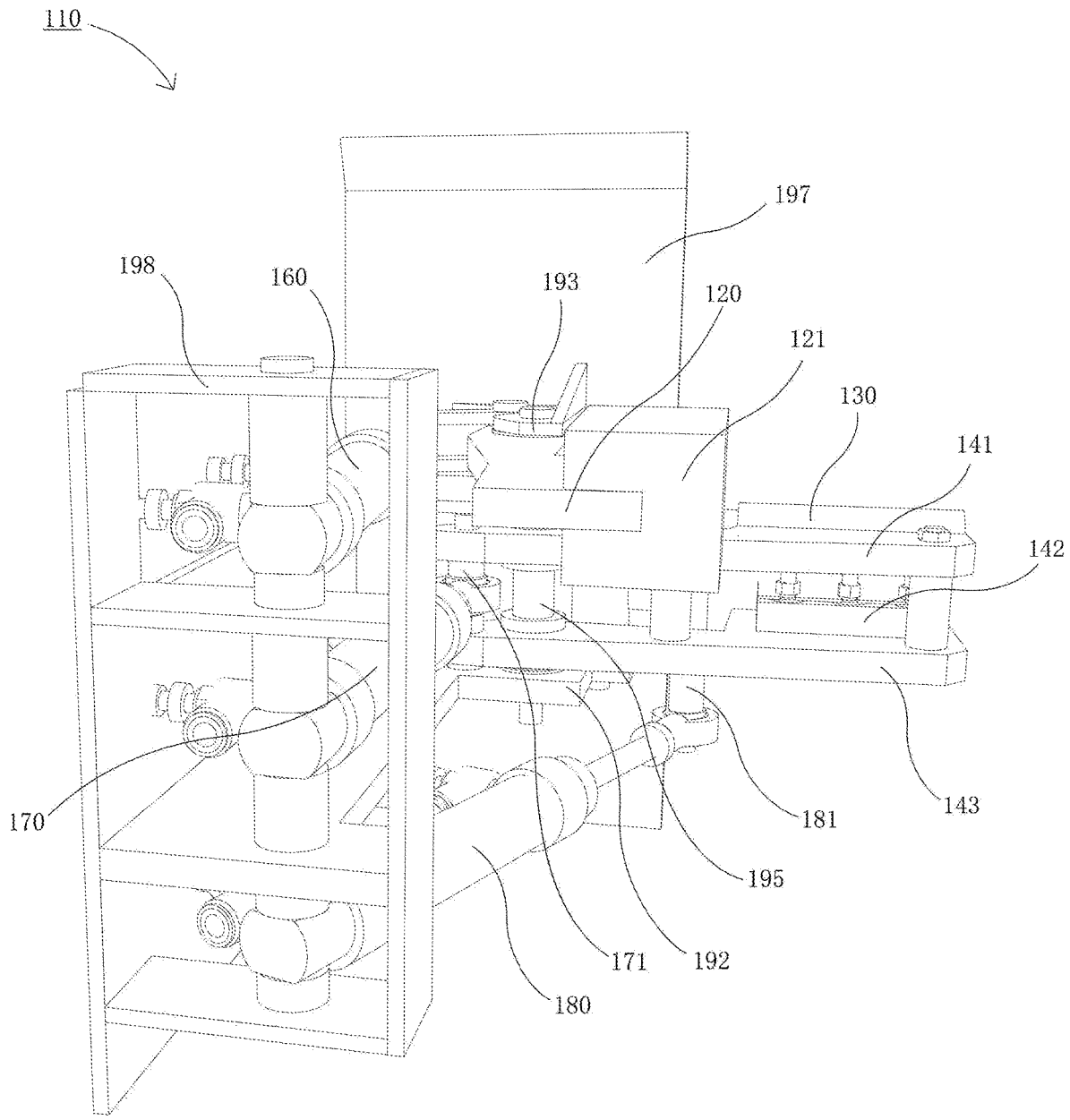
Figure 10A:
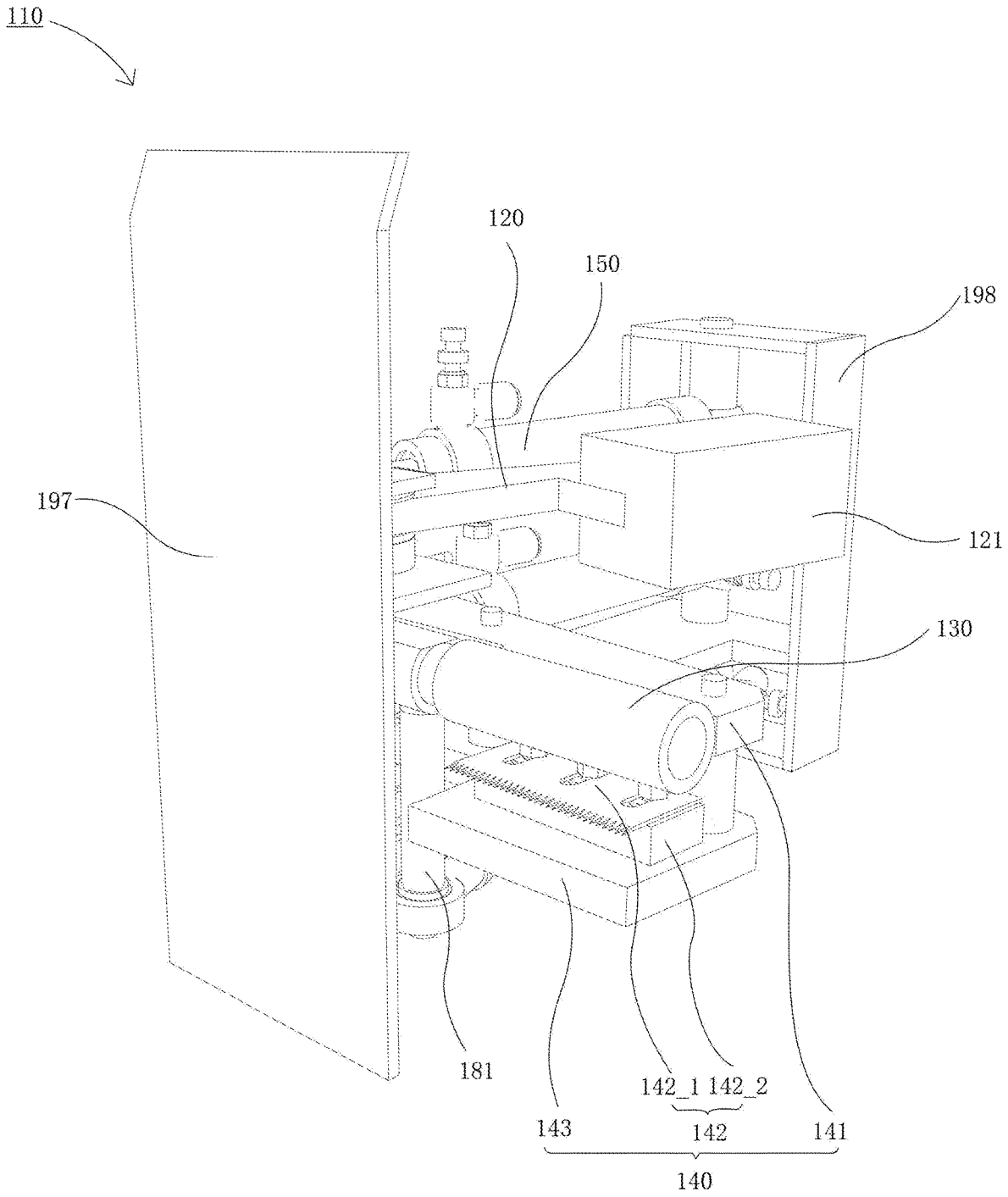
FIGS. 10A to 10D show schematic structural diagrams of another tape end processing unit in different viewing angles according to an embodiment of the present invention.
Figure 10B:
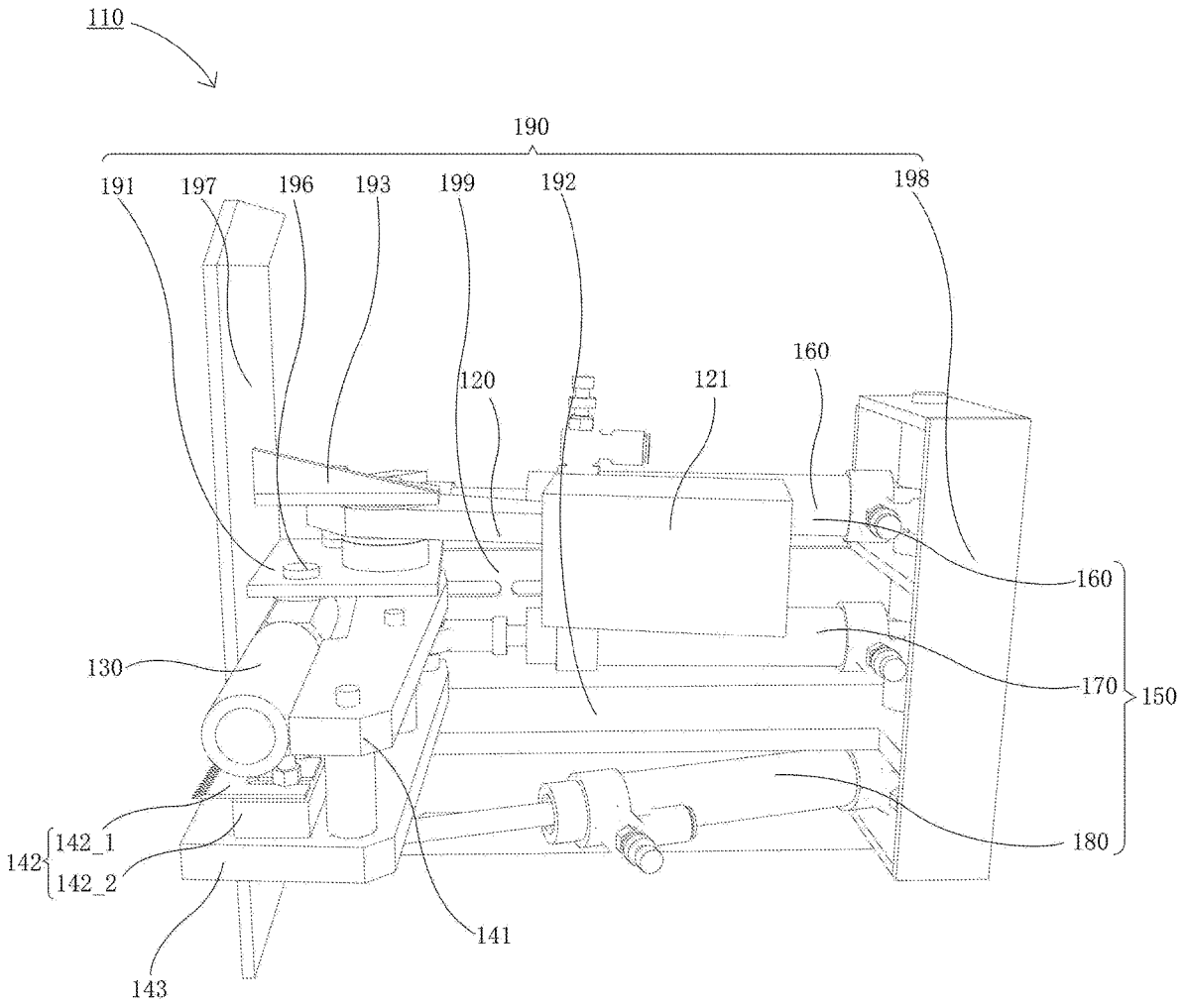
Figure 10C:
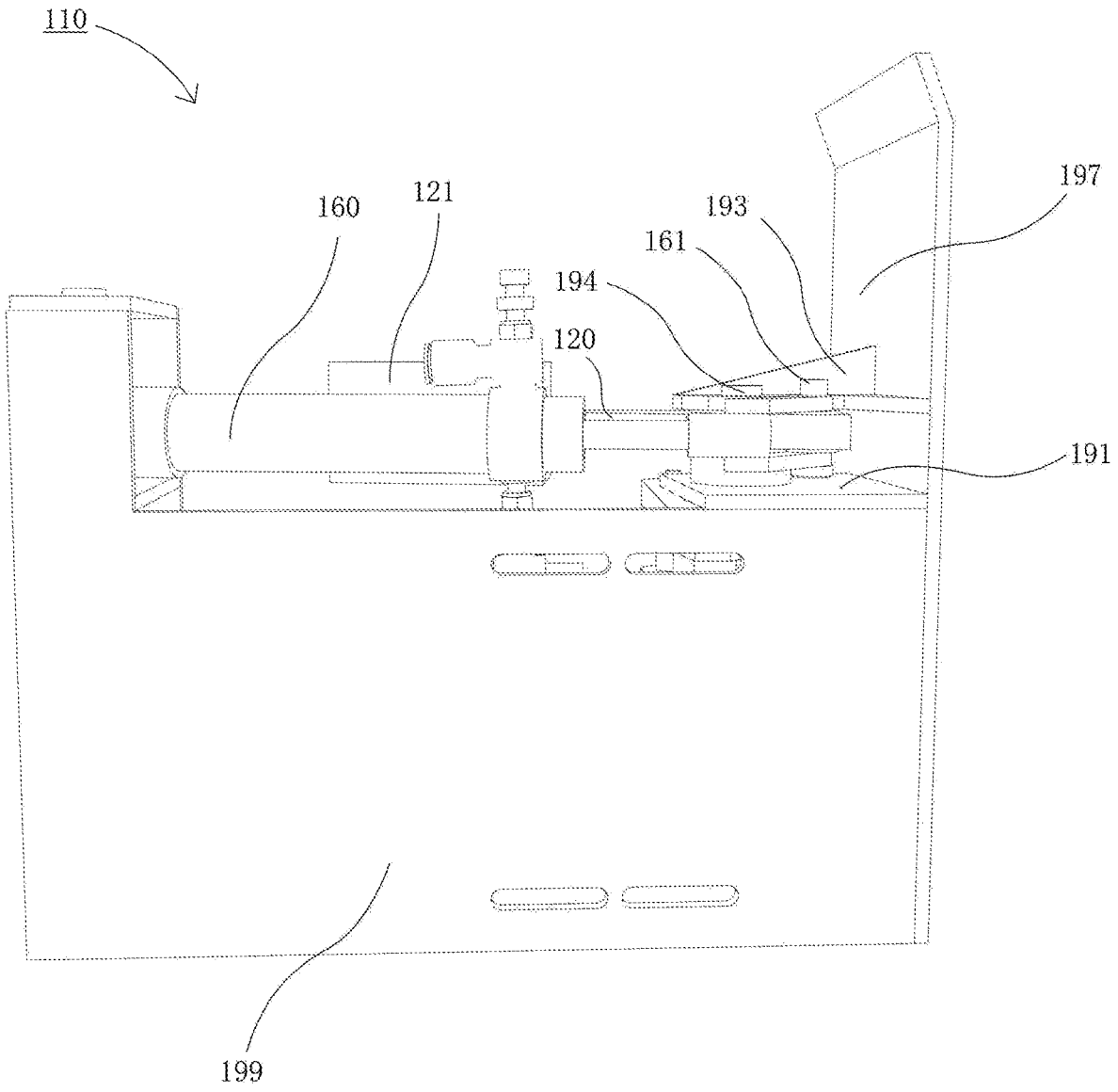
Figure 10D:
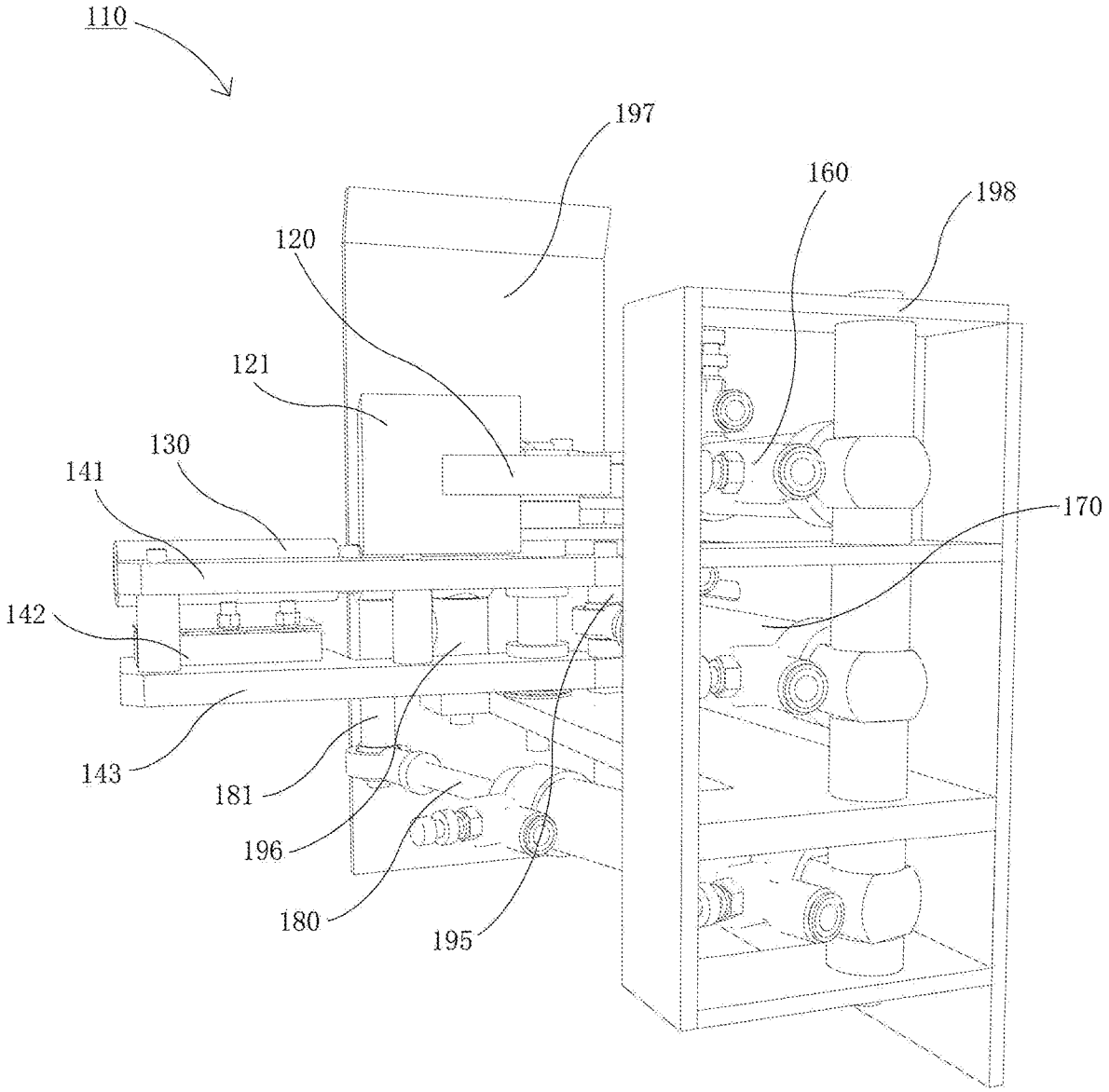

As shown in FIGS. 9A and 10A, the cutting module 142 includes a cutting blade support arm 142_2 and a cutting blade 142_1 provided on the cutting blade support arm 142_2. The tape clamping arm 141, the cutting blade support arm 142_2, and the tape tail pressing arm 143 are fixedly connected together to form a clamping and cutting arm 140. By being fixedly connected to each other, the tape clamping arm 141, the cutting blade support arm 142_2, and the tape tail pressing arm 143 can move synchronously under the driving of the driving unit. The cutting blade support arm 142_2 is provided between the tape clamping arm 141 and the tape tail pressing arm 143. In the example shown in the drawings, the tape clamping arm 141 and the tape tail pressing arm 143 are connected to each other, and the cutting blade support arm 142_2 is fixed on the tape tail pressing arm 143.

As an example, as shown in FIGS. 9A and 10A, the tape head end pressing arm 110 is provided with a pressing plate 121 for pressing the tape 320 with a relative broad area. The head of the tape 320 is pressed by the pressing plate 121, so that the tape 320 can be attached to the box 20 in a larger area, so as to be more firmly attached to the surface of the box 20.

As an example, as shown in FIGS. 9A, 9B, 10A, 10B and 24B, in the direction facing the box 20, the cutting edge portion of the cutting blade 142_1 protrudes relative to the tape clamping arm 141 to ensure that the cutting blade 142_1 can cut the clamped tape 320, thereby after the tape winding operation is completed, the tape 320 can be cut, and the tail end of the tape 320 is close to the side wall of the box 20. In the direction facing the box 20, the tape tail pressing arm 143 is more protruding relative to the edge of the cutting blade 142_1, so that the tape tail pressing arm 143 can press the tail of the tape 320 onto the box 20 while it can ensure a gap between the blade edge of the cutting blade 142_1 and the outer surface of the box 20 without scratching the box 20. As an example, as shown in FIG. 9A, the clamping support arm 130 may include a support roller 131, and the tape 320 is supported by the cylindrical support roller 131 to prevent the clamping support arm 130 from sticking to the tape 320 with a large area, so that the clamping support arm 130 is easier to separate from the tape 320.

The driving unit 150 for driving each operating arm is described in detail below. As shown in FIGS. 9A, 9B, 9C, and 9D, the driving unit 150 may include a first driving unit 160, a second driving unit 170, and a third driving unit 180. The first driving unit 160 is connected to the tape head pressing arm 120 for driving the tape head pressing arm 120 to pivot relative to the support frame 190. The second driving unit 170 is connected to the clamping and cutting arm 140 for driving the clamping and cutting arm 140 to pivot relative to the support frame 190, that is, driving the tape clamping arm 141, the cutting blade support arm 142_2, and the tape tail pressing arm 143 synchronously move, thereby reducing the number of driving units, reducing parts, saving costs, and reducing driving steps, reducing packing time. The third driving unit 180 is connected to the clamping support arm 130 for driving the clamping support arm 130 to pivot relative to the support frame 190.

Although in the example shown in the drawings, the tape clamping arm 141, the cutting blade support arm 142_2, and the tape tail pressing arm 143 are connected together to form an integrated clamping and cutting arm 140 such that the three operating arms are driven to move synchronously by the second driving unit, but the solution of the present invention is not limited to this. The tape clamping arm 141, the cutting blade support arm 142_2, and the tape tail pressing arm 143 may be independently driven. Therefore, when the tape clamping arm 141, the cutting blade support arm 142_2, and the tape tail pressing arm 143 are not fixedly connected together, the drive unit 150 can also drive the tape clamping arm 141, the cutting blade support arm 142_2, and the tape tail end extrusion arm 150 moves independently, and can drive the three operating arms to move synchronously, or drive any two of them to move synchronously.

FIGS. 9A-9D and 10A-10D show the connection structure among the tape head pressing arm 120, the support frame 190 and the drive unit 150. Specifically, the support frame 190 includes a first support plate 191 and a second support plate 192 and a third supporting plate 193 arranged at predetermined intervals. The third supporting plate 193 is arranged on one side of the first supporting plate 191 opposite to the second supporting plate 192. In the example shown in the drawings, the first supporting plate 191 is disposed above the second supporting plate 192, and the third supporting plate 193 is disposed above the first supporting plate 191. The first supporting plate 191 is provided with a first rotating shaft 194. The tape head pressing arm 120 is connected to the first supporting plate 191 through the first rotating shaft 194. The first driving unit 160 is a first telescopic rod, the first end of which is connected to the first end of the tape head pressing arm 120, and the tape head pressing arm 120 is driven to rotate around the first rotating shaft 194.

As an example, the first end of the first driving unit 160 is connected to the first end of the tape head pressing arm 120 through the first transmission shaft 161. The first transmission shaft 161 penetrates the first end of the tape head pressing arm 120, and two connecting arms are used to connect the two ends of the first transmission shaft 161 respectively, and the two connecting arms are connected to the first end of the first driving unit 160. It is convenient for the first driving unit 160 to expand and contract along its own length direction while pulling the tape head pressing arm 120 to rotate around the first rotating shaft 194 through the two connecting arms and the first transmission shaft 161.

As an example, the first driving unit 160 may be a pneumatic rod, a hydraulic rod, or an electric screw rod.

As shown in FIGS. 9A-9D and 10A-10D, the supporting frame 190 may is provided with a second rotating shaft 195, and both ends of the second rotating shaft 195 are connected to the first supporting plate 191 and the second supporting plate 192, respectively. The clamping and cutting arm 140 is connected to the supporting frame 190 through the second rotating shaft 195. The second driving unit 170 is a second telescopic rod, the first end of the second driving unit 170 is connected with the first end of the clamping and cutting arm 140, and the second end of the clamping and cutting arm 140 is driven to rotate around the second rotating shaft 195.

As an example, as shown in FIGS. 9B, 9D, 10B, and 10D, the first end of the second driving unit 170 is connected to the first end of the clamping and cutting arm 140 through the second transmission shaft 171. The first end of the second driving unit 170 extends between the tape clamping arm 141 and the tape tail pressing arm 143, and the second transmission shaft 171 penetrates the tape clamping arm 141, the first end of the second driving unit 170 and the tape tail pressing arm 143, and the upper and lower sides of the second driving unit 170 have gaps between the first support plate 191 and the second support plate 192, respectively, to prevent the second driving unit 170 from interfering with the first support plate 191 and the second support plate 192.

As an example, the second driving unit 170 may be a pneumatic rod, a hydraulic rod, or an electric screw rod.

A connecting structure of the clamping support arm 130, the support frame 190, and the third drive unit 180 will be described in detail below. Specifically, as shown in FIGS. 9A, 9B, 9C, and 9D, the support frame 190 may is provided with a third rotating shaft 196, each end of the third rotating shaft 196 is respectively connected to the first support plate 191 and the second support plate 192. The clamping support arm 130 is connected to the support frame 190 through the third rotating shaft 196. The third driving unit 180 is a third telescopic rod. The first end of the third drive unit 180 is connected with the clamping support arm 130 to drive the clamping support arm 130 to rotate around the third rotating shaft 196.

As an example, the first end of the third drive unit 180 is connected to the clamping support arm 130 through the third transmission shaft 181. For example, one end of the third transmission shaft 181 is inserted into the shaft hole at the first end of the third drive unit 180, the second end of the third transmission shaft 181 is inserted into the shaft hole in the middle of the clamping support arm 130, and the third transmission shaft 181 is spaced a predetermined distance from the third rotating shaft 196, and the first end of the clamping support arm 130 is driven by the third transmission shaft 181 during the expansion and contraction of the third drive unit 180, so that the second end of the clamping support arm 130 rotates around the third rotating shaft 196 to move to the packing position or retract.

As an example, the third drive unit 180 may be a pneumatic rod, a hydraulic rod, or an electric screw rod.

As shown in FIGS. 9A, 9B, 10A and 10B, the support frame 190 also may include a drive unit support frame 198. The second end of the first drive unit 160, the second end of the second drive unit 170, and the second end of the third drive unit 180 are all connected to the drive unit support frame 198.

As shown in FIGS. 9A, 9B, 9C, 10A, 10B, and 10C, the support frame 190 further includes a first baffle 197 and a second baffle 199. The first baffle 197 is disposed on one side of the tape head pressing arm 120 and the cutting module 142, facing to the box 20 and used to abut against the side wall of the box 20. For example, the horizontal press 400 pushes the box 20 to abut the first baffle 197 to position the box 20 at the packing position and prevent the box 20 from moving laterally during the packing operation. The second baffle 199 is connected to the first baffle 197, and is used to shield the tape head pressing arm 120, the cutting module 142, the tape clamping arm 141, the clamping support arm 130 and the tape tail pressing arm 143. It can protect the above-mentioned components, and on the other hand, it also prevents the user's hand from being injured by touching the above-mentioned components.

As an example, each of the first support plate 191, the second support plate 192 and the third support plate 193 are connected to at least one of the first baffle 197, and the second baffle 199 to be supported. The driving unit support frame 198 is connected to the second baffle 199 to be supported.

As shown in FIGS. 1-4, the tape dispenser 300 may include a tape mounting seat 310 capable of rotating around the box 20, and the tape mounting seat 310 is used for mounting a tape roller. The tape dispenser 300 may further include a first transmission wheel 330, a first transmission wheel driver 340, a second transmission wheel 350, and a transmission belt 360. The tape mounting seat 310 is provided on the first transmission wheel 330 and can rotate around the packing position when the first transmission wheel 330 rotates. The transmission belt 360 is sleeved on the first transmission wheel 330 and the second transmission wheel 350, and the first transmission wheel driver 340 is connected with the second transmission wheel 350 to drive the second transmission wheel 350 to rotate, and then the first transmission wheel 330 is driven to rotate by the transmission belt 360. As a result, the adhesive tape mounting seat 310 on the first transmission wheel 330 rotates around the box 20 so that the adhesive tape 320 binds the box 20.

Of course, the first transmission wheel 330 may not be driven to rotate in a belt transmission manner, but the first transmission wheel 330 may be directly driven to rotate through the first transmission wheel driver 340. For example, in the case where only one tape end processing unit 110 is provided, the first transmission wheel 330 can be directly driven to rotate through the first transmission wheel driver 340. As an example, the first transmission wheel driver 340 is a driving motor.

In the example shown in the drawings, the box 20 can put inside of the first transmission wheel 330 so that the first transmission wheel 330 rotates and the adhesive tape 320 binds the box 20 in the circumferential direction.

As an example, as shown in FIGS. 1-6, the tape packing device according to the embodiment of the present invention further includes a packing platform 200, and the packing platform 200 may include a first conveying part 230 and a supporting platform 210 provided at one end of the first conveying part 230 for supporting the box 20. In the case where the box 20 is placed on the first conveying part 230, the first conveying part 230 can convey the box 20 to the supporting platform 210. The packing platform 200 may further include a second conveying part 240, which is arranged on the side of the supporting platform 210 opposite to the first conveying part 230, and is used for conveying the boxes 20 away from the tape packing device 10 after the packing is completed. The supporting platform 210 is arranged between the first conveying part 230 and the second conveying part 240 with a packing gap between supporting platform 210 and the first conveying part 230 and between supporting platform 210 and the second conveying part 240. The tape mounting seat 310 can rotate through the packing gap such that the tape adhered to the object to be packed by passing through the packing gap. As an example, the supporting platform 210 is arranged inside the first transmission wheel 330 to ensure the rotation of the first transmission wheel 330 without interference with the supporting platform 210 and drive the tape mounting seat 310 to rotate around the box 20.

As an example, two tape mounting seats 310 may be provided, which are symmetrically distributed on both sides of the first transmission wheel 330, so that two rolls of tapes 320 can be set at the same time, and the two positions of the box 20 can be bundled at the same time to improve the packing effect. At this time, two tape end processing units 110 are also provided, which are respectively arranged on each side of the first transmission wheel 330 to process two rolls of tapes 320 at the same time.

As shown in FIG. 3, the horizontal press 400 and the tape end processing unit 110 are distributed on opposite sides of the packing platform 200 and are used to push the articles to be packed to the packing position horizontally.

Figure 11A:
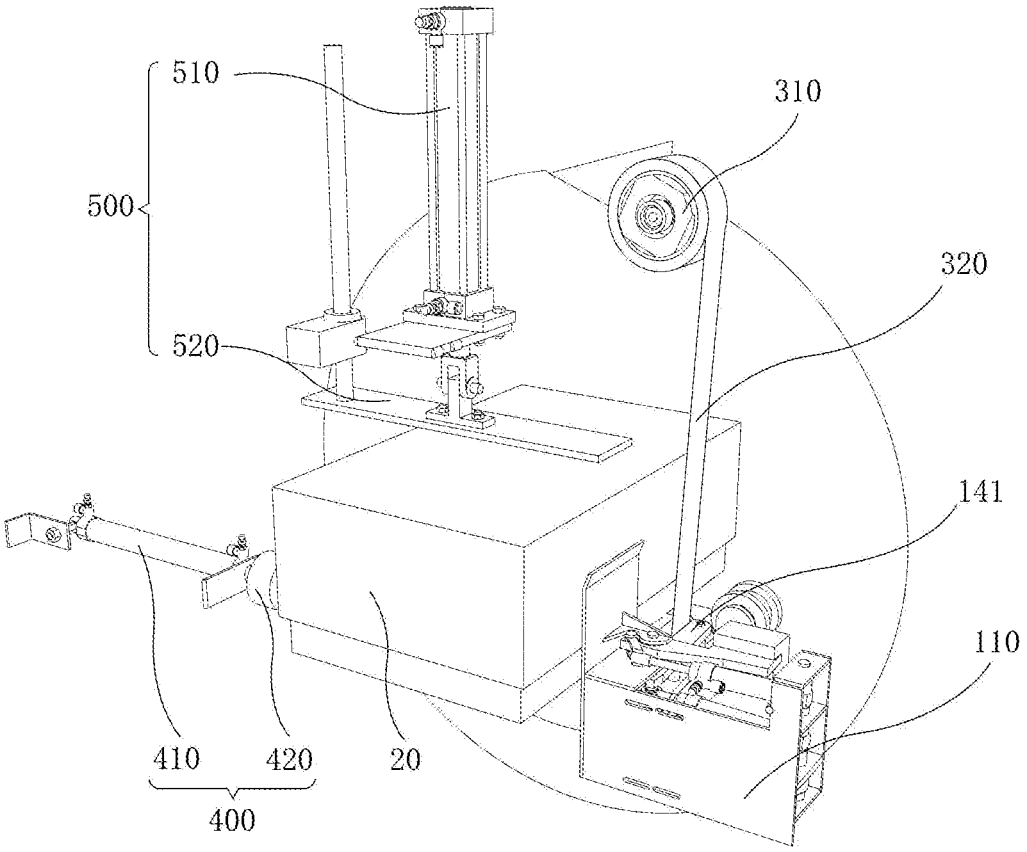
FIGS. 11A and 11B respectively show a perspective view and a front view of the tape packing device in the home position according to an embodiment of the present invention (home position, 0.00 seconds)

As an example, as shown in FIGS. 6 and 11A, the horizontal press 400 may include a fourth telescopic rod 410 and a horizontal pressure plate 420 connected to one end of the fourth telescopic rod 410. The fourth telescopic rod 410 is used to drive the horizontal pressure plate 420 toward the box 20 to move laterally, thereby pressing the box 20 toward the tape end processing unit 110.

As shown in FIGS. 3 and 11A, the vertical press 500 is arranged above the packing platform 200, and is used to press the object to be packed downwards, thereby compressing the box 20 tightly.

As an example, as shown in FIG. 11A, the vertical press 500 may include a fifth telescopic rod 510 and a vertical pressure plate 520 connected to one end of the fifth telescopic rod 510, and the fifth telescopic rod 510 is used to drive the vertical pressure plate 520 to move up and down.

As shown in FIGS. 1, 2, and 5, the first conveying part 230 extends from the front side into the main frame 6 for transporting the box 20 to the support platform 210. In the case where the box 20 is located on the support platform 210, the two ends of the box 20 are suspended in the air so that the tape is wound around the two ends of the box 20. The second conveying part 240 is located on the other side of the supporting platform 210 and is used to convey the box 20 to the outside of the main frame 600 after the packing operation is completed. Further, as shown in FIG. 4, the bottoms of the first conveying part 230 and the second conveying part 240 have support legs, and the bottoms of the support legs are provided with a roller 220 to facilitate the movement of the tape packing device.

Further, the support platform 210, the first conveying part 230 and the second conveying part 240 may include a plurality of rollers (not shown in the figure) distributed at predetermined intervals. During the process of transporting the box 20, the box 20 supported by the rollers to reduce the friction force between packing platform 200 and the box 20 during the movement.

The control method of the tape packing device 10 according to an embodiment will be described in detail below.

In the following description of the packing operation method, the entire packing operation process is divided into fifteenth sub-operations in chronological order. This is only for the convenience of description, and the packing operation process according to the embodiment of the present invention is not limited thereto. The packing operation process can be divided into more or fewer sub-operations. The time points corresponding to each sub-operation process mentioned in the following description are also exemplary, which are only for the convenience of describing the operation process of the tape packing device, and should not cause any limitation to the solution of the present invention.

Figure 11B:
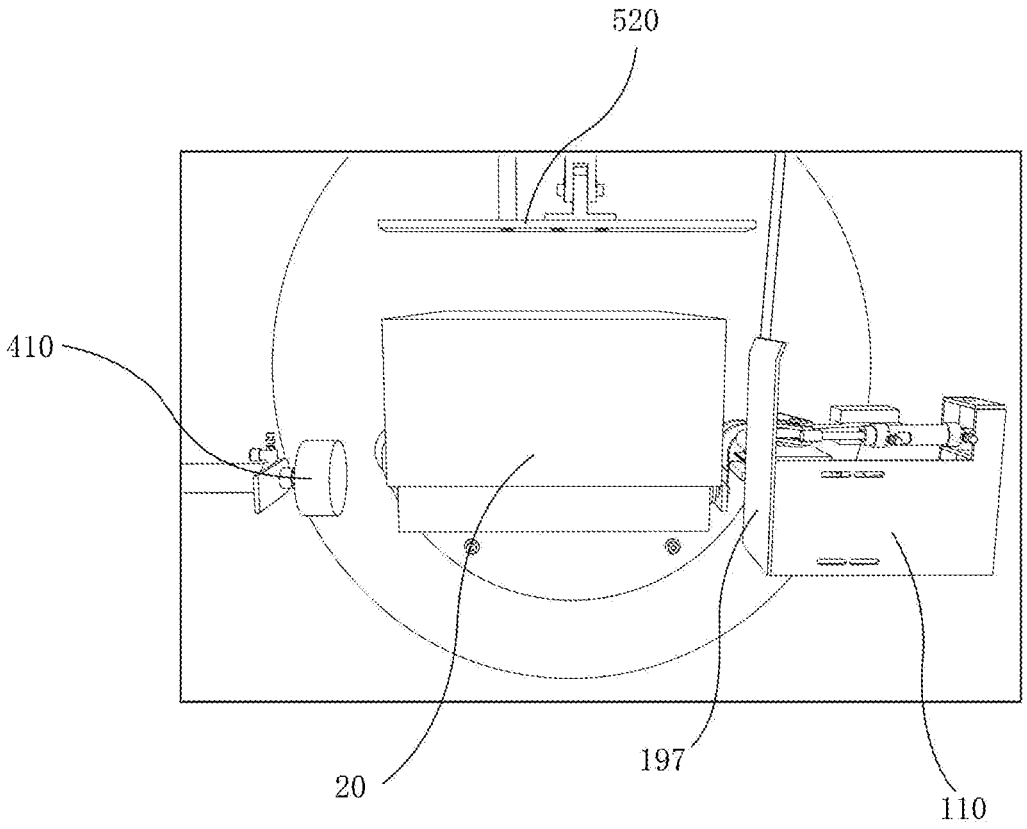
Figure 13A:
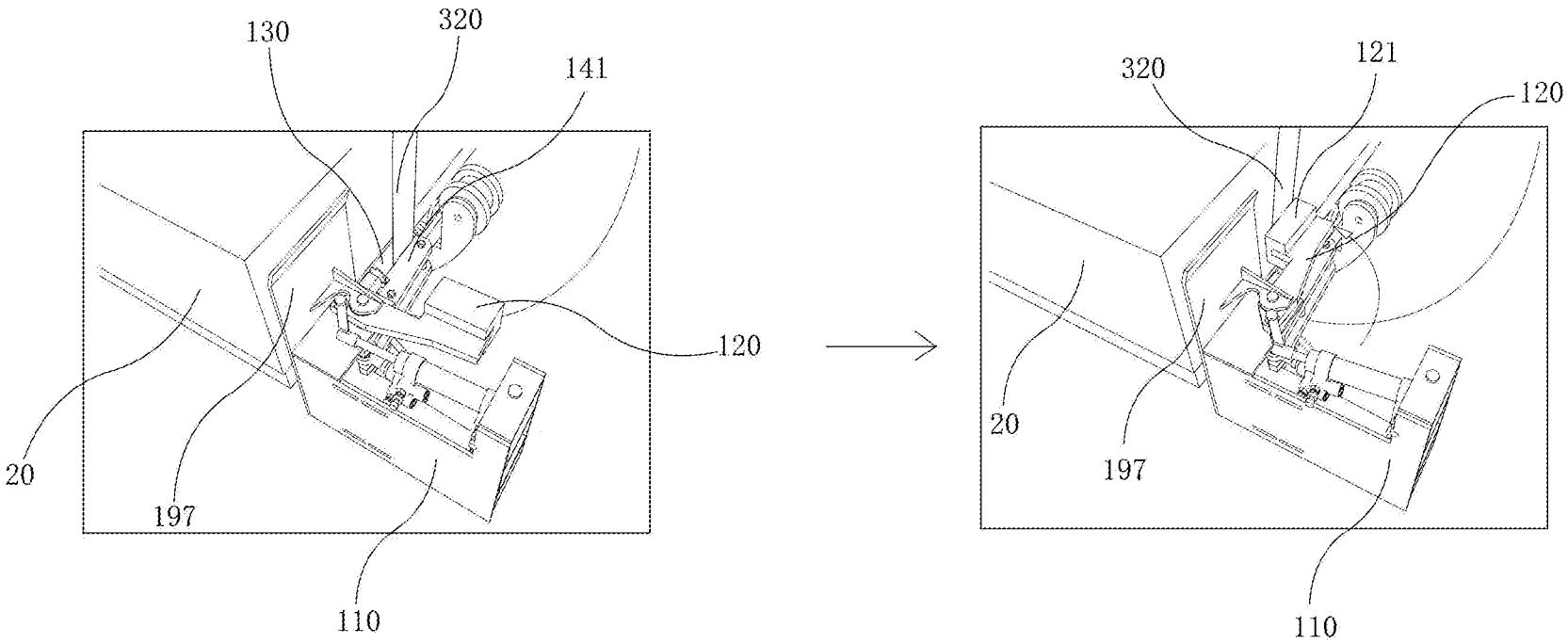

FIG. 11A shows a partial perspective view of the tape packing device 10 in an initial position according to an embodiment of the present invention. FIG. 11B shows a partial front view of the tape packing device 10 in an initial position according to an embodiment of the present invention. As shown in FIGS. 5, 11A, and 11B, when the tape packing device 10 is at home position, the box 20 is placed on the support platform 210, and there are gaps between the box 20 and the horizontal press 400, the vertical press 500 and the tape end processing unit 110. At this time, as shown in FIG. 13A, the tape clamping arm 141 and the clamping support arm 130 respectively press the each side of the tape 320 to fix the head of the tape 320. At this time, the tape head pressing arm 120 is separated, i.e., moves away, from the tape 320, and the tape 320 may be separated from the box 20 by at least the width of the clamping support arm 130.

Figure 12:
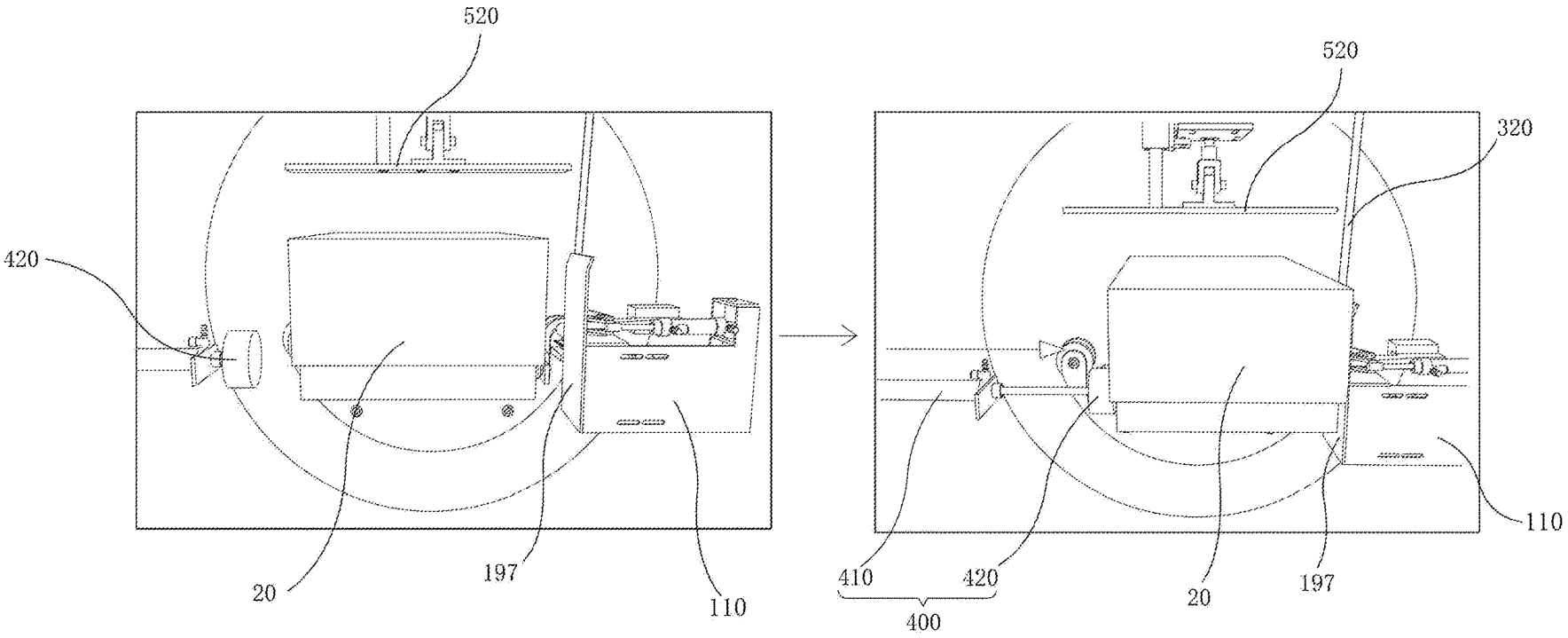
FIG. 12 shows a schematic diagram of the first sub-operation process of the tape packing device according to an embodiment of the present invention, showing a state in which the horizontal press extends for the first time to press the box (the first sub-operation process, 0.01 seconds)

FIG. 12 shows the first sub-operation process of the tape packing device 10, showing the state of the tape packing device 10 according to an embodiment of the present invention operates from the initial position of FIGS. 11A and 11B to 0.01 seconds. In this process, the controller 100 (as shown in FIG. 1) controls the horizontal press 400 to extend the fourth telescopic rod 410, push the box 20 toward the tape end processing unit 110, abut the side of the box 20 with the first baffle 197, and position the box 20 in the packing position, the box 20 is prevented from moving during the tape sticking process. As an example, this process can be operated from 0.00 seconds in the initial state to 0.01 seconds.

Figure 13B:
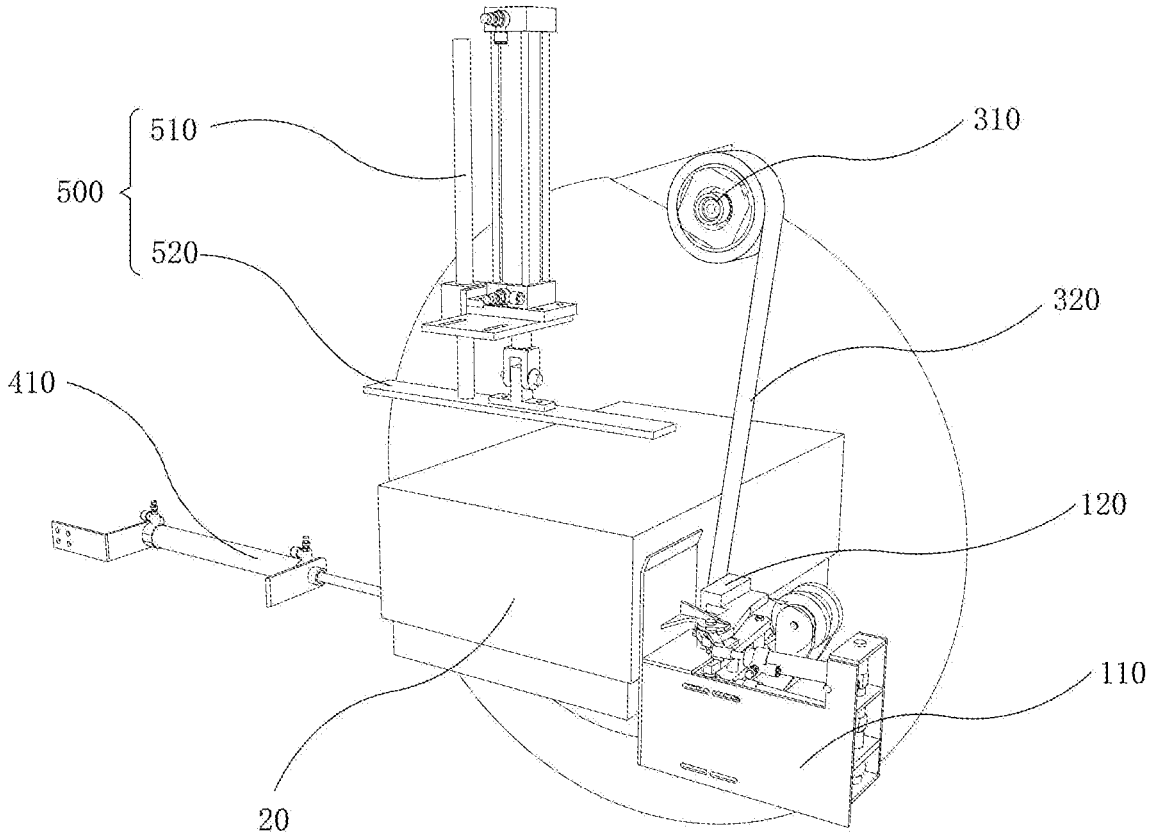

FIGS. 13A and 13B show the second sub-operation process of the tape packing device 10. In the second sub-operation process, the controller 100 (as shown in FIG. 1) controls the tape head pressing arm 120 to move to the packing position, so that the tape head pressing arm 120 presses the head of the tape 320 against the box 20. At this time, the tape packing device 10 operates for 0.02 seconds, and the pressing plate 121 of the tape head pressing arm 120 presses the head end of the tape 320 onto the box 20, so that the head end of the tape 320 is bonded to the side wall of the box 20. In comparison with the tape head sticking operation, the manual operation is avoided and the efficiency is improved. Moreover, the tape head pressing arm 120 and the horizontal press 400 can extrude the box 20 from opposite sides. It ensures that the head end of the tape 320 is firmly attached to the box 20 and it is conducive to the quick start of the tape dispenser 300 without tearing the tape head off from the box 20.

Figure 14A:
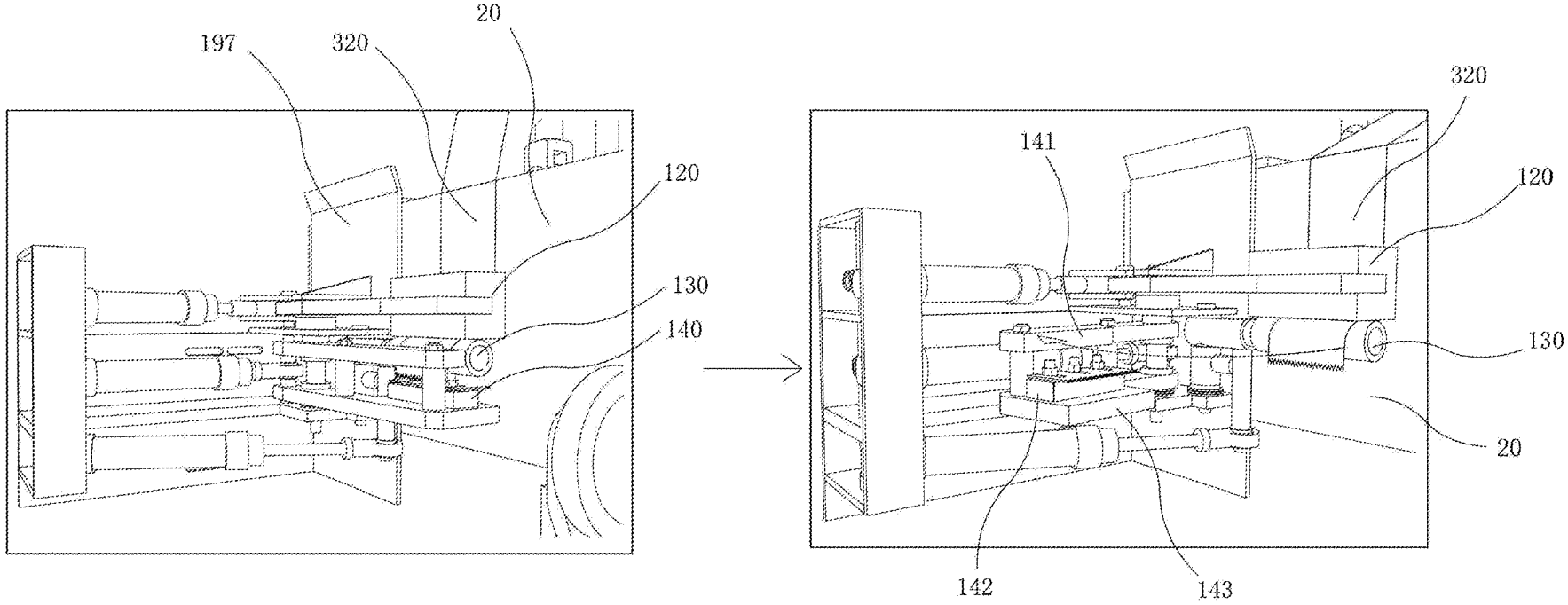
Figure 14B:
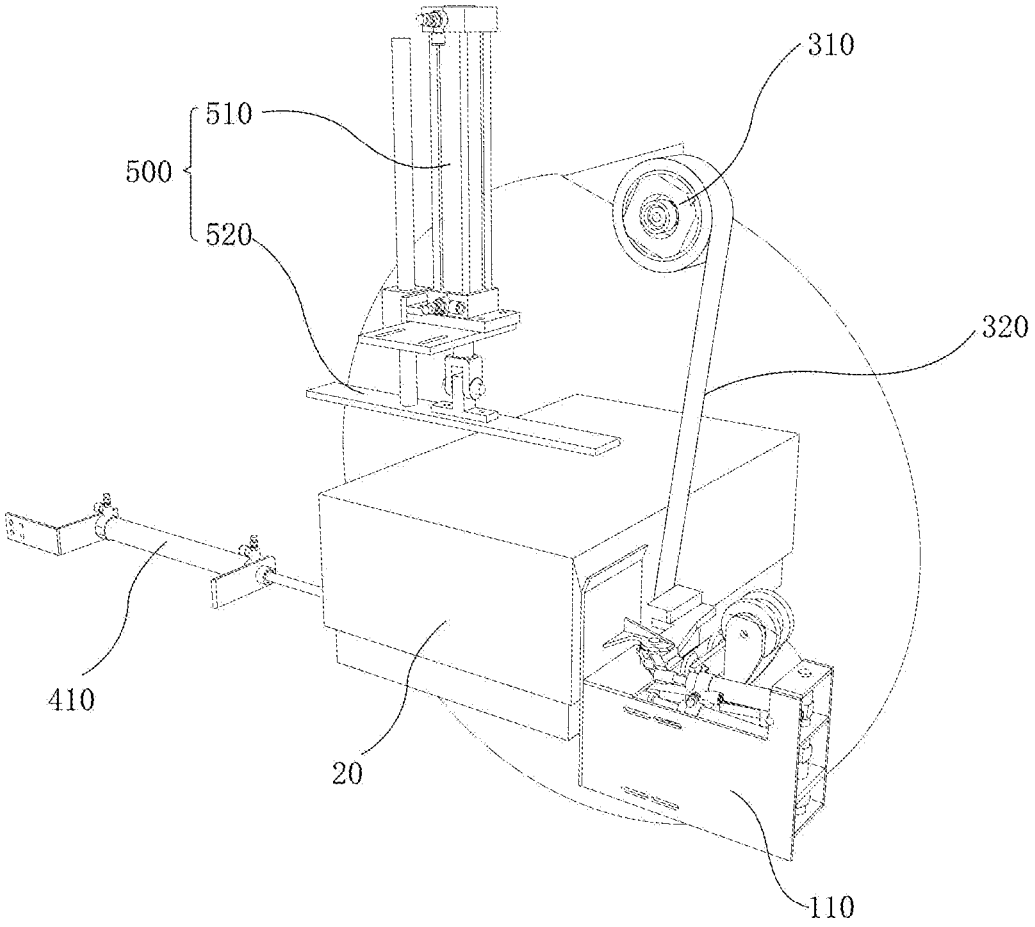

FIGS. 14A and 14B show the third sub-operation process of the tape packing device 10 according to an embodiment of the present invention, wherein FIG. 14A shows the process of clamping and cutting arm 140 retracting, FIG. 14B shows the state after the clamping and cutting arm 140 is retracted. In the process, the controller 100 (as shown in FIG. 1) controls the clamping and cutting arm 140 retracts back, the tape clamping arm 141 and the clamping support arm 130 are separated to provide convenience for the subsequent clamping support arm 130 to move away from the box. At this time, the tape packing device 10 operates for 0.32 seconds.

Figure 15A:
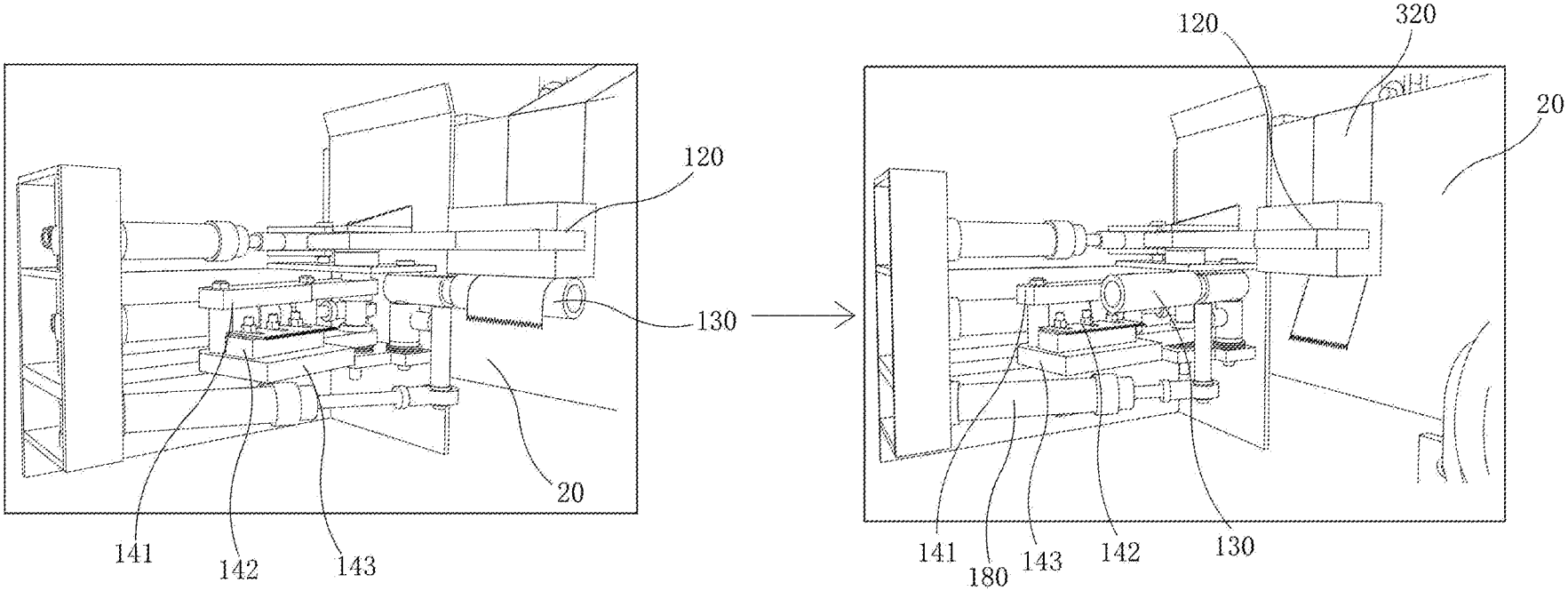
Figure 15B:
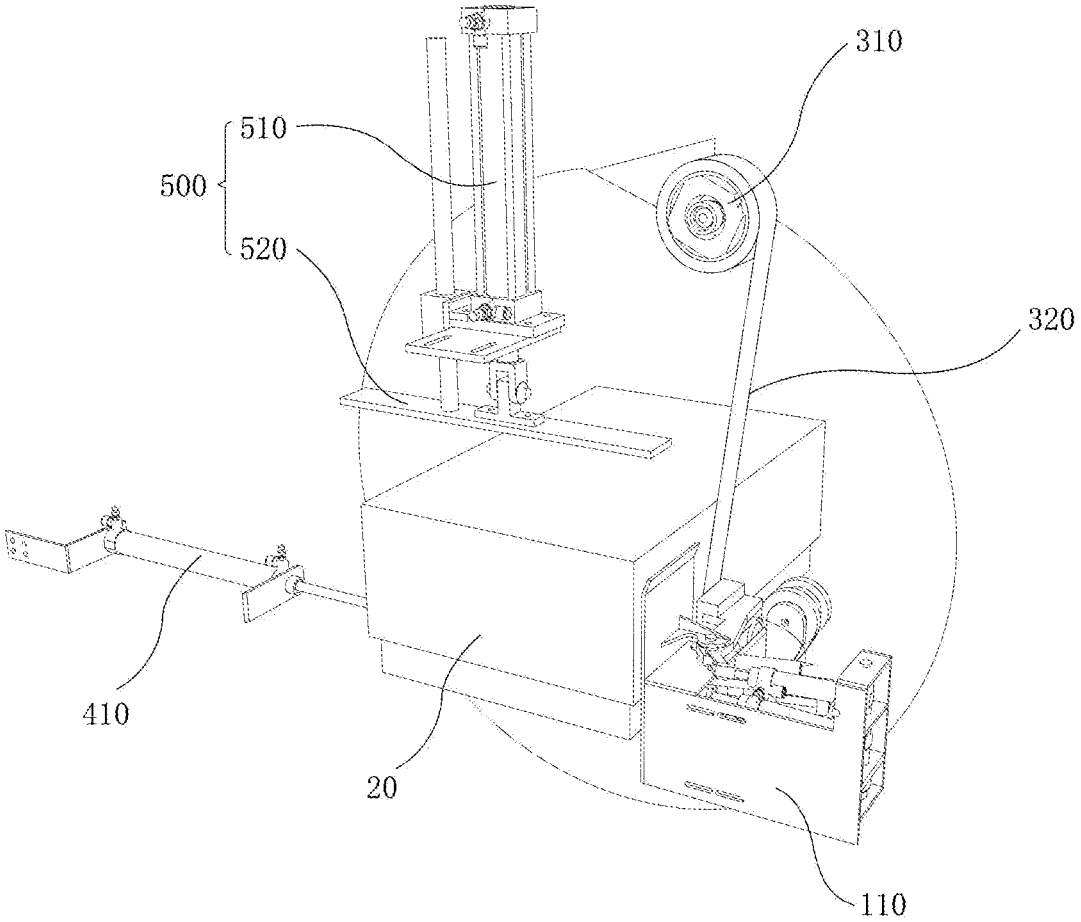

FIGS. 15A and 15B show the fourth sub-operation process of the tape packing device 10 according to an embodiment of the present invention, in which, FIG. 15A shows the action process of the clamping support arm 130 moving away from the box 20, FIG. 15B shows the state after the clamping support arm 130 is far away from the box 20. In this process, the controller 100 (as shown in FIG. 1) controls the clamping support arm 130 move away from the box 20. At this time, the tape packing device 10 operates for 0.52 seconds. Because the tape head pressing arm 120 still extrudes the tape 320, even if the tape 320 is sticky, it can still ensure that the clamping support arm 130 separates from the tape 320 without tearing the tape 320 off from the box 20. Especially in the case of cooperating with the horizontal press 400, the horizontal press 400 and tape head pressing arm 120 extrude the box 20 face to face, and the head end of the tape 320 can be firmly pasted on the box 20, so that the clamping support arm 130 can slide out smoothly and separate from the tape 320, and the head end of the tape 320 can be released. Moreover, the clamping support arm 130 is kept away from the box 20 before starting the vertical press 500, during the pressing process of the vertical press 500, the tape head pressing arm 120 will press more adhesive tape 320 to stick to the box 20, compared with the way of keeping the clamping support arm 130 supporting the inner side of the tape headwhile starting the vertical press 500, it can prevent the clamping support arm 130 from tearing the tape 320 below the tape head pressing arm 120 off from the box 20, it ensures that the tape 320 sticks to the box 20 in a more large area.

Figure 16A:
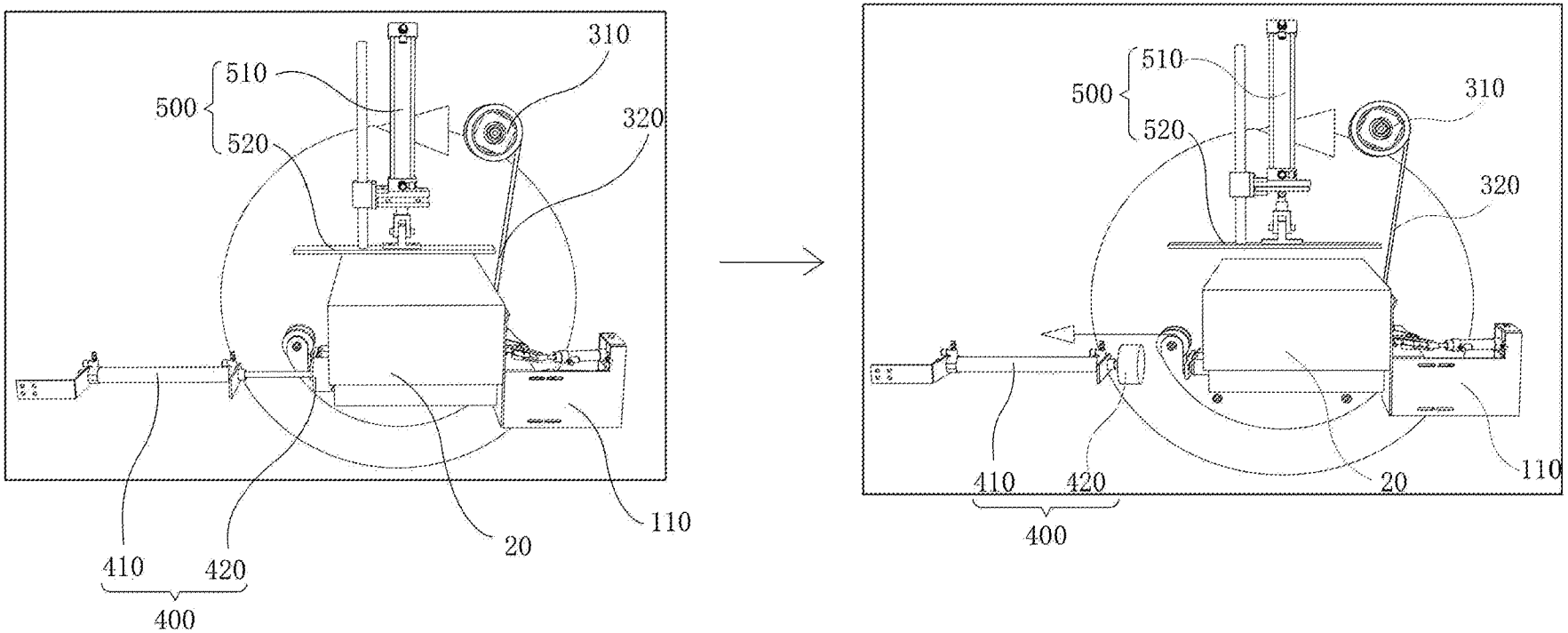
Figure 16B:
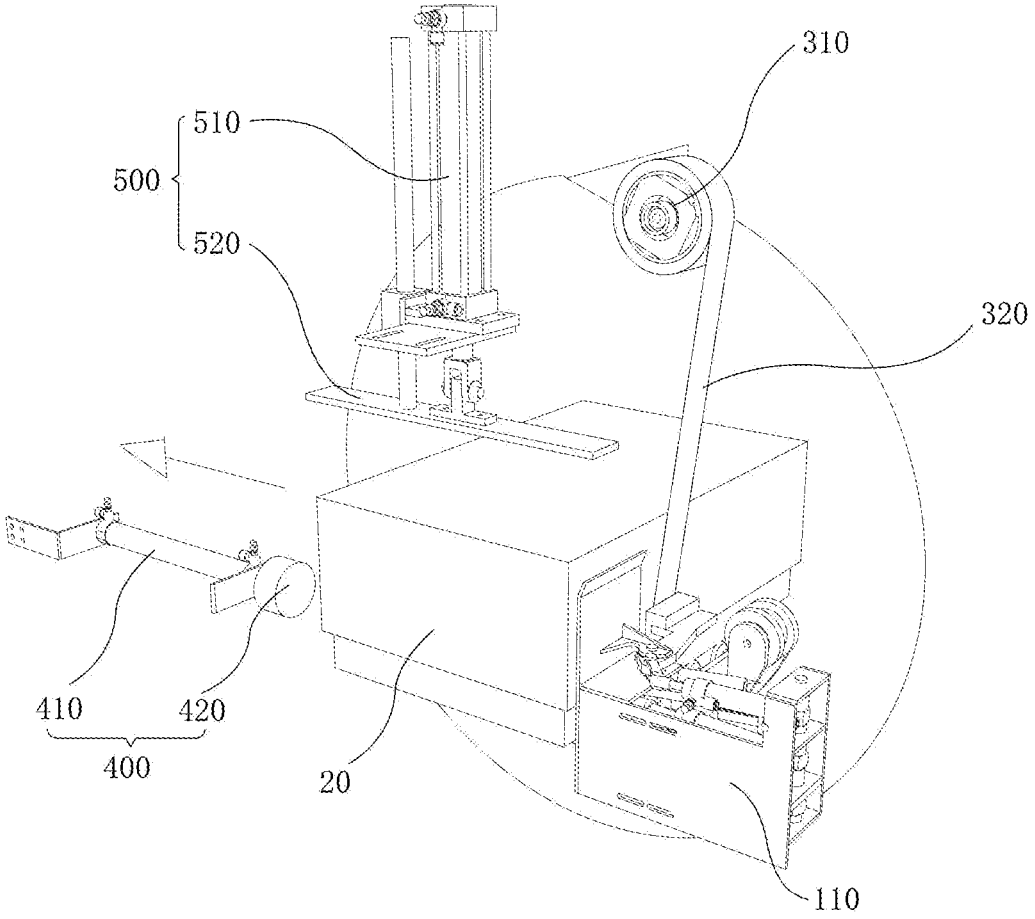

FIGS. 16A and 16B show the fifth sub-operation process of the tape packing device 10 according to an embodiment of the present invention, in which FIG. 16A shows a process of the retracting action of the horizontal press 400; FIG. 16B shows the state after the horizontal press 400 is retracted. In this process, the controller 100 (as shown in FIG. 1) controls the return of the horizontal press 400, it provides space for the subsequent deforming of the box 20 while being pressed down by the vertical press 500. At this time, the tape packing device 10 operates for 0.62 seconds.

Figure 17A:
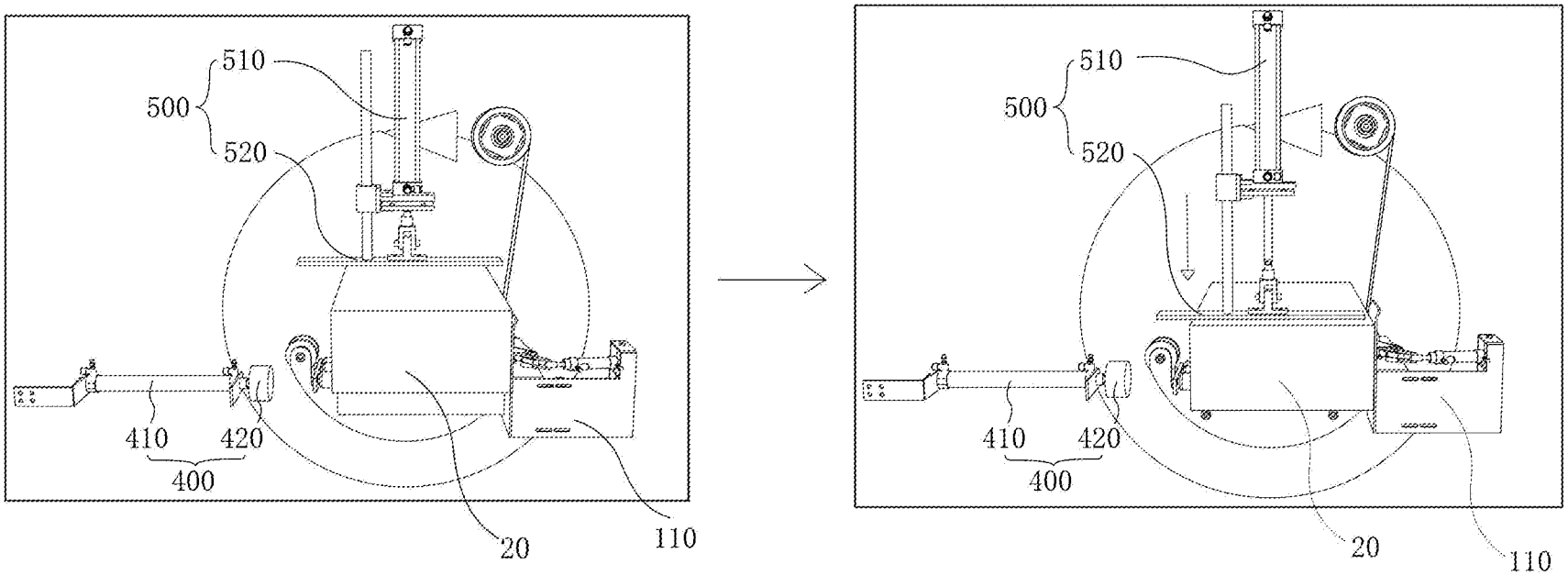
Figure 17B:
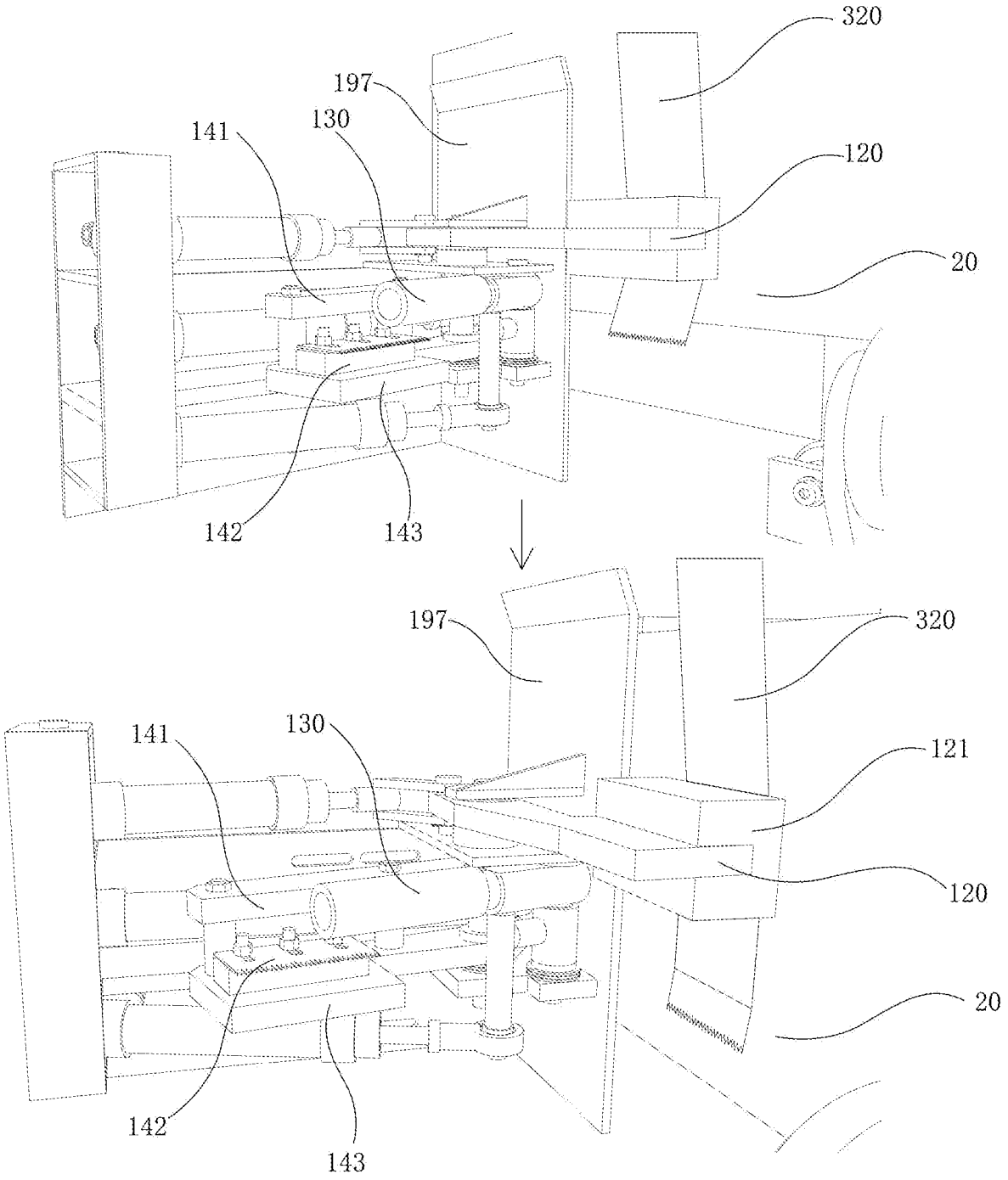
Figure 17C:
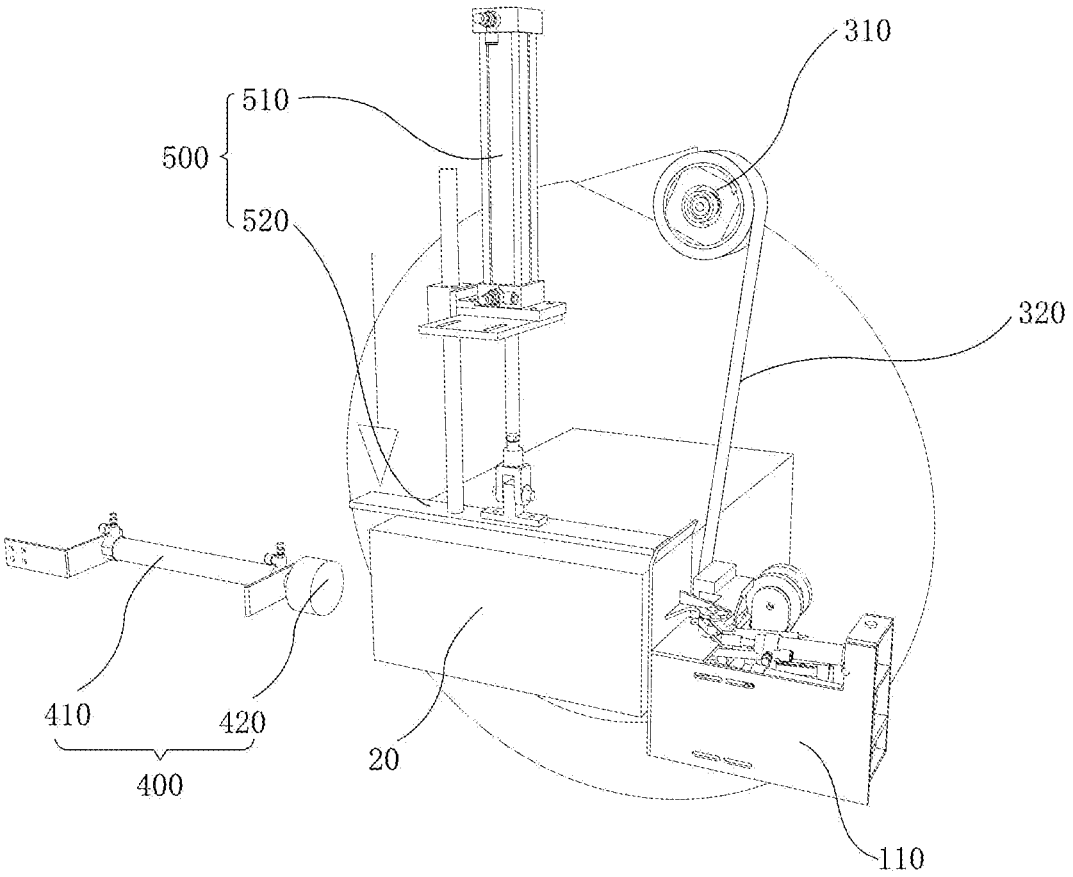
FIG. 17C shows the state diagram when the box is pressed under the vertical press (the 6th sub-operation process: 0.75 seconds)

FIGS. 17A to 17C show the sixth sub-operation process of the tape packing device according to an embodiment of the present invention, in which FIG. 17A shows the action process of the vertical press 500 pressing down the box 20; FIG. 17B shows the changing process of the sticking state of the tape 320 when the box 20 moves down; FIG. 17C shows the state when the box 20 is pressed under the vertical press 500. In this process, the controller 100 (as shown in FIG. 1) controls the vertical press 500 to start and press the box 20 downward such that the box 20 is compressed, for example, the upper cover of the box 20 moves down. At this time, the tape packing device 10 runs to 0.75 seconds. The vertical pressing plate 520 of the vertical press 500 abuts against the cover of the box 20. The top wall of the box 20 (such as the lid of the box) is pressed down and moved a predetermined distance. On the one hand, the vertical press 500 can compress the box 20 tightly; on the other hand, when the box 20 moves down, the head of the tape 320 will be pulled down. When the tape head moves down, more of the tape 320 will be pressed by the tape head pressing arm 120 onto the box 20. This action helps the tape 320 to adhere better to the box 20.

Figure 18A:
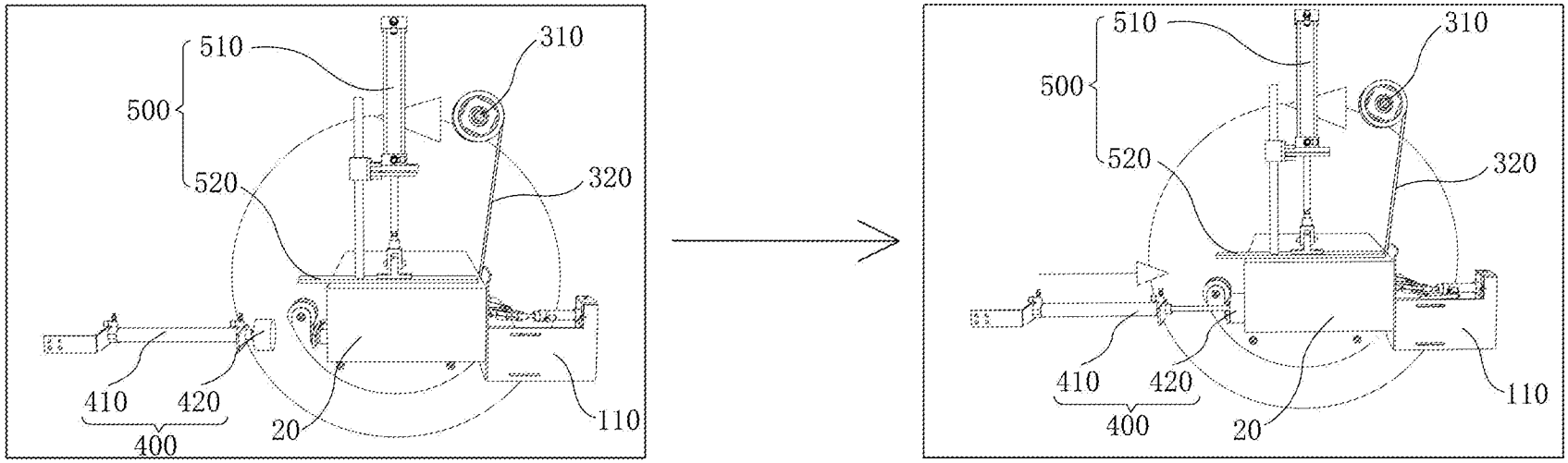
Figure 18B:
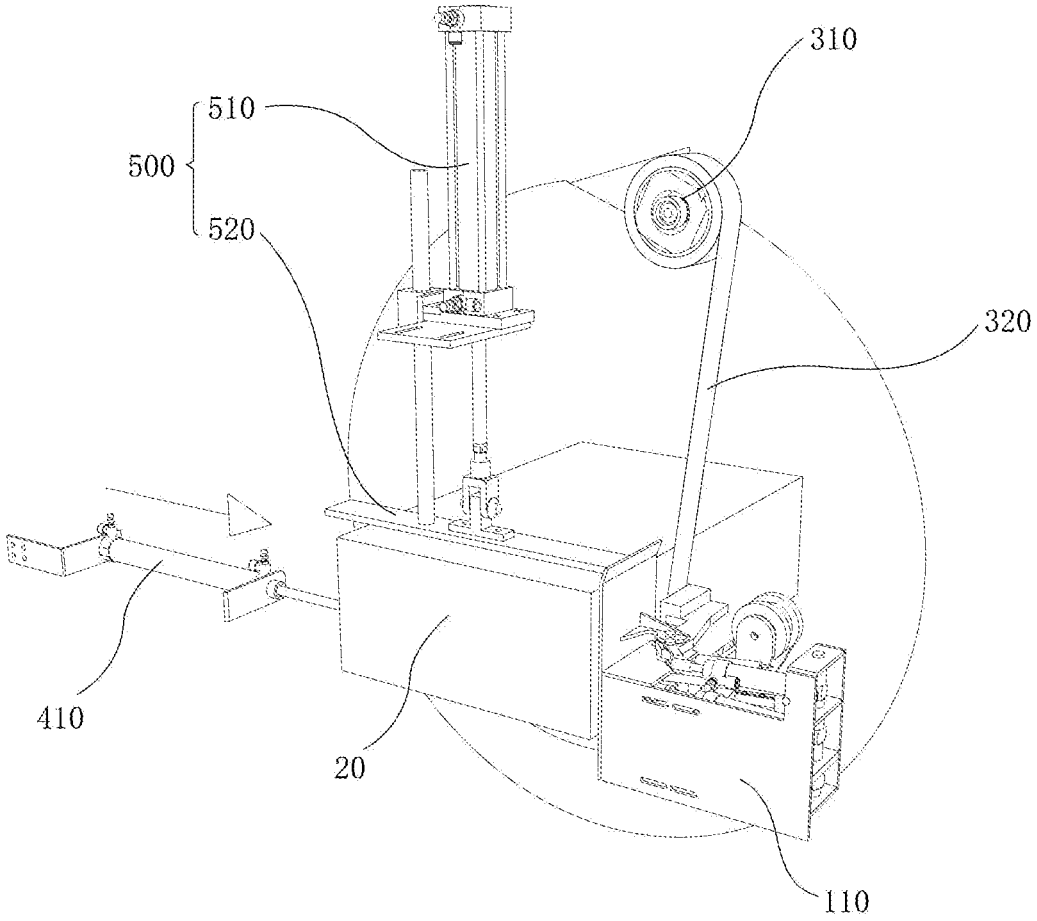

FIGS. 18A and 18B show the seventh sub-operation process of the tape packing device 10 according to an embodiment of the present invention, in which, FIG. 18A shows the extension process of the horizontal press 400 for the second time, FIG. 18B shows the state of the horizontal press 400 after it is extended for the second time. In this process, the controller 100 (as shown in FIG. 1) controls the extension of the horizontal press 400, at this time, the tape packing device 10 runs to 0.90 seconds. Before the operation of the tape dispenser 300, the horizontal press 400 is extended to extrude the box 20, which ensures that the head end of the tape 320 is stably attached to the box 20, and avoid tearing the tape 320 off due to the start jumps of the tape dispenser 300. Furthermore, the box 20 can be held firmly during the tape dispensing.

Figure 19A:
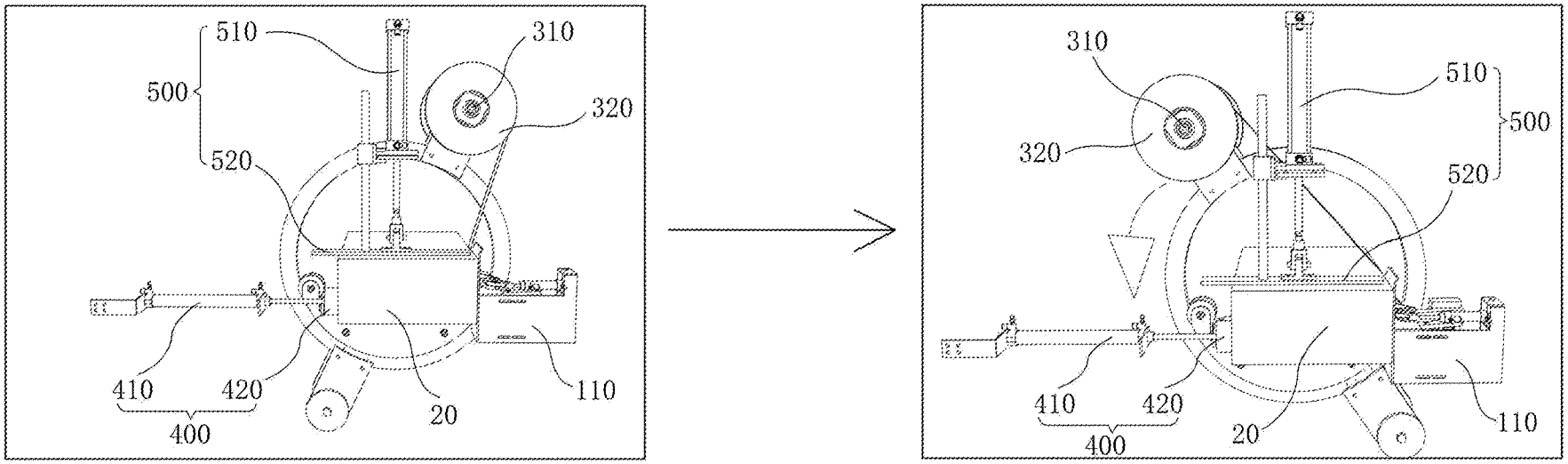
Figure 19B:
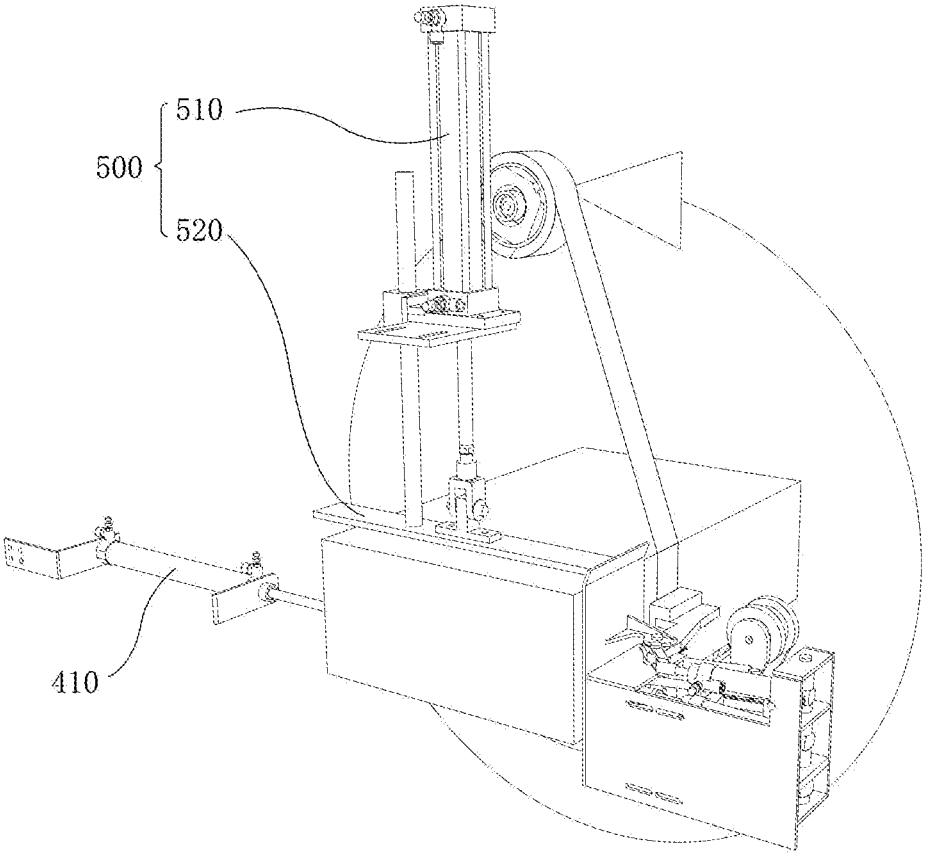

FIGS. 19A and 19B show the eighth sub-operation process of the tape packing device 10 according to an embodiment of the present invention, in which FIG. 19A shows the action process of the tape dispenser 300; FIG. 19B shows the tape dispenser 300 when it moves. In this process, the controller 100 (as shown in FIG. 1) controls the operation of the tape dispenser 300 so that the tape mounting seat 310 rotates around the box 20 according to a predetermined number of turns, so that the tape 320 binds the box 20. As an example, the predetermined number of laps to at least two laps. In this embodiment, it is taken as an example that the tape is wrapped around the box 20 two rounds. When the tape mounting seat 310 of the tape dispenser 300 operates to the state shown in FIG. 19B, the tape packing device 10 operates for 1.25 seconds. In the example shown in the drawings, the tape mounting seat 310 rotates counterclockwise to start the first winding. The tape 320 can be continuously pasted with the right side wall, the top wall, the left side wall, and the bottom of the box 20 along with the rotation of the tape mounting seat 310.

Figure 20A:
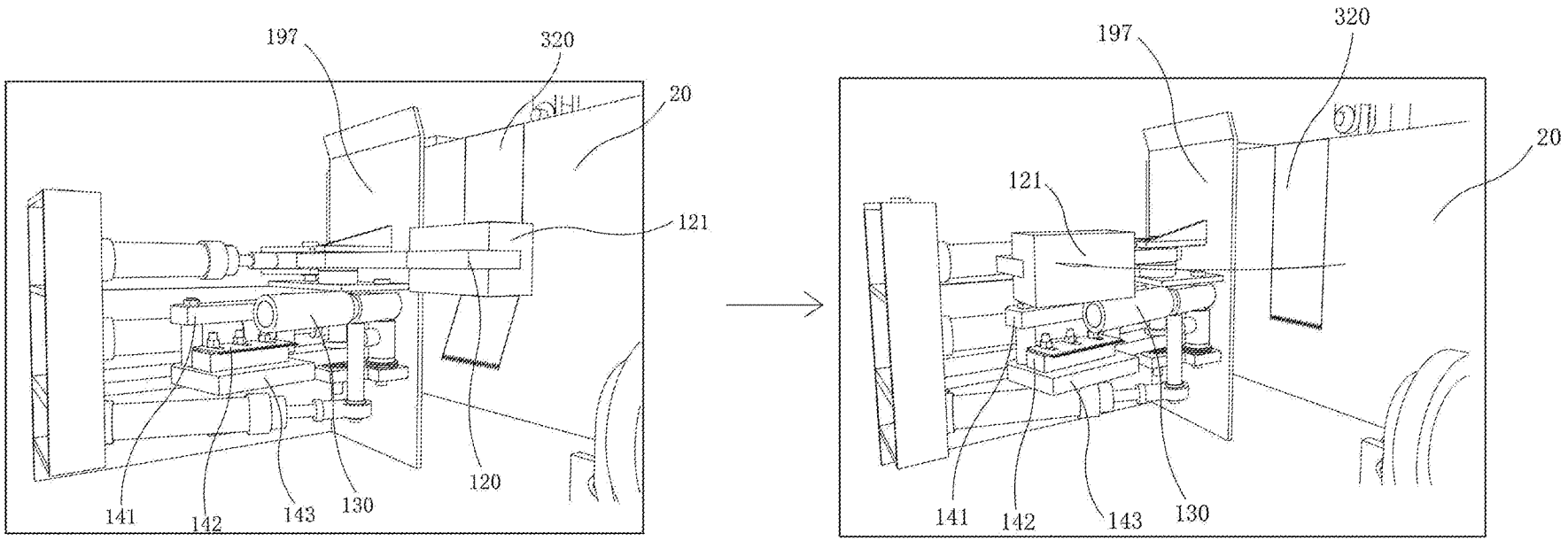
Figure 20B:
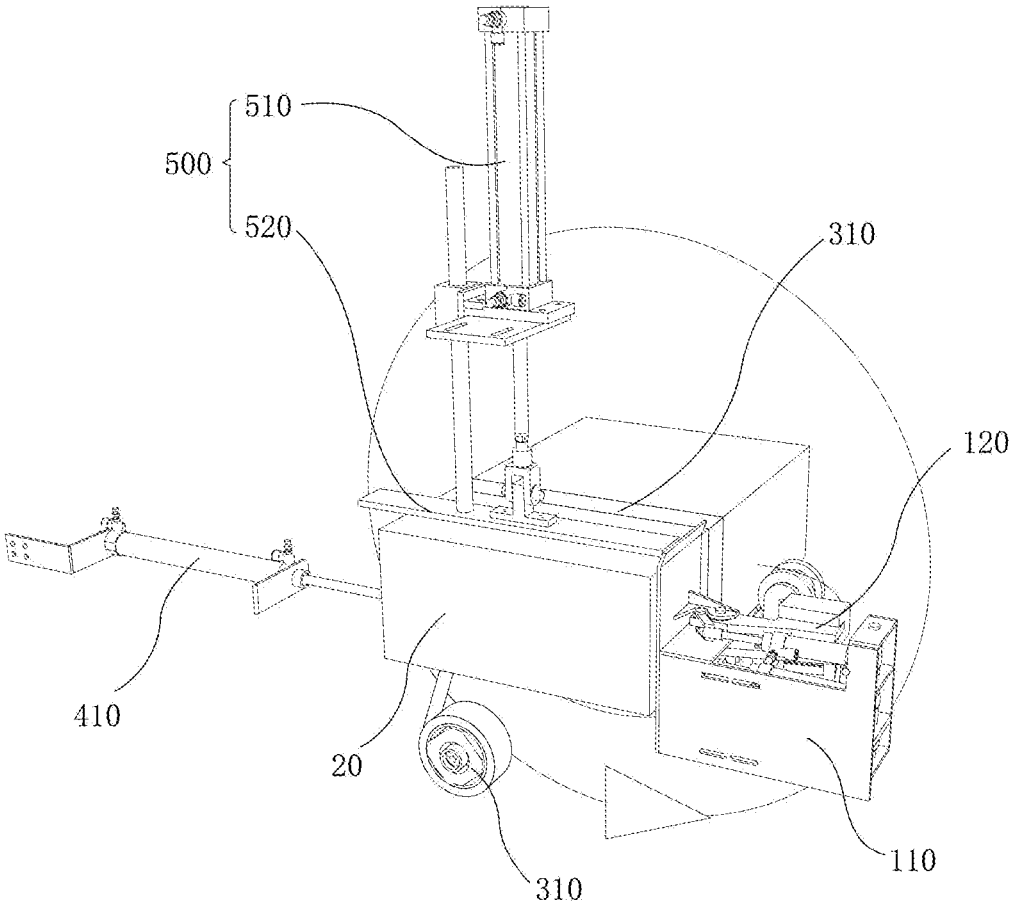

FIGS. 20A and 20B show the ninth sub-operation process of the tape packing device 10 of an embodiment of the present invention, in which, FIG. 20A shows the action process of the tape head pressing arm 120 moving away from the box 20; FIG. 20B shows the state of the tape head pressing arm 120 moving away from the box 20. In the process, when the tape 320 is about to complete the first round of winding, the controller 100 (as shown in FIG. 1) controls the tape head pressing arm 120 to retract. After the tape head pressing arm 120 is retracted, the tape packing device 10 runs for 1.98 seconds. The tape head pressing arm 120 is retracted to prevent the tape head pressing arm 120 from interfering with the tape 320.

Figure 21A:
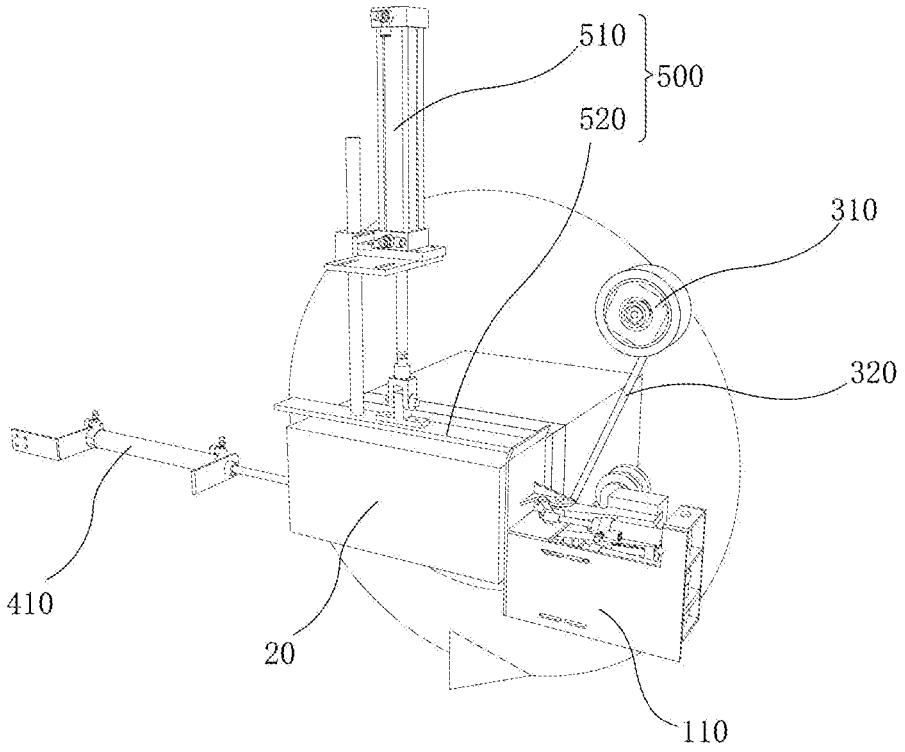
FIGS. 21A and 21B show the tenth sub-operation process of the tape packing device of an embodiment of the present invention.
Figure 21B:
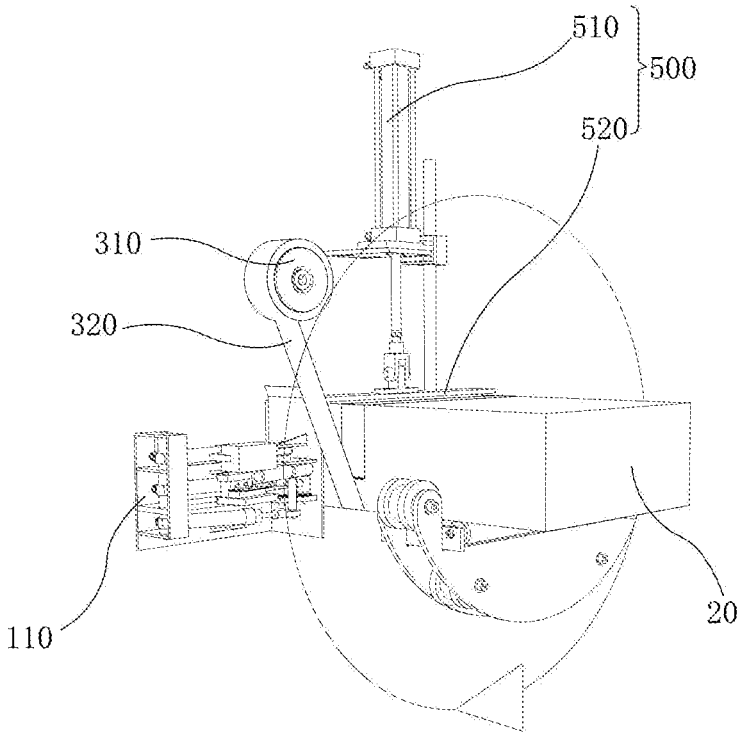

FIGS. 21A and 21B show the tenth sub-operation process of the tape packing device 10 according to an embodiment of the present invention. FIGS. 21A and 21B respectively show the front perspective view and a rear perspective view of the tape packing device when the tape winding for the first round is finished. In this process, the controller 100 (as shown in FIG. 1) controls the tape mounting seat 310 of the tape dispenser 300 to rotate for the first round. When the tape mounting seat 310 completes the first round of rotation, the tape packing device 10 runs for 2.20 seconds. At this time, each operating arm of the tape end processing unit 110 is completely separated from box 20 and the tape 320, which provides an operating space for the tape 320 to fit the box 20 and avoid interference.

Figure 22A:
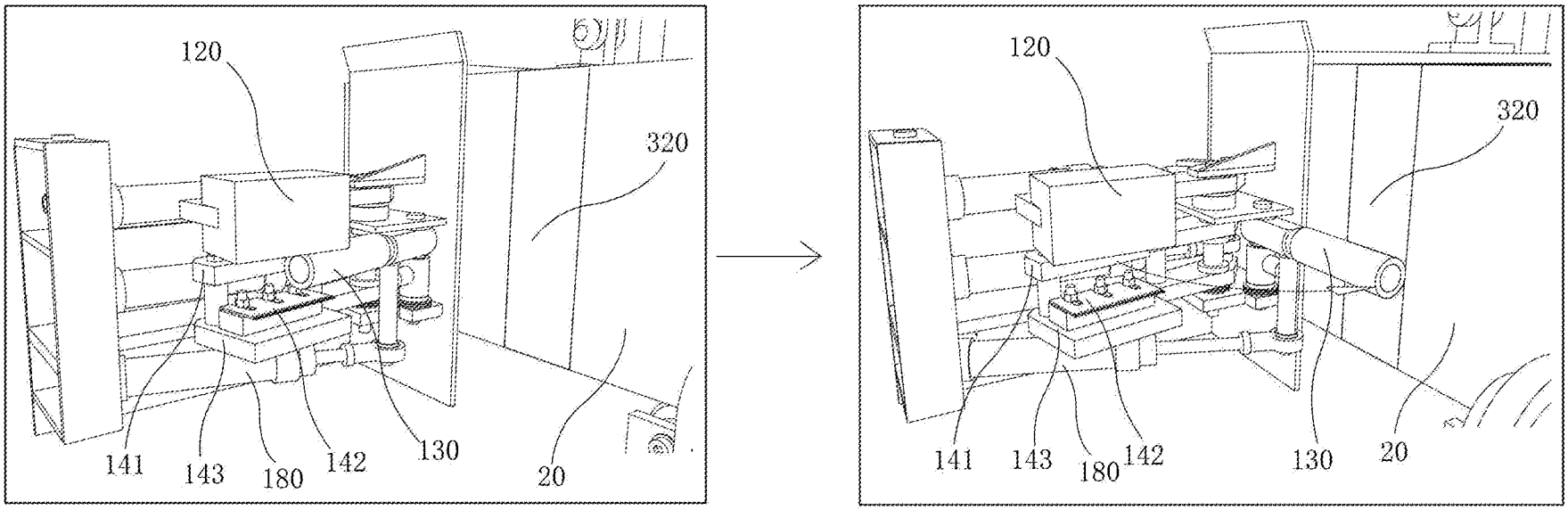
Figure 22B:
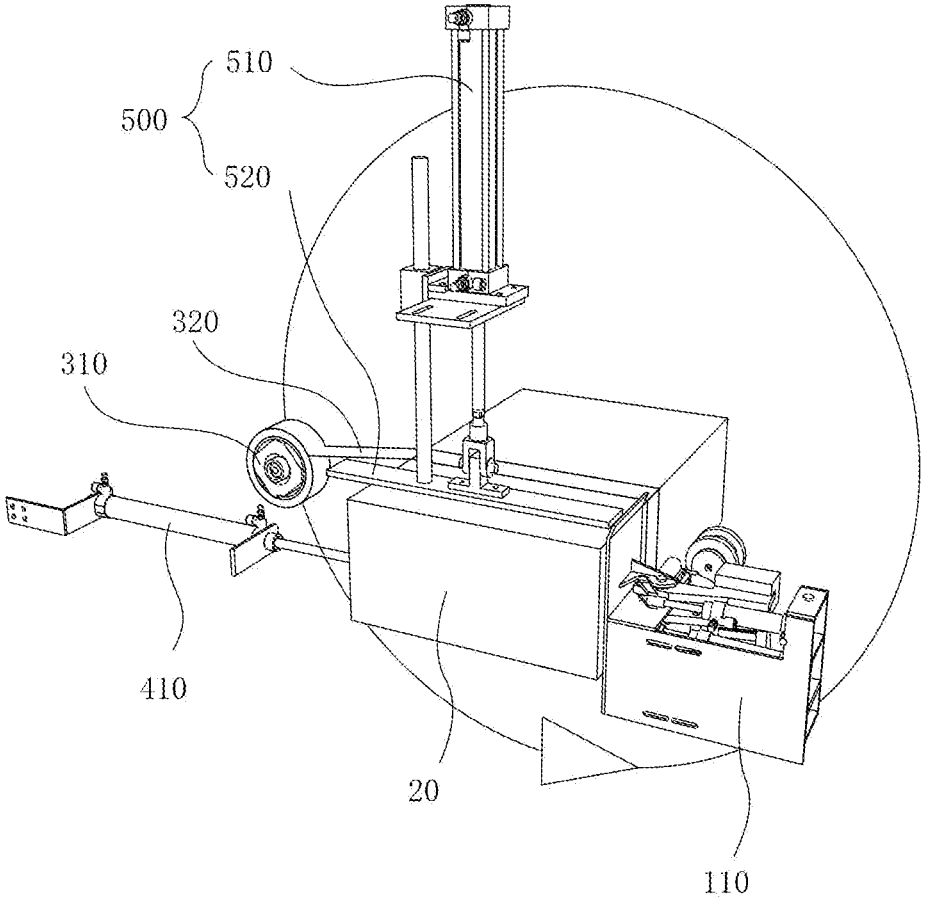

FIGS. 22A and 22B show the tenth sub-operation process of the tape packing device 10 of an embodiment of the present invention, in which, FIG. 22A shows a process of the clamping support arm 130 moving close to the tape 320; FIG. 22B shows a state of the clamping support arm 130 after moving close to the tape 320. In this process, during the tape 320 is wound for the second round and before the second round (last round) of winding is completed, the controller 100 (as shown in FIG. 1) controls the third driving unit 180 to move the clamping support arm 130 to the packing position. At this time, the tape packing device operated for 2.45 seconds. The clamping support arm 130 is close to the side wall of the box 20 to facilitate support and clamping of the tape 320 to prepare for the subsequent cutting operation.

Figure 23A:
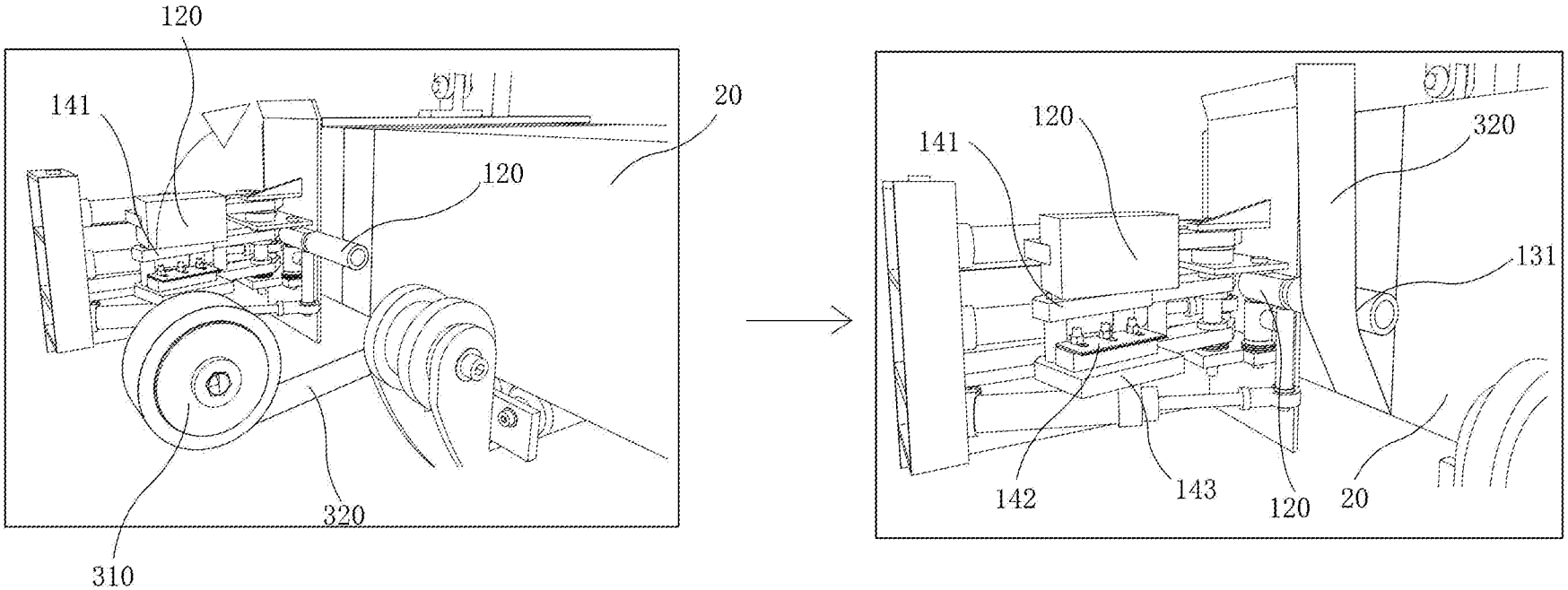
Figure 23B:
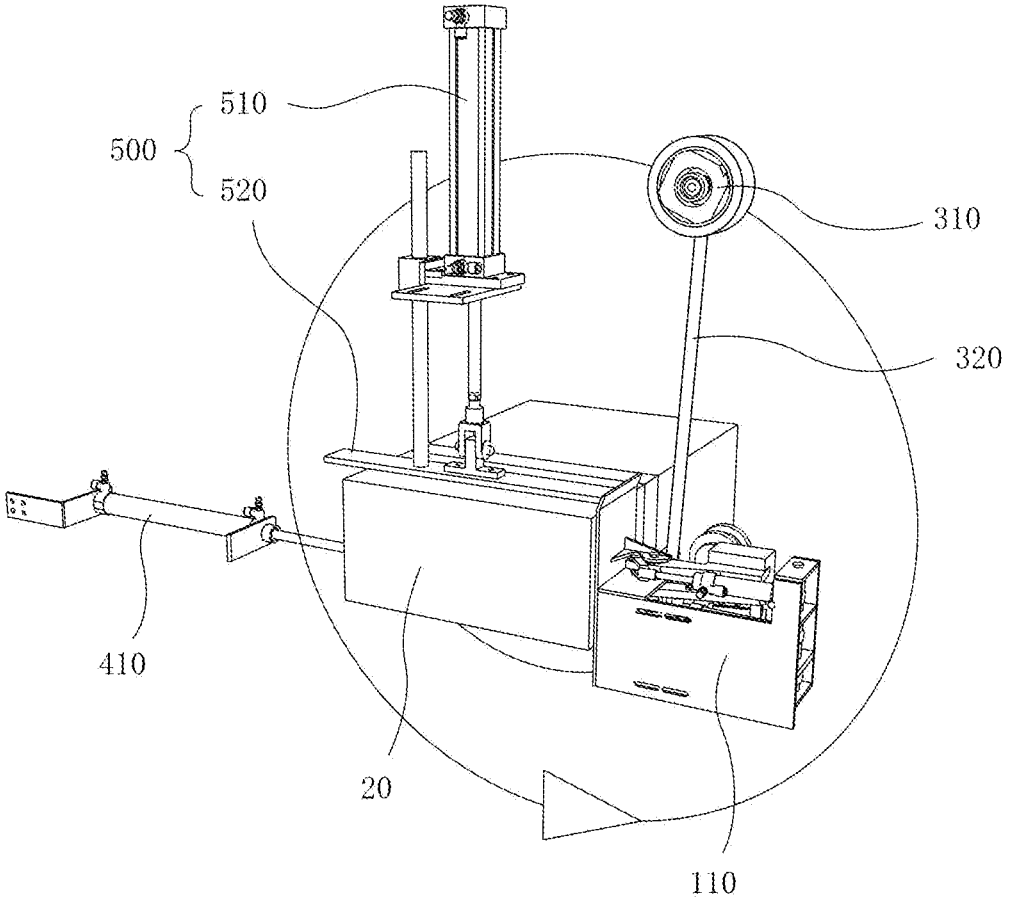

FIGS. 23A and 23B show the eleventh sub-operation process of the tape packing device 10 according to an embodiment of the present invention, in which, FIG. 23A shows a schematic diagram of the tape dispenser 300 about to complete the second winding of the winding; FIG. 23B shows the state of the tape dispenser 300 when the second winding is completed. In this process, the controller 100 (as shown in FIG. 1) controls the tape 320 to wrap around the right side surface of the box 20 and have the tape 320 pass over the clamping support arm 130, and the inner surface of the tape 320 is in contact with the clamping support arm 130. At this time, the tape packing device 10 runs for 2.81 seconds with the last round winding finished. Then the tape dispenser 300 stops operation.

Figure 24A:
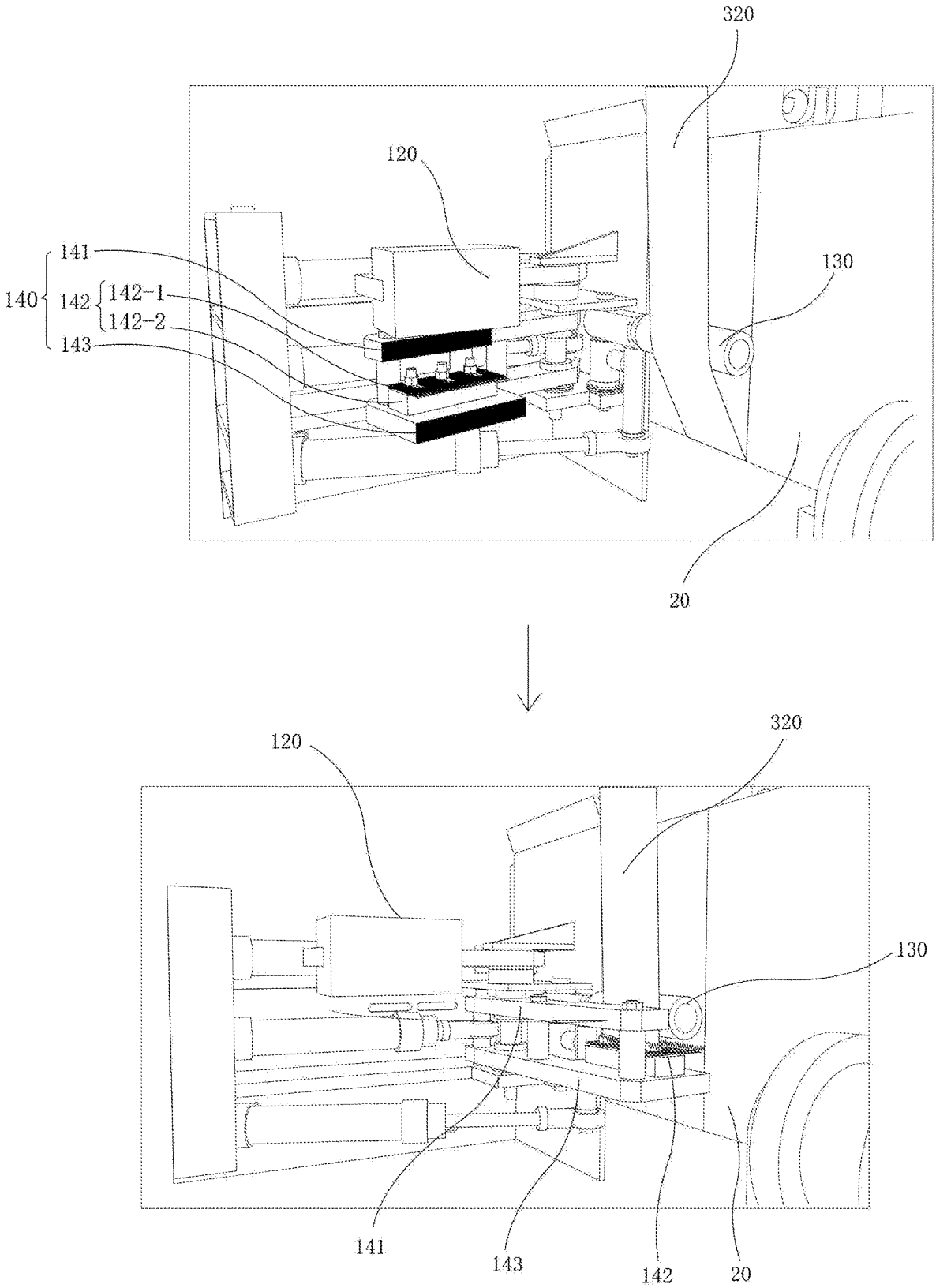
Figure 24B:
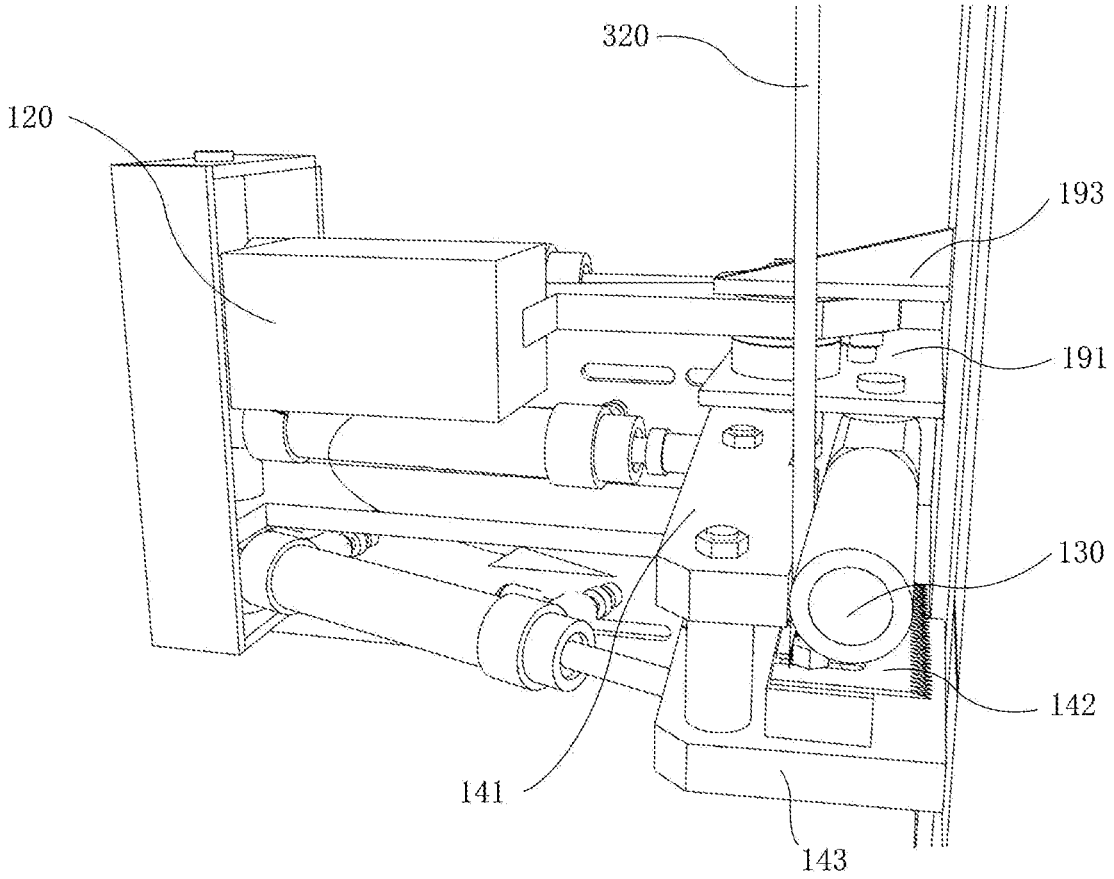
Figure 24C:
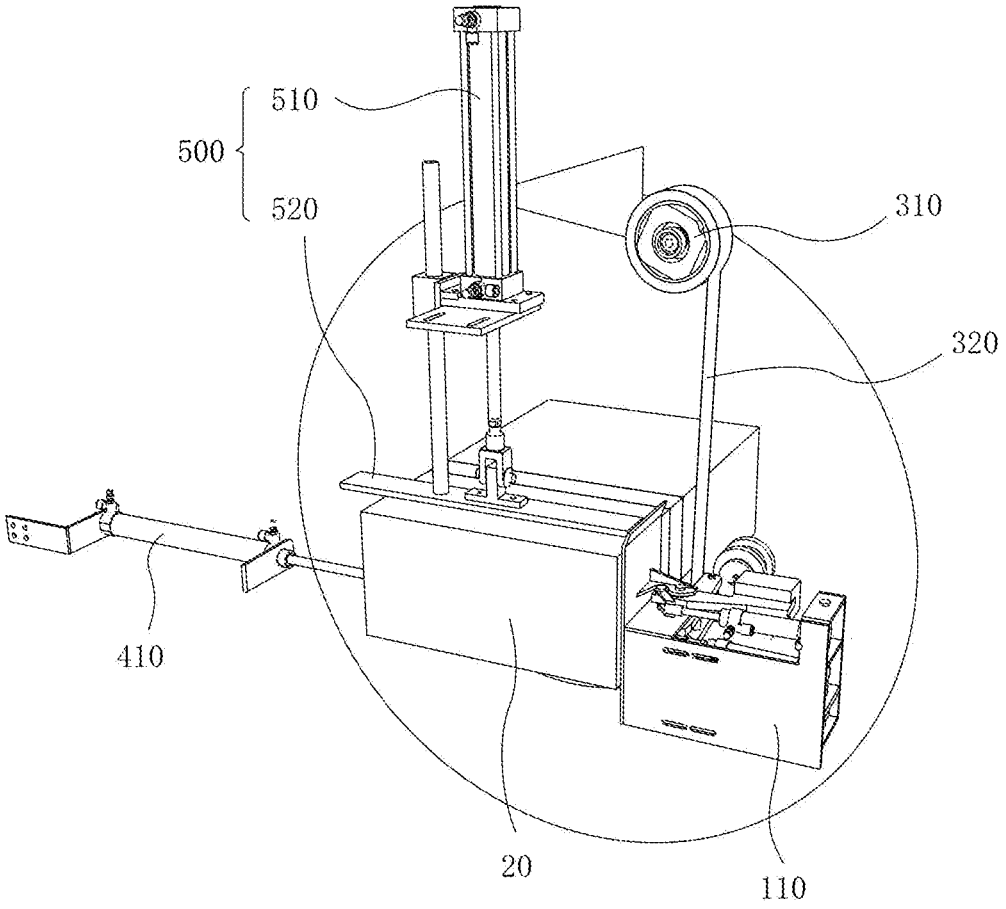
Figure 24D:
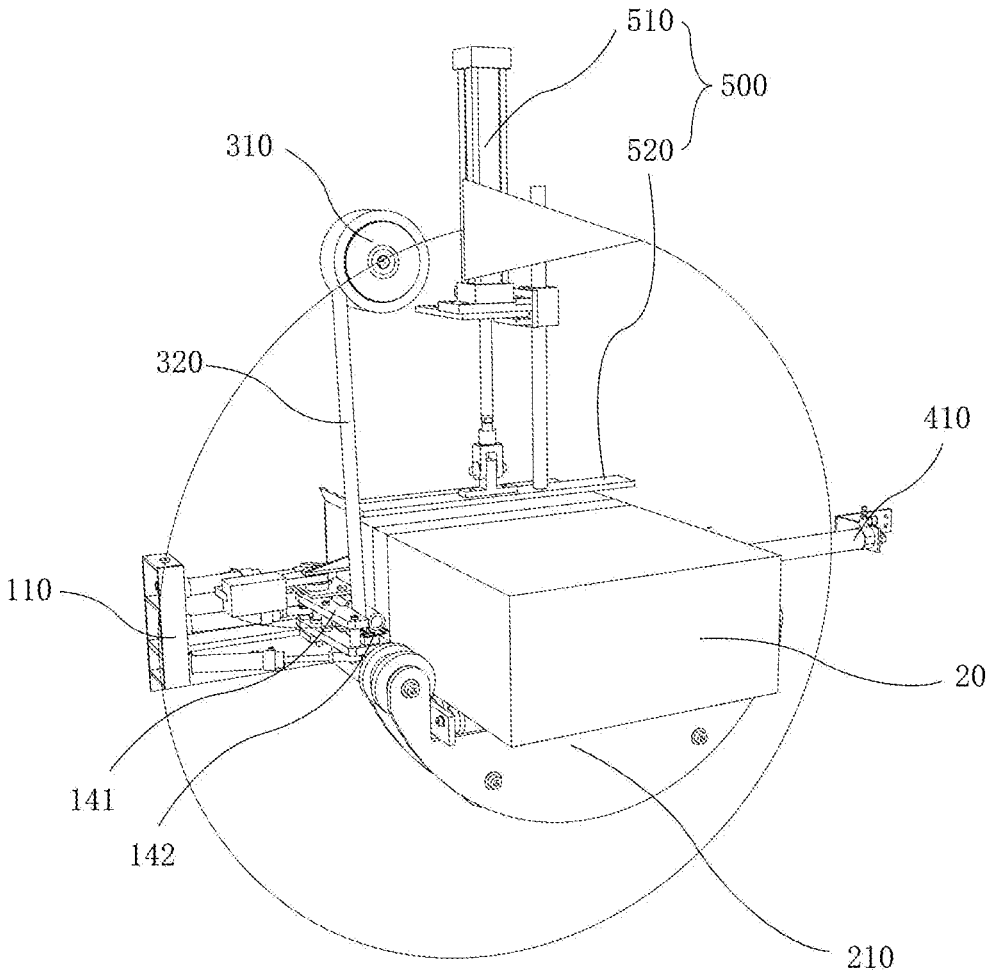

FIGS. 24A to 24D show the twelfth sub-operation process of the tape packing device 10 according to an embodiment of the present invention, in which, FIG. 24A shows the action process of the clamping and cutting arm 140 cutting the tape; FIGS. 24B to 24D show the state when the clamping and cutting arm 140 is cutting the tape 320. During this process, the controller 100 (as shown in FIG. 1) controls the clamping and cutting arm 140 to move to the packing position, clamp and cut the tape 320, and press the tail of the tape 320 onto the box 20. At this time, the tape packing device has operated for 2.90 seconds.

Since the clamping and cutting arm 140 may include three different modules, namely a tape clamping module, a tape cutting module, and a tape tail pressing module, the tape clamping operation, the tape cutting operation, and the tape tail pressing operation may be performed at the same time. Specifically, the tape clamping arm 141, the cutting module 142, and the tape tail pressing arm 143 move to a packing position at the same time, and multiple different functions can be realized by one driving operation. When the clamping and cutting arm 140 is repositioned at the packing position against the clamping support arm 130, the first function is that the tape 320 can be cut, and the second function is that the tape 320 can be clamped between the clamping support arm 130 and the tape clamping arm 141. The third function is that the tail of the tape 320 can be pressed onto the box 20 to prevent the tail of the tape 320 from lifting. The fourth function is that the cutting blade 142_1 (as shown in FIG. 9A and FIG. 10A) of the cutting module 142 can be prevented from contacting the box 20 by the tail pressing arm 150 to prevent the box 20 from being scratched.

Figure 25A:
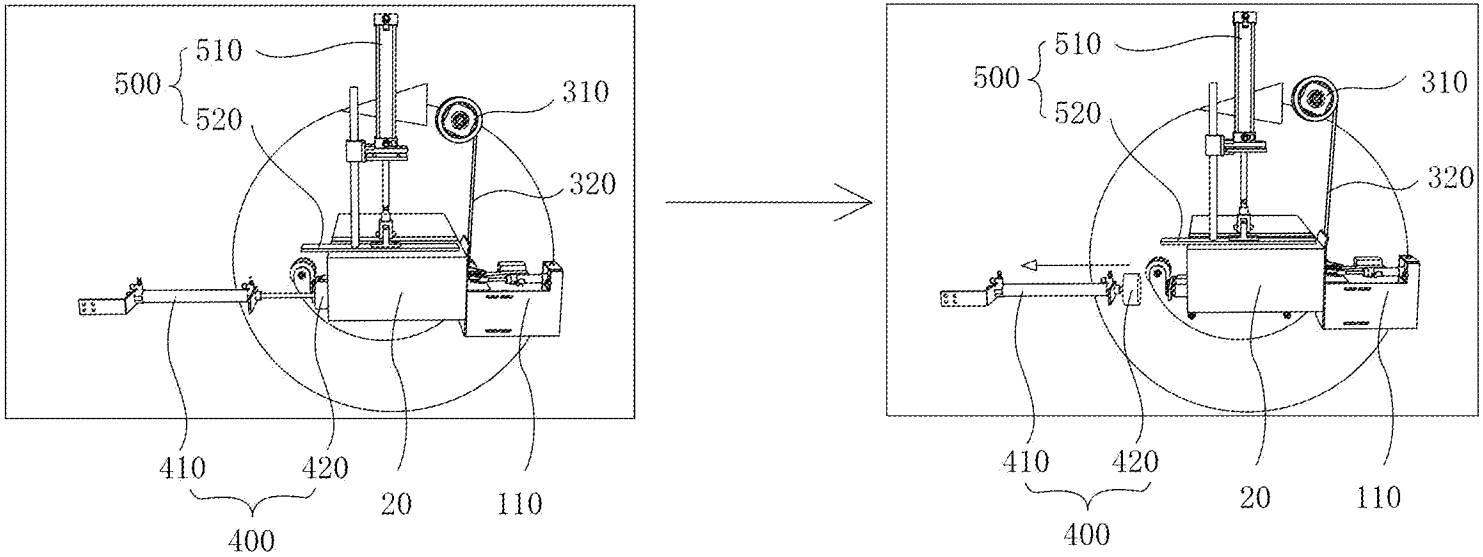
Figure 25B:
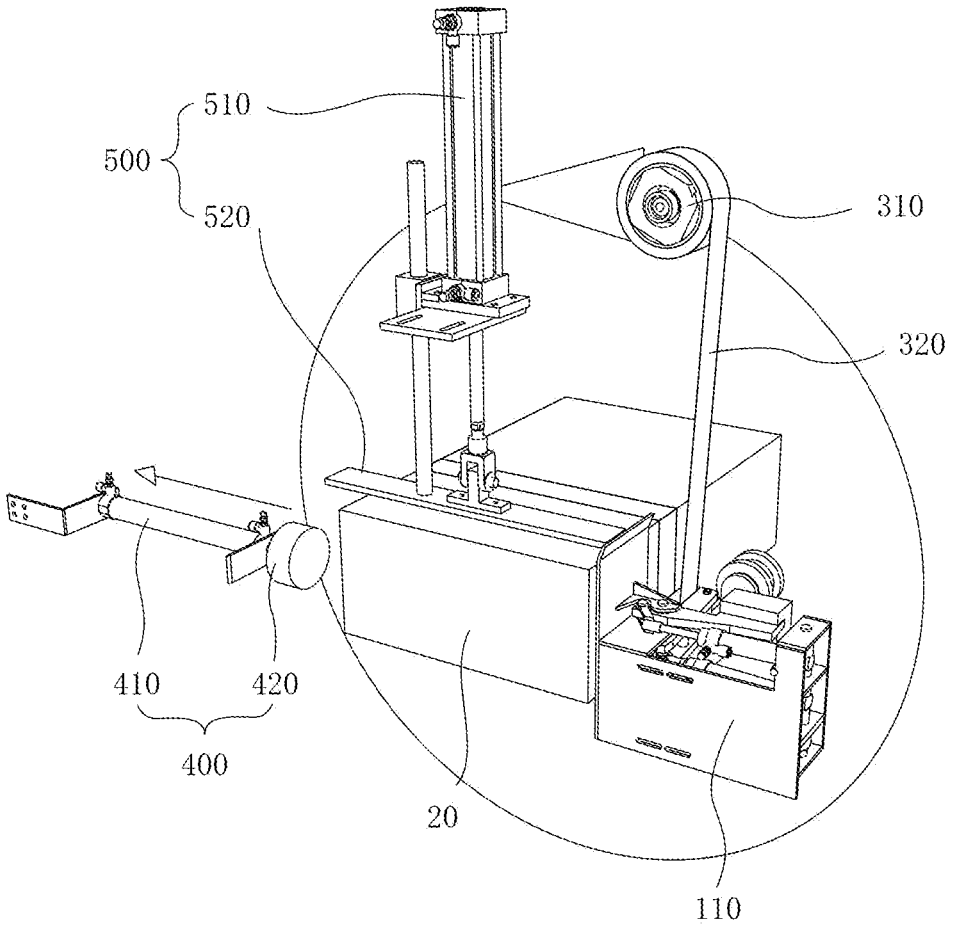

FIGS. 25A and 25B show the fourteenth sub-operation process of the tape packing device 10 of an embodiment of the present invention, in which, FIG. 25A shows the action of the horizontal press 400 moving away from the box, FIG. 25B shows the state of the horizontal press 400 after it is away from the box. In this process, the controller 100 (as shown in FIG. 1) controls the horizontal press 400 to reset and release the box 20.

Figure 26A:
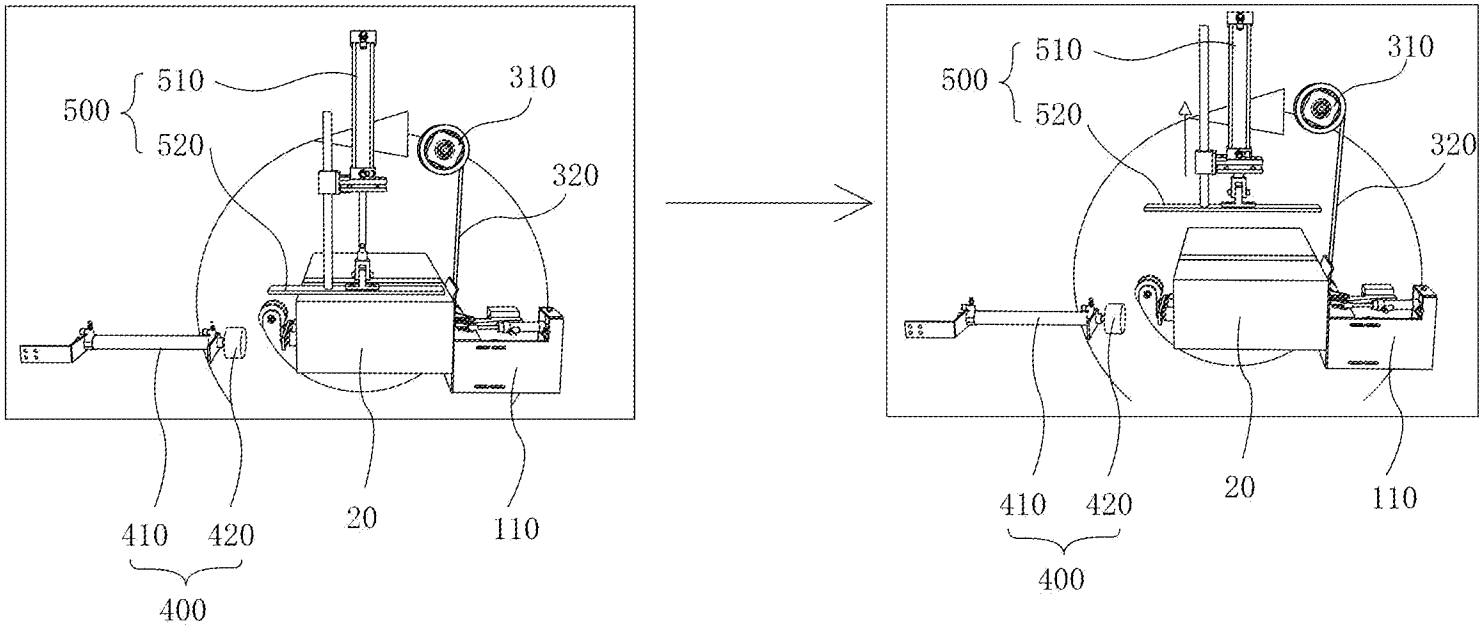
Figure 26B:
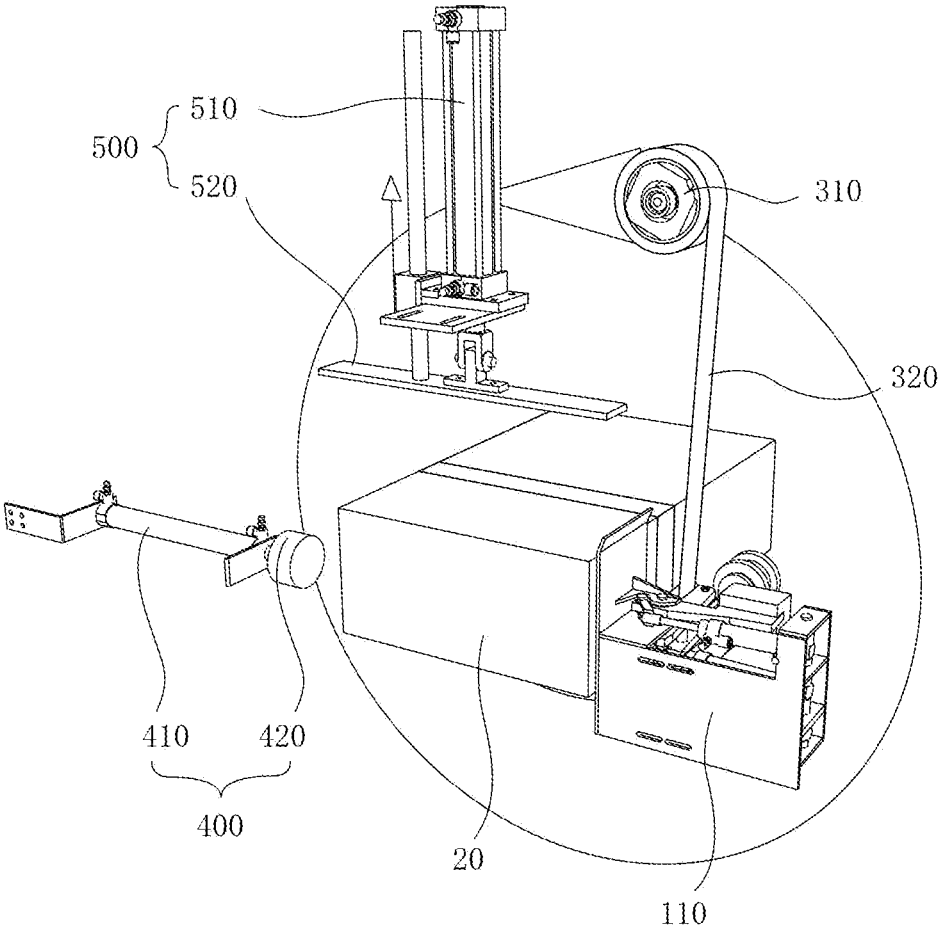
Figure 27:
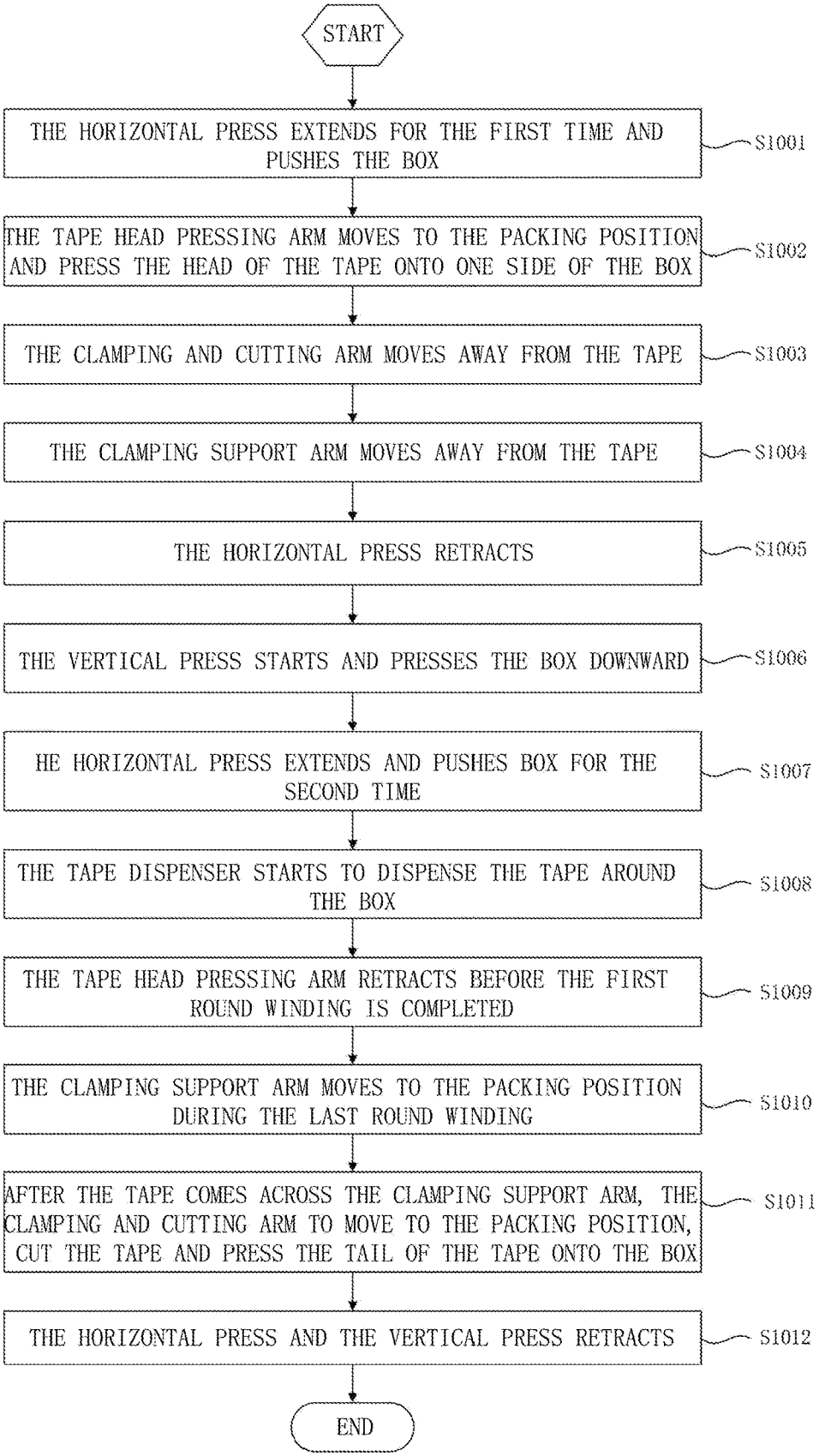
FIG. 27 shows a flowchart of a control method of a tape packing device according to an embodiment of the present invention.
Figure 28:
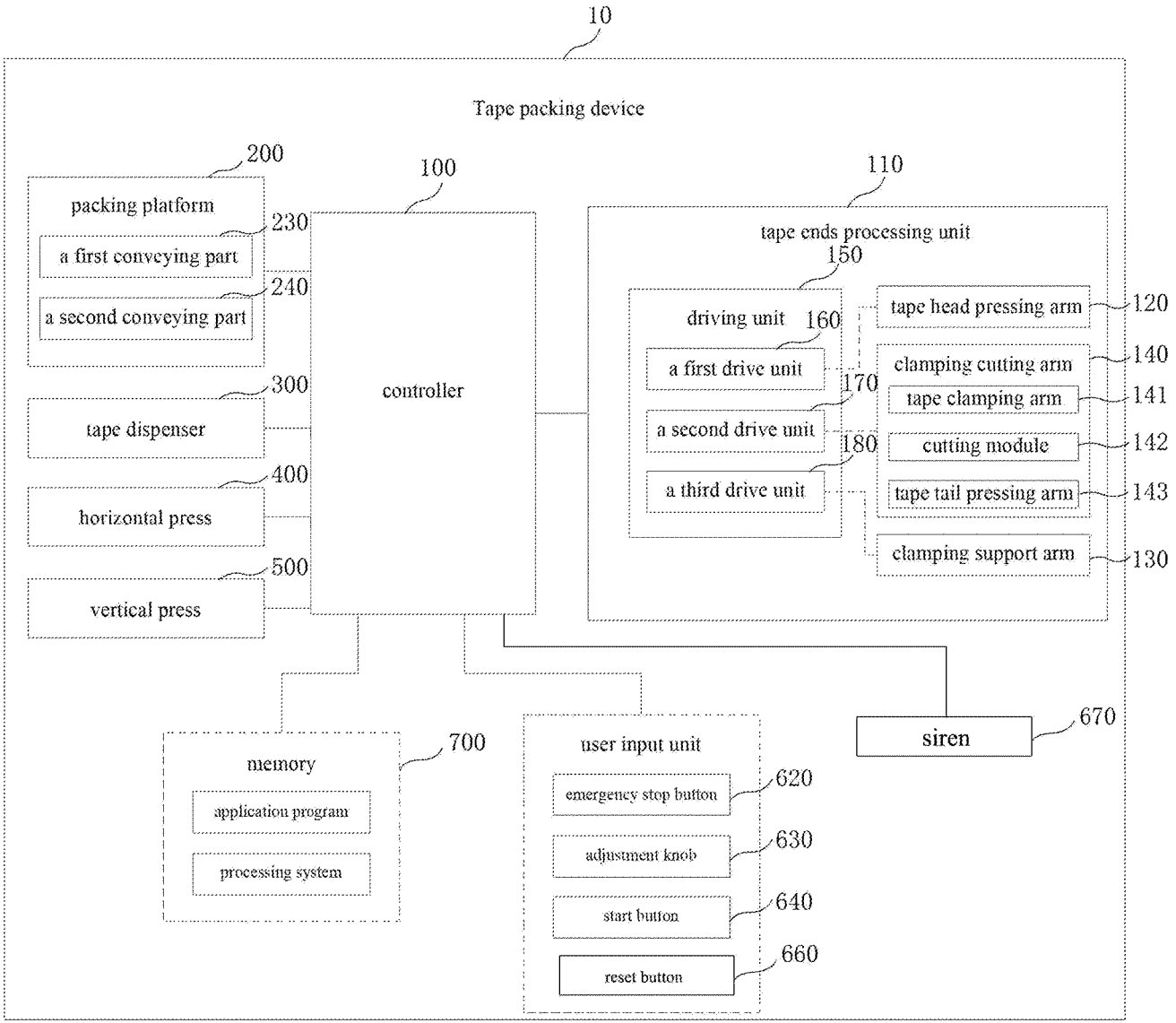
FIG. 28 shows a structural block diagram of a tape packing device according to an embodiment of the present invention.

FIGS. 26A and 26B show the fifteenth sub-operation process of the tape packing device 10 according to an embodiment of the present invention, in which, FIG. 26A shows the process of the vertical press 500 moving away from the box 20; FIG. 26B shows the three-dimensional schematic diagram of the vertical press 500 after it moves away from the box 20. In this process, the controller 100 (as shown in FIG. 1) controls the vertical press 500 to retract, release the box 20, and complete the packing operation. At this time, the tape packing device 10 runs for 3.20 seconds to complete the packing operation of wrapping the box 20 with two rounds of tape 320. The horizontal press 400 and the vertical press 500 can move simultaneously.

Of course, the operation process of the tape packing device 10 can also be different from the above-mentioned embodiment. For example, before the tape dispenser 300 rotates for the first turn, the clamping and cutting arm 140 can be retracted, the clamping support arm 130 can be retracted, and the tape head pressing arm 120 can be retracted successively. It is not limited to the above specific control steps.

FIG. 30 shows a flowchart of a control method of the tape packing device 10 according to an embodiment of the present invention.

As shown in FIGS. 11A-26B, and FIG. 30, the control method of the tape packing device 10 may include the following steps:

- S1001: the horizontal press 400 extends for the first time and pushes the box 20 so that the side of the box 20 comes into contact with the first baffle 197 of the tape end processing unit 110;
- S1002: the tape head pressing arm 120 moves toward and press the head of the tape 320 onto one side of the box 20;
- S1003: Control the clamping and cutting arm 140 to move away from the tape 320;

S1004: Control the clamping support arm 130 to move away from the tape 320;

S1005: Control the reset of the horizontal press 400;

S1006: the vertical press 500 starts and squeezes the box 20 downward;

S1007: the horizontal press 400 pushes box 20 for the second time;

S1008: Control the tape dispenser 300 to dispense the tape around the box 20;

S1009: Before the first round winding is completed, control the tape head pressing arm 120 to retract;

S1010: Control the clamping support arm 130 to move to the packing position during the last round winding;

S1011: After the tape 320 passes through the clamping support arm 130, control the clamping and cutting arm 140 to move to the packing position, clamp the tape 320 on the clamping support arm 130, cut the tape 320 under the clamping support arm 130, and press the tail of the tape 320 onto the box;

S1012: Control the horizontal press 400 and the vertical press 500 to retract, then the packing operation is completed.

In the example shown in the drawing, the tape 320 is wrapped around the box 20 twice. However, the embodiment of the present invention is not limited to this, and the tape 320 can be wrapped around the box 20 more times to ensure the packing effect. In this case, in step S1010, before completing the last winding of the winding, the clamping support arm 130 is controlled to move to the packaging position, and in step S1011, after the tape mounting seat 310 has rotated for the last turn, the clamping and cutting arm 140 is controlled to move to the packaging position and cut the tape, and then the packaging is completed.

In addition, in the case that the tape packing device 10 may not include the horizontal press 400 and/or the vertical press 500, the box 20 can be manually placed in the packing position without the need for a controller 100 (as shown in FIG. 1) to control the horizontal press 400 and/or vertical press 500. In the case that the tape packing device 10 does not include the tape clamping arm 130 and the clamping support arm 130, there is no need for a controller 100 to control the tape clamping arm 141 and the clamping support arm 130, which satisfies the requirement of squeezing the head of the tape 320 and automatically cutting the tape 320, which can also improve the packing efficiency. The tape end processing unit 110 can be assembled as needed, and the specification will not list them all here.

In the example shown in FIG. 31, the tape packaging device 10 may include a memory 700, which can store inventions and processing systems so that the controller 100 performs packing tape operation(s) according to the program or processing system stored in a memory 700.

As noted, aspects of the present invention may take the form of a computer program product embodied in one or more computer readable medium(s) having computer readable program code embodied thereon. Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. The specification and drawings are a non-limiting example. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described herein with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It should be noted that any of the methods described herein can include an additional step of providing a system comprising distinct software modules embodied on a computer readable storage medium; the modules can include, for example, one or more distinct software modules for control (e.g., to control the cooling systems using the logic in the flow charts) and/or system design. The method steps can then be carried out, or at least facilitated by, using the distinct software modules and/or sub-modules of the system, as described above, executing on one or more hardware processors. Further, a computer program product can include a computer-readable storage medium with code adapted to be implemented to carry out one or more method steps described herein, including the provision of the system with the distinct software modules.

In any case, it should be understood that the components illustrated herein may be implemented in various forms of hardware, software, or combinations thereof; for example, invention specific integrated circuit(s) (ASICS), functional circuitry, one or more appropriately programmed general purpose digital computers with associated memory, and the like. Given the teachings of the invention provided herein, one of ordinary skill in the related art will be able to contemplate other implementations of the components of the invention.

The specific embodiments of the invention are described in detail above. Although some embodiments have been shown and described, those skilled in the art should understand that without departing from the principle and spirit of the invention whose scope is defined by the claims and their equivalents. In the case of, these embodiments can be modified and improved (for example, different features described in different embodiments can be combined), and these modifications and improvements should also be within the protection scope of this invention.

What is claimed is:

1. A tape packing apparatus for applying tape to an object to be packed, the tape packing apparatus comprising:

a supporting frame;

a drive unit installed on the supporting frame;

a tape dispenser which includes a tape mounting seat capable of rotating around the object to be packed, and the tape mounting seat for mounting a tape;

a tape mounted on the tape mounting seat of the tape dispenser, wherein the tape having a direction of extension and including a tape head and a tape tail;

a controller being electrically connected to the tape dispenser and the drive unit, respectively, and controlling the operations of the tape dispenser and the drive unit;

a tape head pressing arm installed on the supporting frame and connected to the drive unit, and the driving unit configured to drive the tape head pressing arm to move to a packing position such that the tape head is pressed onto the object to be packed;

the tape head pressing arm provide with a pressing plate for pressing the tape onto the object to be packed; and a cutting module installed on the supporting frame and connected with the drive unit, and the drive unit is constructed to drive the cutting module to the packing position to cut the tape;

a tape tail pressing arm provided on a side of the cutting module opposite to the tape head pressing arm, and the tape tail pressing arm moves to the packing position to press the tape tail onto the object to be packed; and a tape clamping module, the tape clamping module installed on the supporting frame and connected with the drive unit, the drive unit configured to drive the tape clamping module to move to the packing position and clamp the tape;

the tape clamping module includes a tape clamping arm and a clamping support arm, the tape clamping arm and the clamping support arm respectively clamp each side of the tape at the packing position, the tape head pressing arm and the cutting module are respectively positioned on each side of the tape clamping module along the extension direction of the tape; and the clamping support arm includes a support roller for supporting the tape;

wherein the tape clamping module, the cutting module, and the tape tail pressing arm, when each is located at the packing position are arranged vertically with the cutting module located between the tape clamping module and the tape tail pressing arm.

2. The tape packing apparatus according to claim 1, wherein the cutting module includes a cutting blade support arm and a cutting blade installed on the cutting blade support arm, and the drive unit can drive each of the tape clamping arm, the cutting blade support arm and the tape tail pressing arm to move separately, or at least two of them to move simultaneously.

3. The tape packing apparatus according to claim 2, wherein:

at the packing position, the blade edge of the cutting blade protrudes relative to the tape clamping arm, and the tape tail pressing arm protrudes relative to the blade edge of the cutting blade.

4. The tape packing apparatus according to claim 1, wherein the tape packing apparatus further comprises a packing platform which includes a support stand, a first conveying part and a second conveying part, and the supporting stand is positioned between the first conveying part and the second conveying part and a gap is left respectively between the supporting stand and the first conveying part and between the supporting stand and the second conveying part, wherein the tape is an adhesive tape, wherein the gap is for the tape mounting seat to move through such that the tape is adhered to the object to be packed after passing through the gap.

5. The tape packing apparatus according to claim 4, wherein the tape dispenser comprises:

a first transmission wheel on which the tape mounting seat is installed; and a first transmission wheel driver for driving the first transmission wheel to rotate, thereby driving the tape mounting seat to rotate.

6. The tape packing apparatus according to claim 5, wherein:

two tape mounting seats are provided and symmetrically positioned on each side of the first transmission wheel along an axial direction of the first transmission wheel;

two tape end processing units are provide and respectively position on each side of the first transmission wheel;

the first transmission wheel is in ring-shape, and the packing platform extends to pass through the first transmission wheel.

7. The tape packing apparatus according to claim 5, wherein the tape dispenser further comprises:

a second transmission wheel and a transmission belt, the transmission belt is sleeved on the first transmission wheel and the second transmission wheel, the first transmission wheel driver is connected with the second transmission wheel, and the first transmission wheel is driven by the rotation of the second transmission wheel.

8. The tape packing apparatus according to claim 4, wherein the support frame, the drive unit, the tape head pressing arm, the cutting module, and the tape clamping module constitute a tape end processing unit, and the tape packing apparatus further comprises:

a horizontal press being provided at one side of the packing platform opposite to the tape end processing unit is distributed on opposite sides of the packing platform, and is used to push the object to be packed to the packing position transversely;

a vertical press, being provided above the packing platform and used to press the object to be packed downwards.

9. The tape packing apparatus according to claim 8, wherein:

the horizontal press includes a fourth telescopic rod and a horizontal press plate connected to one end of the fourth telescopic rod, and the fourth telescopic rod is used to drive the horizontal pressing plate to move laterally;

the vertical press includes a fifth telescopic rod and a vertical pressing plate connected to one end of the fifth telescopic rod, and the fifth telescopic rod is used to drive the vertical pressure plate to move up and down.

10. The tape packing apparatus according to claim 8, wherein the controller is configured to:

on an initial state that the tape clamping arm and the clamping support arm clamp the tape, control the tape head pressing arm to move to the packing position for the first time, so that the tape head pressing arm presses the tape head onto the object to be packed;

control the tape dispenser such that the tape mounting seat rotates around the object to be packed for a predetermined turn, so that the tape binds the object to be packed;

after the tape mounting seat is rotated to the predetermined turn, the cutting module is controlled to move to the packing position to cut the tape.

11. The tape packing apparatus according to claim 10, wherein the controller is configured to:

before a step of controlling a movement of the tape head pressing arm to the packing position, start the horizontal press to push the object to be packed toward the tape head pressing arm.

12. The tape packing apparatus according to claim 11, wherein the controller is configured to:

after the head of the tape sticks onto the object to be packed, control the tape packing apparatus to perform the following steps;

control the tape clamping arm and the clamping support arm in sequence to move away from the packing position;

control a reset of the horizontal press;

start the vertical press to press the object to be packed downward;

start the horizontal press again to push the object to be packed toward the tape head pressing arm; and start the tape dispenser to wind tape around the object to be packed.

13. The tape packing apparatus according to claim 12, wherein the controller is configured to:

before completing a first winding of the adhesive tape, control the tape head press arm to move away from the packing position;

before finishing a last turn of the tape winding, control the clamping support arm to move to the packing position, and prepare to support the tape;

after the tape is overlapped on the clamping support arm to complete the final turn, the tape clamping arm is controlled to be close to the clamping support arm to clamp the tape, and the cutting arm is moved to the packing position to cut the tape, and the tape tail pressing arm is controlled to move to the packing position, so as to press the tape tail onto the object to be packaged.

14. The tape packing apparatus according to claim 13, wherein the controller is configured to:

after a step of controlling the movement of the tape tail pressing arm to the packing position, control the reset of the horizontal press and a reset of the vertical press.

15. A tape packing apparatus, the tape packing apparatus comprising:

a supporting frame;

a drive unit installed on the supporting frame;

a tape head pressing arm installed on the supporting frame and connected to the drive unit, and the drive unit configured to drive the tape head pressing arm to move to a packing position such that a tape head is pressed onto an object to be packed;

a tape dispenser which includes a tape mounting seat capable of rotating around the object to be packed, and the tape mounting seat is used for mounting a tape;

a tape installed on the tape mounting seat of the tape dispenser;

a cutting module installed on the supporting frame and connected with the drive unit, and the drive unit is constructed to drive the cutting module to the packing position to cut the tape; and a tape tail pressing arm provided on the side of the cutting module opposite to the tape head pressing arm, and the tape tail pressing arm moves to the packing position to press the tape tail onto the object to be packed, wherein the cutting module includes a cutting blade support arm and a cutting blade installed on the cutting blade support arm, and the drive unit can drive each of a tape clamping arm, the cutting blade support arm and the tape tail pressing arm to move separately, or at least two of them to move simultaneously, wherein the tape packing apparatus comprises a tape clamping module, the tape clamping module is installed on the supporting frame and connected with the drive unit, wherein the drive unit is constructed to drive the tape clamping module to move to the packing position and clamp the tape, wherein the tape clamping module includes the tape clamping arm and a clamping support arm, the tape clamping arm and the clamping support arm respectively clamp each side of the tape at the packing position, the tape head pressing arm and the cutting module are respectively positioned on each side of the tape clamping module along an extension direction of the tape, wherein the tape clamping arm, the cutting module, and the tape tail pressing arm are fixedly together connected to form a clamping and cutting arm, wherein the drive unit includes:

a first drive unit connected with the tape head support arm for driving the tape head support arm to pivot relative to the supporting frame;

a second drive unit connected to the clamping and cutting arm for driving the clamping and cutting arm to pivot relative to the supporting frame; and a third drive unit connected with the clamping support arm for driving the clamping support arm to pivot relative to the supporting frame.

16. The tape packing apparatus according to claim 15, wherein the supporting frame is provided with a first rotating shaft, a second rotating shaft and a third rotating shaft, and the tape head pressing arm is connected to the supporting frame through the first rotating shaft, the first drive unit includes a first telescopic rod, a first end of the first telescopic rod is connected to a first end of the tape head pressing arm such that a second end of the tape head pressing arm is driven to rotate around the first shaft;

a clamping and cutting arm is connected to the supporting frame through the second rotating shaft, the second drive unit includes a second telescopic rod, and a first end of the second telescopic rod is connected to a first end of the clamping and cutting arm such that the second end of the clamping and cutting arm is driven to rotate around the second rotating shaft;

the clamping support arm is connected to the supporting frame through the third rotating shaft, the third drive unit includes a third telescopic rod, and a first end of the third telescopic rod is connected to the clamping support arm such that the clamping support arm is driven to rotate around the third rotating shaft.

17. The tape packing apparatus according to claim 16, wherein:

the supporting frame includes a first supporting plate and a second supporting plate arranged at predetermined intervals, the first rotating shaft is provided on the first supporting plate, and two ends of the second rotating shaft and the third rotating shaft are respectively connected to the first support plate and the second support plate;

both of the tape clamping arm and the tape tail pressing arm are connected to the second rotating shaft and positioned between the first support plate and the second support plate.

18. The tape packing apparatus according to claim 17, wherein the supporting frame further comprises:

a third supporting plate being provided on one side of the first supporting plate opposite to the second supporting plate, and two ends of the first rotating shaft are respectively connected with the first supporting plate and the third supporting plate.

19. The tape packing apparatus according to claim 16, wherein the supporting frame further comprises:

a first baffle being provided on one side of the tape head pressing arm and the cutting module for supporting against the object to be packed at the packing position;

a drive unit supporting frame for supporting the second end of the first telescopic rod, the second end of the second telescopic rod, and the second end of the third telescopic rod.

* * * * *